US006816136B2

(12) United States Patent
Tanaka et al.

(10) Patent No.: US 6,816,136 B2
(45) Date of Patent: Nov. 9, 2004

(54) METHOD OF DRIVING PLASMA DISPLAY PANEL

(75) Inventors: Yoshito Tanaka, Tokyo (JP); Hajime Homma, Tokyo (JP); Kota Araki, Tokyo (JP)

(73) Assignee: NEC Corporation, Tokyo (JP)

( * ) Notice: Subject to any disclaimer, the term of this patent is extended or adjusted under 35 U.S.C. 154(b) by 207 days.

(21) Appl. No.: 10/082,071

(22) Filed: Feb. 26, 2002

(65) Prior Publication Data

US 2002/0118149 A1 Aug. 29, 2002

(30) Foreign Application Priority Data

Feb. 27, 2001 (JP) ..... 2001-052851

(51) Int. Cl.[7] ..... G09G 3/28

(52) U.S. Cl. ..... 345/66; 345/60; 315/169.1; 315/169.3; 315/169.4

(58) Field of Search ..... 345/460–63, 66–68; 315/169.1–169.4

(56) References Cited

U.S. PATENT DOCUMENTS 6,249,087 B1 * 6/2001 Takayama et al. ..... 315/169.1
6,317,105 B1 * 11/2001 Eo et al. ..... 345/68
6,342,874 B1 * 1/2002 Tokunaga et al. ..... 345/68
6,456,263 B1 * 9/2002 Hashimoto et al. ..... 345/60
2001/0017605 A1 * 8/2001 Hashimoto et al. ..... 345/60

* cited by examiner

*Primary Examiner*—Henry N. Tran
(74) *Attorney, Agent, or Firm*—Sughrue Mion, PLLC

(57) ABSTRACT

A method for driving a PDP is provided which is capable of improving reliability in selective operations, acquiring excellent displaying characteristics, improving contrast, and accommodating a difference in driving characteristics caused by a color to be displayed. If a discharge initiating threshold voltage between surface electrodes is 250 V and the discharge initiating threshold voltage between facing electrodes in a state where lots of activated particles exist in discharging space is 350 V, an ultimate potential of a pre-discharging pulse is set to be 400 V and a electric potential of a pre-discharging pulse is set to be 0 V. When a voltage of the pre-discharging pulse exceeds 250 V being the discharge initiating threshold voltage between surface electrodes, a feeble discharge occurs between surface electrodes. Then, when a voltage of the pre-discharging pulse exceeds 350 V being a discharge initiating voltage between facing electrodes, since lots of activated particles produced by the surface discharge exist in the discharging space, a feeble discharge between facing electrodes occurs.

38 Claims, 28 Drawing Sheets

2
3
1a
9
11
5
1b 1a
1b 1a
1b 1a
1b

METHOD OF DRIVING PLASMA DISPLAY PANEL

BACKGROUND OF THE INVENTION

1. Field of the Invention

The present invention relates to a method for driving a plasma display panel (PDP) and more particularly to an alternating current (AC) discharging-type PDP which provides a display in a form of a matrix.

The present application claims priority of Japanese Patent Application No. 2001-052851 filed on Feb. 27, 2001, which is hereby incorporated by reference.

2. Description of the Related Art

A conventional PDP and a method for driving the conventional PDP will be described below by referring to the attached prior art drawings. FIG. 23 is a cross-sectional view showing main portions of the conventional PDP. The conventional PDP includes a front insulating substrate 1*a* and a rear insulating substrate 1*b* both being made from glass. On the front insulating substrate la are formed a scanning electrode 2 and a sustaining electrode 3 both being made from transparent conductive material. In order to reduce resistance values of the scanning electrode 2 and the sustaining electrode 3, trace electrode 4 is stacked on each of the scanning electrode 2 and the sustaining electrode 3. A first dielectric layer 9 is formed in a manner that it covers the scanning electrode 2 and the sustaining electrode 3. Moreover, a protecting layer 10 used to protect the first dielectric layer 9 and made from magnesium oxide or a like is formed. On the rear insulating substrate 1*b* is formed a data electrode 5 extending in a direction orthogonal to the scanning electrode 2 and sustaining electrode 3. Also, a second dielectric layer 11 which covers the data electrode 5 is formed. On the second dielectric layer 11 is formed a rib 7 extending in a same direction as the data electrode 5 extends and is used to partition a discharging cell 12 (FIG. 24) making up a unit portion for displaying in the conventional PDP. On a side face of the rib 7 and on a surface of the second dielectric layer 11 where the rib 7 has not been formed is formed a phosphor layer 8 used to convert ultraviolet rays emitted by a discharge of a discharging gas to visible light. Generally, in a PDP which performs a display in multiple colors, a phosphor layer 8 is formed by putting a necessary phosphor on each region partitioned by ribs to acquire various colors. Therefore, all the phosphor layers 8 corresponding to one piece of the data electrode 5 use phosphors of a same type.

Space being sandwiched between the front insulating substrate 1*a* and the rear insulating substrate 1*b* and being partitioned by the rib 7 serves as a discharging space 6 to be filled with helium, neon, xenon, or a like, or their mixed gas. In the conventional PDP being configured as above, a discharge occurs between the scanning electrode 2 and the sustaining electrode 3 (hereinafter the discharge occurring between the scanning electrode 2 and sustaining electrode 3 is referred to as a surface discharge 100).

FIG. 24 is a schematic diagram illustrating an arrangement of electrodes used in the conventional PDP. As shown in FIG. 24, one discharging cell 12 is placed at a point of intersection of one piece of the scanning electrode 2, one piece of the sustaining electrode 3, and one piece of the data electrode 5 which intersects the scanning electrode 2 and the sustaining electrode 3 at right angles. The scanning electrode 2 is connected to a scanning driver integrated circuit (IC) 21 so as to individually apply a scanning voltage pulse. The sustaining electrode 3 is connected to a sustaining circuit 22, in order to provide pulses each having a common waveform, in a manner that all the sustaining electrodes 3 are electrically and commonly connected at an end of a panel or on a driving circuit. The data electrode 5 is connected to a data driver integrated circuit (IC) 23 so as to individually provide a data pulse.

Next, various selective displaying operations of the discharging cell 12 employed in the conventional PDP will be described by referring to FIG. 25. FIG. 25 is a timing chart illustrating a voltage pulse being applied to each electrode (the scanning electrode 2, the sustaining electrode 3 and data electrode 5) in the conventional method for driving the conventional PDP. In FIG. 25, a pre-discharging period A is a period during which a preparation is made to induce an easy discharge in a subsequent selective operation period B. The selective operation period B is a period during which an ON or OFF state of each of the discharging cells 12 for displaying is selected. A discharge sustaining period C is a period during which each of all the selected discharging cells 12 for displaying is discharged. A discharge sustaining terminating period D is a period during which the discharge for displaying is stopped. FIGS. 26A, 26B, 26C, 26D, and 26E show schematic diagrams illustrating a state of a wall charge in the discharging cell 12 during the pre-discharging period A and the selective operation period B in the conventional driving method. Each of states shown in FIGS. 26A to 26E corresponds to a state occurring at each of times $t_1$ to $t_5$ shown in FIG. 25, respectively. Moreover, in the conventional driving method, a reference potential between a pair of electrodes electrically made up of the scanning electrode 2 and the sustaining electrode 3 (hereinafter the pair of electrodes electrically made up of the scanning electrode 2 and the sustaining electrode 3 is referred to as "surface electrodes") is set so as to be a sustaining voltage Vos which is required to sustain the discharge during the discharge sustaining period C. Therefore, a electric potential of the scanning electrode 2 or the sustaining electrode 3 being higher than the sustaining voltage Vos being the reference potential is defined as a electric potential of positive polarity and a electric potential of the scanning electrode 2 or the sustaining electrode 3 being lower than the sustaining voltage Vos being the reference potential as a electric potential of negative polarity. Moreover, a reference potential of the data electrode 5 is set to be 0 (zero) V.

First, during the pre-discharging period A, a sawtooth-shaped pre-discharging pulse Pops having its ultimate potential Vops of positive polarity is applied to the scanning electrode 2 while a rectangular pre-discharging pulse Popc having its electric potential being 0 (zero) V of negative polarity is applied to the sustaining electrode 3. A difference in ultimate potentials between the scanning electrode 2 and sustaining electrode 3 occurring at a time of application of the pre-discharging pulse Pops is a electric potential Vops. The electric potential Vops is set, in advance, at a value exceeding a discharge initiating threshold voltage between the scanning electrode 2 and sustaining electrode 3. A non-disclosed experiment of the inventor of the present invention shows that the discharge initiating threshold voltage between the scanning electrode 2 and sustaining electrode 3 is within a range of 230 V to 250 V and therefore the electric potential Vops is preferably set to be about 300 V. By application of the sawtooth-shaped pre-discharging pulse Pops to the scanning electrode 2 and of the rectangular pre-discharging pulse Popc to the sustaining electrode 3, a voltage of the sawtooth-shaped pre-discharging pulse Pops rises and, from a time point when a voltage between the scanning electrode 2 and the sustaining electrode 3 exceeds the discharging initiating threshold voltage, as shown in FIG. 26A, a feeble surface discharge occurs between the scanning electrode 2 and sustaining electrode 3 (at the time of $t_1$). The feeble surface discharge continues to occur while the electric potential of the sawtooth-shaped pre-discharging pulse Pops is rising, and stops when the electric potential of the sawtooth-shaped pre-discharging pulse Pops has reached the ultimate potential Vops and a change in the electric potential has ended. As a result, as shown in FIG. 26B, a negative wall charge is formed on the scanning electrode 2 and a positive wall charge on the sustaining electrode 3. Moreover, during the pre-discharging period A, the data electrode 5 does not participate directly in the discharge, however, since the electric potential of the data electrode 5 is fixed at 0 (zero) V, as shown in FIG. 26B, some amounts of positive electric charges attracted by an electric field between the scanning electrode 2 and data electrode 5 are adsorbed on the data electrode 5 and, as a result, a feeble positive wall charge is formed on the data electrode 5 (at the time of $t_2$)

Following the application of the pre-discharging pulse Pops, a sawtooth-shaped pre-discharge erasing pulse Pope of negative polarity is applied to the scanning electrode 2. At this point, the electric potential of the sustaining electrode 3 is fixed at the sustaining voltage Vos. As shown in FIG. 26C, when the sawtooth-shaped pre-discharge erasing pulse Pope is applied, the wall charges formed on the scanning electrode 2 and sustaining electrode 3 are erased (at the time of $t_3$). Moreover, even after the wall charges have been erased, in the discharging space 6, a space charge such as an electron, ion, or a like, and activated particle such as metastable particles or a like formed by the pre-discharge still exist. The operation of erasing the wall charge during the pre-discharging period A includes an operation of adjusting the wall charge to have a smooth operation be performed in the subsequent processes such as the selective operations, discharge sustaining operations, or a like.

Next, during the selective operation period B, after the electric potentials of all the scanning electrodes 2 have been held at a base electric potential Vobw once, a scanning pulse Pow of negative polarity having its electric potential being 0 (zero) V is applied to the scanning electrodes 2 and, at the same time, a data pulse Pod which corresponds to a display data and whose electric potential is a electric potential Vod is applied to the data electrode 5. During this period, an auxiliary scanning pulse Posw having its electric potential being Vosw of positive polarity is applied to the sustaining electrode 3. Each of the electric potentials of the scanning pulse Pow and the data pulse Pod is set in a manner that a voltage between a pair of electrodes being electrically made up of the scanning electrode 2 and the data electrode 5 both facing each other (hereinafter the pair of electrodes being electrically made up of the scanning electrode 2 and the data electrode 5 is referred to as "facing electrodes") does not exceed a discharge initiating threshold voltage between the facing electrodes by application of only either of the scanning pulse Pow or the data pulse Pod and exceeds the discharge initiating threshold voltage between the facing electrodes when the scanning pulse Pow is superimposed on the data pulse Pod. Moreover, a electric potential of a auxiliary scanning pulse Posw is set in a manner that, even when the auxiliary scanning pulse Posw is superimposed on the scanning pulse Pow, a voltage between surface electrodes, that is, between the scanning electrode 2 and sustaining electrode 3 does not exceed a discharge initiating threshold voltage between the surface electrodes. For example, if the discharge initiating voltage between the facing electrodes is 220 V and the voltage Vos of the sustaining pulse Pos is 170 V, a voltage Vow of the scanning pulse Pow can be set to be 0 (zero) V, a voltage Vod of the data pulse Pod can be set to be 70 V and a voltage Vosw of the auxiliary scanning pulse Posw can be set to be Vos+about 20 V.

Therefore, only on the discharging cell in which, in addition of the scanning pulse Pow, the data pulse Pod is applied simultaneously, a discharge occurs between the scanning electrode 2 and the data electrode 5 (at the time of $t_4$) (hereinafter, the discharge occurring between the scanning electrode 2 and the data electrode 5 is referred to as a "facing discharge"). At this point, since there is a electric electric potential difference (Vosw) caused by the scanning pulse Pow and the auxiliary scanning pulse Posw between the scanning electrode 2 and the sustaining electrode 3, a discharge, triggered by the facing discharge between the scanning electrode 2 and data electrode 5, also occurs between the scanning electrode 2 and the sustaining electrode 3. This discharge serves as a writing discharge. Since the space charges and activated particles caused by processes of discharging and erasing wall charges during the pre-discharging period A exist in the discharging space 6, the stable writing discharge can be implemented at a discharge probability based on an amount of the space charge and activated particles. As a result, as shown in FIG. 26E, only in the discharging cell 12 that has been selected in the selective operation period B, positive wall charges are formed on the scanning electrode 2 and negative wall charges are formed on the sustaining electrode 3 (at the time of $t_5$).

Then, during the discharge sustaining period C, the sustaining pulses Pos having crest values being the sustaining voltage Vos and being reversed in phase to each other are applied to all the scanning electrodes 2 and the sustaining electrodes 3. The sustaining voltage is set in a manner that the discharge occurs when the wall voltage formed on the surface electrodes, that is, on the scanning electrode 2 and sustaining electrode 3 by the writing discharge during the selective operation period B is superimposed on the sustaining voltage Vos and that, if there is no superimposition of such wall charges, a voltage for the discharge between the surface electrodes does not exceed the discharge initiating threshold voltage and no discharge occurs. Therefore, only in the discharging cell 12 on which the wall charge is formed by occurrence of the writing discharge during the selective operation period B, the sustaining discharge for displaying occurs.

In the subsequent discharge sustaining terminating period D, the voltage of the sustaining electrode 3 is fixed at the sustaining voltage Vos and a sawtooth discharge sustaining terminating pulse Poe of negative polarity having its ultimate voltage being 0 (zero) V is applied to the scanning electrode 2. This process causes the wall charges on the surface electrodes to be erased and the operation to return back to its initial state, that is, to the state that existed before application of the pre-discharging pulses Pops and Popc during the pre-discharging period A. Moreover, the operation of erasing the wall charge during the discharge sustaining terminating period D includes an operation of adjusting the wall charge to have smooth operations be performed in the subsequent processes.

In the conventional method for actually driving the PDP, each of the periods from the pre-discharging period A or from the selective operation period B to the discharge sustaining terminating period D is defined as one sub-field and a combination of a plurality of sub-fields during which a number of pulses of the sustaining pulse Pos are changed during the discharge sustaining period C with the above sub-fields is defined as one field. Luminance in displaying is adjusted by selecting an ON or OFF state in each sub-field.

Moreover, in the conventional method for driving the PDP, since a probability of occurrence of a discharge induced by the scanning pulse Pow and the data pulse Pod is low, it is better to make a pulse width of the scanning pulse Pow, for example, as long as 10 $\mu$s to ensure the selection of the ON or OFF state.

However, actually, because of limitation in time allowable within one field for a television display or a like, a pulse width of the scanning pulse Pow is usually about 3 $\mu$s. Therefore, a measure is taken to increase the probability of occurrence of the discharge by raising the electric electric potential Vod of the data pulse Pod. However, an increase in the electric electric potential Vod of the data pulse Vod causes a rise of power consumption. If a pulse width of the scanning pulse Pow is made longer, time of the selective operation period B occupying in one field becomes longer, which inevitably shortens the time of the discharge sustaining period C and, as a result, the number of the sustaining pulses Pos decreases, causing a lowering in luminance.

It has been confirmed from an experiment made by the inventors that, by causing a discharge using the scanning electrode 2 as an anode and the data electrode 5 as a cathode to occur during the pre-charging period A, that is, by causing the discharge of a polarity being opposite to the polarity in the facing discharge using the scanning pulse Pow and the data pulse Pod that is to occur during the selective operation period B to occur during the pre-discharging period A, the probability of the occurrence of the discharge is greatly improved.

However, if the electric electric potential of the scanning electrode 2 is raised while a electric electric potential of the data electrode 5 is fixed, no continuous and feeble discharge occurs and, when the electric electric potential of the scanning electrode 2 exceeds a specified level, a phenomenon in which a strong discharge occurs and then the discharge is temporarily stopped is observed. This is due to an influence of a phosphor layer 8 formed on the data electrode 5. Generally, a secondary electron emission coefficient of the phosphor is lower than that of magnesium oxide (MgO) used as material for the protecting layer 10. Because of this, the discharge using the data electrode 5 as a cathode has a problem in that not only its discharge initiating voltage is made high but also its discharge is difficult to continue in a stable manner.

Moreover, in order to cause the facing discharge to occur, it is necessary to raise the ultimate electric electric potential Vops of the pre-discharging pulse Pops. If the ultimate electric electric potential Vops is set to be higher, in some cases, the discharge occurs also between the scanning electrode 2 and the sustaining electrode 3 during the pre-discharging period A and an amount of the discharge increases. In the PDP, since an increase in the amount of the charges is almost equal to an increase in an amount of emitted light, it causes the increase in the amount of the emitted light during the pre-discharging period A. Luminance at a time when light is emitted during the pre-discharging period A matches luminance at a time when any discharging cell 12 is not selected, that is, luminance occurring at a time of displaying a black color. As a result, this presents a problem in that contrast being one of display characteristics becomes low due to the rise in the luminance in displaying the black color. Another problem is that, since a discharge voltage in the discharge using the data electrode 5 as the cathode is determined by physical properties of the phosphor, in the PDP in which a plurality of kinds of the phosphors is applied in various manners for displaying multiple colors, the discharging characteristic such as the discharge initiating voltage or a like differs in every color to be displayed and therefore its control is made difficult.

SUMMARY OF THE INVENTION

In view of the above, it is an object of the present invention to provide a method for driving a PDP capable of improving reliability in selective operations, acquiring excellent displaying characteristics, improving contrast, and accommodating a difference in driving characteristics caused by an emitted color light to be displayed.

According to a first aspect of the present invention, there is provided a method for driving a plasma display panel for causing the plasma display panel, in which a plurality of first electrodes extending in a first direction and a plurality of second electrodes extending in the first direction are placed in such a manner that each of the first electrodes is adjacent to each of the second electrodes and a plurality of third electrodes extending in a second direction orthogonal to the first direction is placed and in which a discharging cell is placed at each point of intersection of each of the first and second electrodes and each of the third electrodes, to perform a display in response to video signals, the method comprising:

a process of causing a discharge to occur between the first electrodes and second electrodes being adjacent to each other in an initializing period; and a process of causing a discharge of one polarity to occur between the first electrodes and the third electrodes intersecting each other after the discharge between the first electrode and the second electrode starts in the initializing period.

With the above configuration, since the discharge occurs between the first and second electrodes during the initializing period, comparatively large amounts of wall charges are formed on the third electrode. Therefore, a probability of a facing discharge to occur in a subsequent selective discharge is improved.

In the foregoing, a preferable mode is one that wherein includes a process of decreasing intensity of the discharge between the first electrode and second electrode before the discharge of one polarity stops.

Also, a preferable mode is one wherein the process of decreasing intensity of the discharge between the first electrode and second electrode is performed after the discharge of one polarity occurred.

Also, a preferable mode is one wherein the process of decreasing intensity of the discharge between the first electrode and second electrode is performed at a same time when the discharge of one polarity occurs.

Also, a preferable mode is one wherein the process of decreasing intensity of the discharge between the first electrode and second electrode is performed before the discharge of one polarity occurs.

Also, a preferable mode is one wherein the process of causing the discharge of one polarity to occur is started while a space charge is left in a discharging cell.

Also, a preferable mode is one that wherein includes a process of applying sequentially scanning pulses to the first electrode and of causing a selective discharge of opposite polarity between the first and third electrodes by applying a data pulse to the third electrode in response to the video signals.

Also, a preferable mode is one wherein, at a time of causing the selective discharge to occur, wall charges of one polarity are formed on the first electrode and wall charges of opposite polarity are formed on the third electrode and wherein a direction of an electric field being produced by the wall charges in a discharging space matches a direction of an electric field occurring in the discharging space by application of the scanning pulse and the data pulse.

Also, a preferable mode is one wherein the process of causing the discharge between the first and second electrodes to occur includes a process of adjusting timing with which the discharge between the first and second electrodes occurs by calibrating a electric electric potential of the second electrode.

Also, a preferable mode is one wherein the process of causing the discharge of one polarity to occur includes a process of adjusting timing with which the discharge of one polarity occurs by calibrating a electric electric potential of the third electrode.

According to a second aspect of the present invention, there is provided a method for driving a plasma display panel having first and second substrates being placed so as to face each other, a plurality of first electrodes each being placed on a surface facing the second substrate and each extending in a row direction on the first substrate, a plurality of second electrodes each pairing up with the first electrode and extending parallel to the first electrode and making up a display line by a space provided by the adjacent first electrode, and a plurality of third electrodes each being placed on a surface facing the first substrate and extending in a column direction orthogonal to a direction in which the first and second electrodes extend on the second substrate, and operating to have a matrix-type plasma display panel having one discharging cell at each of intersecting points of the first and second electrodes and the third electrode to perform a display in the plasma display panel in response to video signals, the method including:

a process of setting, in a field period making up one screen, at least one initializing period during which a state of the discharging cell is reset, at least one selective operation period during which a selective discharge occurs to select an ON or OFF state for displaying and at least one discharge sustaining period during which a discharge for displaying is achieved, and of causing a discharge to occur, during the initializing period, between the first and second electrodes by applying a pulse whose electric electric potential changes with time to the first electrode; and a process of causing a discharge of one polarity to occur between the first electrode and third electrode after the discharge between the first electrode and second electrode starts in the initializing period.

In the foregoing, a preferable mode is one that wherein includes a process of sequentially applying a scanning pulse to the first electrode during the selective operation period and of causing the selective discharge of opposite polarity to occur between the first and third electrodes by applying a data pulse to the third electrode in response to the video signals.

Also, a preferable mode is one wherein the discharge of one polarity occurring during the initializing period is a discharge using the first electrode as an anode and the third electrode as a cathode.

Also, a preferable mode is one wherein, at a time of causing the selective discharge to occur, wall charges of one polarity are formed on the first electrode and wall charges of opposite polarity are formed on the third electrode and wherein a direction of an electric field being produced by the wall charges in discharging space matches a direction of an electric field occurring in the discharging space by application of the scanning pulse and the data pulse.

Also, a preferable mode is one that wherein includes a process of decreasing intensity of the discharge between the first electrode and second electrode before the discharge of one polarity stops, during the initializing period.

Also, a preferable mode is one wherein the process of decreasing intensity of the discharge between the first electrode and second electrode is performed after the discharge of one polarity occurred, during the initializing period.

Also, a preferable mode is one wherein the process of decreasing intensity of the discharge between the first electrode and second electrode during the initializing period is performed at a same time when the discharge of one polarity occurs.

Also, a preferable mode is one wherein the process of decreasing intensity of the discharge between the first electrode and second electrode is performed before the discharge of one polarity occurs.

Also, a preferable mode is one wherein the process of causing the discharge of one polarity to occur is started while a space charge is left in the discharging cell, during the initializing period.

Also, a preferable mode is one wherein the process of decreasing intensity of the discharge between the first electrode and second electrode includes a process of decreasing a electric electric potential difference between the first and second electrodes.

Also, a preferable mode is one wherein the process of decreasing the electric electric potential difference between the first and second electrodes includes a process of causing a electric electric potential of the second electrode to come near to a electric electric potential of the first electrode.

Also, a preferable mode is one wherein the process of decreasing a electric electric potential difference between the first and second electrodes includes a process of fixing a difference in electric electric potentials between the first and second electrodes.

Also, a preferable mode is one wherein the process of fixing a difference in electric electric potentials between the first and second electrodes includes a process of matching a change in a electric electric potential of the second electrode to a change in a electric electric potential of the first electrode.

Also, a preferable mode is one wherein the process of fixing a difference in electric electric potentials between the first and second electrodes includes a process of changing a electric electric potential of the third electrode while electric electric potentials of the first and second electrodes are being fixed.

Also, a preferable mode is one wherein the process of decreasing intensity of the discharge between the first electrode and second electrode includes a process of decreasing an increasing rate of a electric electric potential difference between the first and second electrodes.

Also, a preferable mode is one wherein the process of decreasing an increasing rate of a electric electric potential difference between the first and second electrodes includes a process of causing a changing rate of a electric electric potential of the second electrode to come near to a changing rate of a electric electric potential of the first electrode.

Also, a preferable mode is one wherein the process of causing a discharge between the first and second electrodes to occur during the initializing period includes a process of adjusting timing with which a discharge occurs between the first and second electrodes by calibrating a electric electric potential of the second electrode.

Also, a preferable mode is one wherein the process of causing a discharge of one polarity to occur during the initializing period includes a process of adjusting timing with which a discharge of one polarity occurs by calibrating a electric electric potential of the third electrode.

According to a third aspect of the present invention, there is provided a method for driving a plasma display panel having first and second substrates being placed so as to face each other, a plurality of first electrodes each being placed on a surface facing the second substrate and each extending in a row direction on the first substrate, a plurality of second electrodes each pairing up with the first electrode and extending parallel to the first electrode and making up a display line by a space provided by the adjacent first electrode, and a plurality of third electrodes each being placed on a surface facing the first substrate and extending in a column direction orthogonal to a direction in which the first and second electrodes extend on the second substrate and operating to have a matrix-type plasma display panel having one discharging cell at each of intersecting points of the first and second electrodes and the third electrode to perform a display in the plasma display panel in response to video signals, the method including:

a process of setting, in a field period making up one screen, at least one initializing period during which a state of the discharging cell is reset, at least one selective operation period during which a selective discharge occurs to select an ON or OFF state for displaying and one discharge sustaining period during which a discharge for displaying is achieved, and of dividing the plurality of third electrodes into a plurality of electrode groups and holding each of the electrode groups at an individual electric electric potential, during the initializing period; and a process of causing a discharge between the first and third electrodes to occur.

In the foregoing, a preferable mode is one wherein a plurality of phosphor layers is formed on the third electrode in a manner that the phosphor layer of a same type is assigned to the third electrode of a same type and the third electrode on which the phosphor layer of the same type is formed belongs to the electrode group of a same type.

Also, a preferable mode is one wherein each electric electric potential at which the electrode group is held is set in a manner that a difference in a discharge initiating voltage between the first and third electrodes by a type of each phosphor decreases.

Also, a preferable mode is one that wherein includes a process of causing a discharge between the first and second electrodes to occur before causing a discharge between the first and third electrodes to occur, during the initializing period.

According to a fourth aspect of the present invention, there is provided a method for driving a plasma display panel having first and second substrates being placed so as to face each other, a plurality of first electrodes each being placed on a surface facing the second substrate and each extending in a row direction on the first substrate, a plurality of second electrodes each pairing up with the first electrode and extending parallel to the first electrode and making up a display line by a space provided by the adjacent first electrode, a plurality of third electrodes each being placed on a surface facing the first substrate and extending in a column direction orthogonal to a direction in which the first and second electrodes extend on the second substrate, and a plurality of phosphors formed on the third electrode, and operating to have a matrix-type plasma display panel having one discharging cell at each of intersecting points of the first and second electrodes and the third electrode to perform a display in response to video signals, the method including:

a process of setting, in a field period making up one screen, at least one initializing period during which a state of the discharging cell is reset, at least one selective operation period during which a selective discharge occurs to select an ON or OFF state for displaying and at least one discharge sustaining period during which a discharge for displaying is achieved, and of causing a discharge to occur between the first and second electrodes by application of a pulse whose electric electric potential changes with time to the first electrode during the initializing period;

a process of causing a discharge of one polarity between the first and third electrodes to occur; and a process of causing intensity of the discharge between the first and second electrodes to decrease before the discharge of one polarity stops.

In the foregoing, a preferable mode is one wherein a process of decreasing intensity of the discharge between the first and second electrodes is performed during a period from a start of a discharge in a discharging cell having a low discharge initiating voltage between the first and third electrodes to a start of a discharge in a discharging cell having a high discharge initiating voltage between the first and third electrodes.

According to a fifth aspect of the present invention, there is provided a method for driving a plasma display panel having first and second substrates being placed so as to face each other, a plurality of first electrodes each being placed on a surface facing the second substrate and each extending in a row direction on the first substrate, a plurality of second electrodes each pairing up with the first electrode and extending parallel to the first electrode and making up a display line by a space provided by the adjacent first electrode, a plurality of third electrodes each being placed on a surface facing the first substrate and extending in a column direction orthogonal to a direction in which the first and second electrodes extend on the second substrate, and dielectric layer to cover the first and second electrodes, and operating to have a matrix-type plasma display panel having one discharging cell at each of intersecting points of the first and second electrodes and the third electrode to perform a display in response to video signals, the method including:

a process of setting, in a field period making up one screen, at least one initializing period during which a state of the discharging cell is reset, at least one selective operation period during which a selective discharge occurs to select an ON or OFF state for displaying and at least one discharge sustaining period during which a discharge for displaying is achieved, and of causing a discharge to occur between the first and second electrodes by application of a pulse whose electric electric potential changes with time to the first electrode during the initializing period; and a process of causing the second electrode to be a floating electric potential and causing a electric electric potential of the second electrode to match a electric electric potential of the first electrode by capacitive coupling.

In the foregoing, a preferable mode is one wherein a process of matching a change in a electric electric potential of the second electrode to a change of a electric electric potential of the first electrode includes a process of causing the second electrode to be a floating electric potential and causing a electric electric potential of the second electrode to match a electric electric potential of the first electrode by capacitive coupling.

Furthermore, a preferable mode is one wherein the process of causing a changing rate of a electric electric potential of the second electrode to come near to a changing rate of a electric electric potential of the first electrode includes a process of causing the second electrode to be a floating electric potential and causing a electric electric potential of the second electrode to match a electric electric potential of the first electrode by capacitive coupling.

With the above configurations, by causing a stable facing discharge to occur during the pre-discharging period, positive wall charges can be formed on the data electrode. As a result, it is possible to cause a writing discharge to occur at a high probability during a subsequent selective operation period. This is because, during the pre-discharging period, by causing a surface discharge to occur prior to the facing discharge, a stable facing discharge is achieved.

With another configuration, by causing a surface discharge in the pre-discharging period to stop or to be weakened at its middle course, all amounts of the discharge during the pre-discharging period are decreased and luminance in a black display can be lowered, which thus enables improvement of contrast being one of display characteristics of the plasma display panel.

With still another configuration, by applying a voltage being different in every type of a phosphor during the pre-discharging period to the data electrode, a difference in a discharge initiating voltage by a type of the phosphor can be made smaller. This enables an amount of the discharge during the pre-discharging period to decrease as a whole, thus lowering the luminance in the black display and improving contrast in the display of the plasma display panel.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
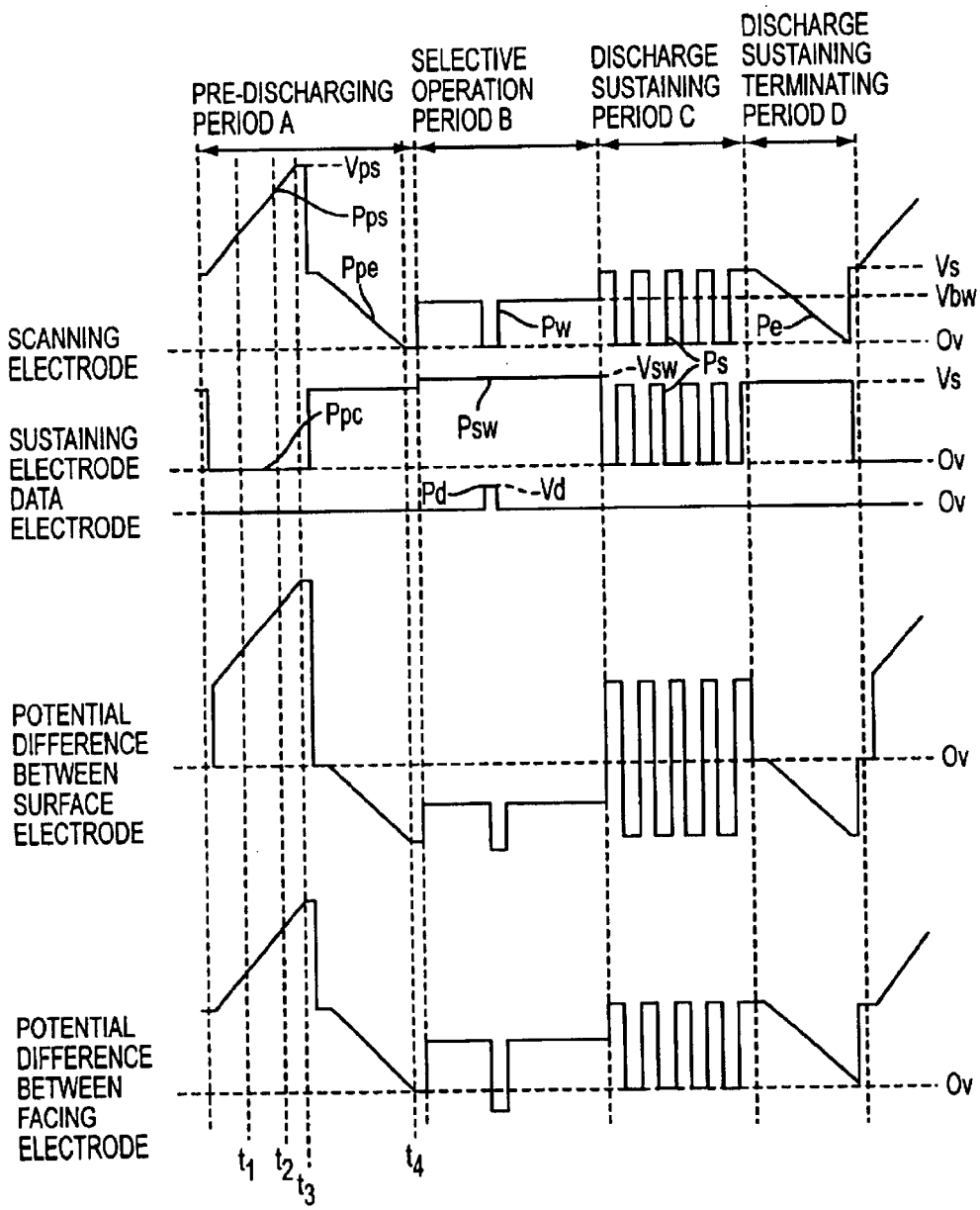
FIG. 1 is a timing chart explaining a method for driving a PDP according to a first embodiment of the present invention.

FIG. 1 is a timing chart explaining a method for driving a PDP according to a first embodiment of the present invention. Basic configurations of the PDP of the first embodiment are the same as those of the conventional PDP. One discharging cell 12 is placed at a point of intersection of one scanning electrode 2, one sustaining electrode 3 (both being made from transparent conductive material) and one data electrode 5 intersecting both the scanning electrode 2 and sustaining electrode 3 at right angles. In FIG. 1, a electric electric potential difference between surface electrodes (as described above, a pair of electrodes electrically made up of the scanning electrode 2 and the sustaining electrode 3 is referred to as the "surface electrodes") represents a difference in electric electric potentials between the scanning electrode 2 receiving a voltage from an outside and the sustaining electrode 3 also receiving a voltage from the outside, while a electric electric potential difference between facing electrodes (as described above, a pair of electrodes electrically made up of the scanning electrode 2 and the data electrode 5 is referred to as the "facing electrodes") represents a difference in electric electric potentials between the scanning electrode 2 receiving a voltage from the outside and the data electrode 5 also receiving a voltage from the outside. FIGS. 2A, 2B, 2C, and 2D are schematic diagrams illustrating states of wall charges and discharges in a discharging cell 12 according to the first embodiment of the present invention. Each of states shown in FIGS. 2A to 2D corresponds to a state occurring at each of times $t_1$ to $t_4$ shown in FIG. 1, respectively. Moreover, in FIGS. 2A to 2D, illustrations of states in a trace electrode 4, a protecting layer 10, a phosphor layer 8 or a like are omitted. Furthermore, illustrations of states of electric charges adsorbed by diffusion on portions other than upper portions of the electrodes are omitted.

In FIG. 1, a pre-discharging period A is a period during which a preparation is made to induce an easy discharge in a subsequent selective operation period B. The selective operation period B is a period during which an ON or OFF state of each of discharging cells 12 for displaying is selected. A discharge sustaining period C is a period during which each of all the selected discharging cells 12 for displaying is discharged. A discharge sustaining terminating period D is a period during which the discharge for displaying is stopped. In the first embodiment, a reference voltage between surface electrodes, that is, between the scanning electrode 2 and sustaining electrode 3 is set so as to be a sustaining voltage Vs which is required to sustain the discharge during the discharge sustaining period C. Therefore, a electric electric potential of the scanning electrode 2 and of the sustaining electrode 3 being higher than the sustaining potential Vs is defined as a electric electric potential of positive polarity and a electric electric potential of the scanning electrode 2 and of the sustaining electrode 3 being lower than the sustaining potential Vs as a electric electric potential of negative polarity. The sustaining voltage Vs is, for example, about 170 V. Moreover, a reference potential of the data electrode 5 is set to be 0 (zero) V.

Next, the method for driving the PDP of the first embodiment will be described.

First, during the pre-discharging period A, a sawtooth-shaped pre-discharging pulse Pps having its ultimate potential being Vps of positive polarity is applied to the scanning electrode 2 while a rectangular pre-discharging pulse Ppc having its electric electric potential being Vps of negative polarity is applied to the sustaining electrode 3. At this time, a electric electric potential of the data electrode 5 is fixed at 0 (zero) V. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. For example, in the case of the discharging cell 12 in which a discharge initiating threshold voltage between the surface electrodes is 250 V and the discharge initiating threshold voltage between the facing electrodes in a state where lots of activated particles exist in the discharging space is 350 V, the ultimate potential Vps of the pre-discharging pulse Pps is set to be 400 V and the electric electric potential Vpc of the pre-discharging pulse Ppc is set to be 0 (zero) V.

Figures 2A, 2B, 2C, 2D:
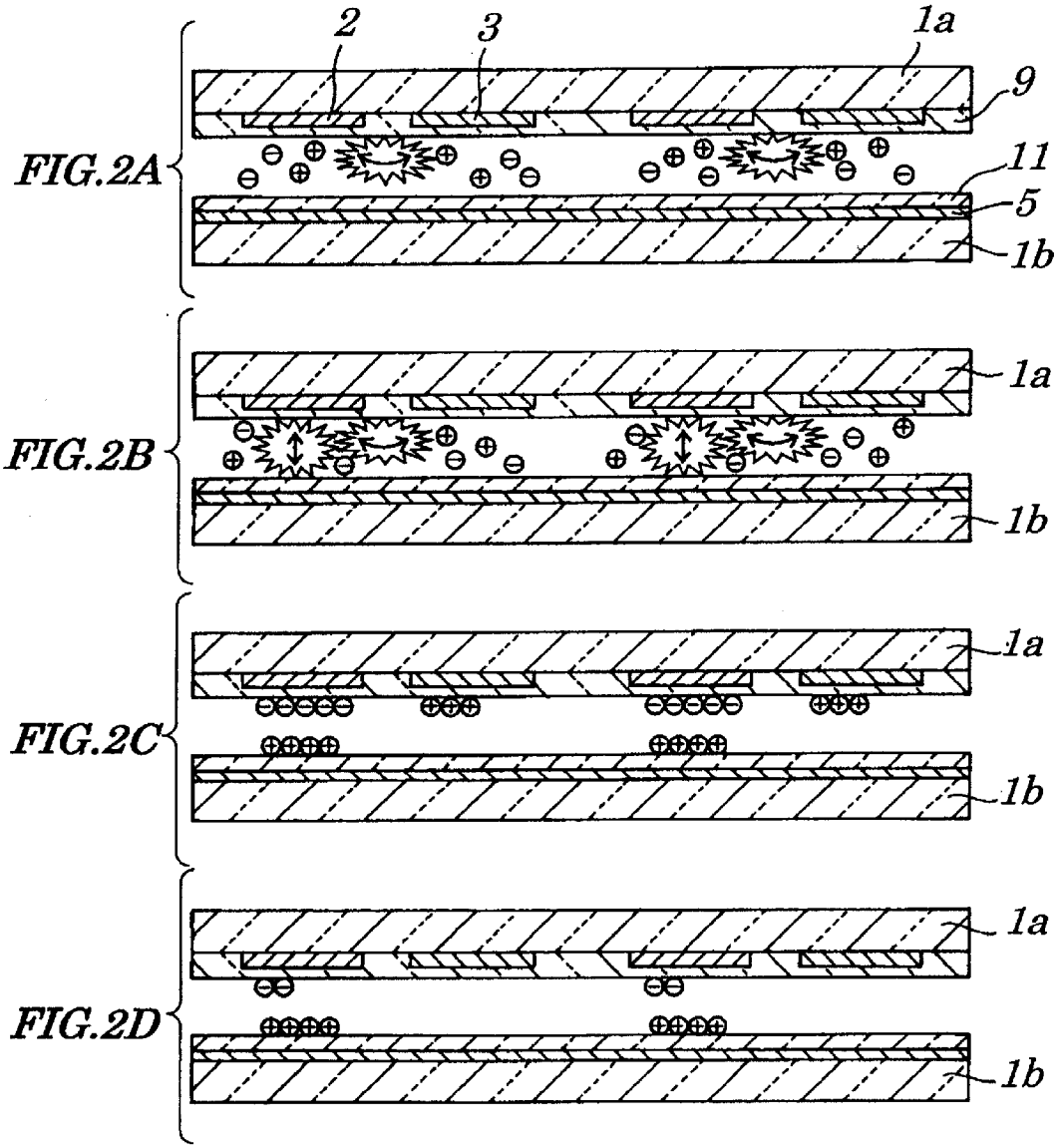
FIGS. 2A, 2B, 2C, and 2D are schematic diagrams illustrating states of wall charges and discharges in a discharging cell according to the first embodiment of the present invention.

Therefore, the sawtooth-shaped pre-discharging pulse Pps rises by application of the pre-discharging pulses Pps and Ppc to each of the scanning electrode and the sustaining electrode 3 and, from a time when the voltage of the pre-discharging pulse Pps exceeds 250 V being the discharge initiating threshold voltage between the surface electrodes, as shown in FIG. 2A, a feeble discharge occurs between the scanning electrode 2 and the sustaining electrode 3 (at a time of $t_1$). Thereafter, the electric electric potential of the scanning electrode 2 further continue to rise and, during this period, the feeble discharge continues to occur between the surface electrodes. Since there are lots of activated particles in the discharging space produced by the discharge occurring between the surface electrodes, from a time when the voltage of the pre-discharging pulse Pps exceeds 350 V being the discharge initiating threshold voltage between the facing electrodes, as shown in FIG. 2B, the feeble discharge occurs between the scanning electrode 2 and the data electrode 5 (at a time of $t_2$). This facing discharge continues in a stable state as the electric electric potential of the scanning electrode 2 rises, by activated particles produced during the facing discharge itself. Thereafter, the electric electric potential of the pre-discharging pulse Pps reaches the ultimate potential Vps and, when a change in the electric electric potential stops, both the discharges between the surface electrodes and between the facing electrodes stop. As a result, as shown in FIG. 2C, negative wall charges are formed on the scanning electrode 2 and positive wall charges are formed on the sustaining electrode 3 and on the data electrode 5 (at a time of $t_3$).

Following the application of the pre-discharging pulse Pps, a sawtooth-shaped pre-discharge erasing pulse Ppe of negative polarity is fed to the scanning electrode 2. An ultimate potential Vpe of the pre-discharge erasing pulse Ppe is set to be, for example, 0 (zero) V. During this time, a electric electric potential of the sustaining electrode 3 is fixed at the sustaining voltage Vs. Moreover, a electric electric potential of the data electrode 5 is fixed at 0 (zero) V. By the application of the pre-discharge erasing pulse Ppe, a discharge of a polarity being opposite to that of the above pre-discharge occurs between the surface electrodes and, as shown in FIG. 2D, wall charges formed on the scanning electrode 2 and on the sustaining electrode 3 are erased (at a time of $t_4$). Moreover, the operation of erasing wall charges during the pre-discharging period A includes an operation of adjusting wall charges to have a smooth operation be performed in the subsequent processes such as selective operations, discharge sustaining operations or a like.

Next, during the selective operation period B, after having once fixed the electric electric potential of the scanning electrode 2 at a scanning base voltage Vbw, a scanning pulse Pw of negative polarity is sequentially applied to the scanning electrode 2 and, at the same time, a data pulse Pd corresponding to display data is fed to the data electrode 5. During the selective operation period B, an auxiliary scanning pulse Psw of positive polarity having a electric electric potential being Vsw is fed to the sustaining electrode 3. Moreover, each a electric electric potentials Vw of the scanning pulse Pw and a electric electric potential Vd of the data pulse Pd is set in a manner that a voltage the facing electrodes does not exceed a discharge initiating threshold voltage between the facing electrodes by application of only either of the scanning pulse Pw or the data pulse Pd but exceeds the discharge initiating threshold voltage between the facing electrodes when the scanning pulse Pw is superimposed on the data pulse Pd. Furthermore, a electric electric potential of an auxiliary scanning pulse Psw is set in a manner that, even when the auxiliary scanning pulse Psw is superimposed on the scanning pulse Pw, a voltage between surface electrodes does not exceed a discharge initiating threshold voltage between the surface electrodes. For example, if the discharge initiating threshold voltage for the facing discharge is 200 V, the scanning pulse voltage Vw is set to be 0 V and the data pulse voltage Vd is set to be 50 V. Moreover, the base voltage Vbw is set to be 80 V and the voltage of the auxiliary scanning pulse Psw is set to be about Vs+20 V. A pulse width of the scanning pulse Pw is set to be, for example, about 3 $\mu$s and a pulse width of the data pulse Pd is set to be a same as for the scanning pulse Pw.

Next, a reason why the discharge initiating threshold voltage (being 200 V) for the facing discharge in the pre-discharging period A is lower than that (being 350 V) for the facing discharge in the selective operation period B will be explained below. In the facing discharge occurring during the pre-discharging period A, the data electrode 5 serves as a cathode. In the facing discharge occurring during the selective operation period B. the scanning electrode 2 serves as the cathode. On the scanning electrode 5 is formed a protecting layer 10 made from magnesium oxide (MgO). It is known that, since the magnesium oxide has a high secondary electron emission coefficient, by using it as a material for the cathode, the discharge initiating threshold voltage can be set to be lower. In contrast, since the phosphor layer 8 formed on the data electrode 5 has a low secondary electron emission coefficient, if it is used as a material for the cathode, the discharge initiating threshold voltage has to be set to be higher. Therefore, the discharge initiating threshold voltage changes greatly depending on the anode.

Then, during the discharge sustaining period C, the sustaining pulses Ps having crest values being the sustaining voltage Vs and being reversed in phase to each other are applied to all the scanning electrodes 2 and the sustaining electrodes 3. Therefore, during the selective operation period B, only in the discharging cell 12 in which a writing discharge occurs and on which wall charges are formed, a sustaining discharge for displaying occurs, enabling light emission for displaying in the discharging cell.

Moreover, during the discharge sustaining terminating period D, the voltage of the sustaining electrode 3 is fixed at the sustaining voltage Vs and a sawtooth-shaped discharge sustaining erasing pulse Pe having its ultimate potential being 0 V of negative polarity is fed to the scanning electrode 2. This process causes the wall charges on the surface electrodes to be erased and the operation to return back to its initial state, that is, the state existed before the application of the pre-discharging pulses Pps and Ppc during the pre-discharging period A. Also, the operation of erasing wall charges during the discharge sustaining terminating period D includes an operation of adjusting wall charges to have smooth operations be performed in the subsequent process. In the initializing state, states of the electric charges in each of the discharging cells are made almost uniform.

Next, reasons why the data pulse voltage Vd which was set to be 70 V in the conventional method for driving the PDP can be lowered to 50 V in the embodiment of the present invention will be explained. An operation time in each of the scanning electrodes 2 is 3 $\mu$s and, during this period, a discharging probability required to cause the discharge to occur_in all the selective cells is defined. Since the discharge probability is proportional to intensity of an electric field formed in the discharging space, by raising a voltage to be applied from an outside, for example, by raising the data pulse voltage Vd, the discharge probability can be made high. On the other hand, in the embodiment of the present invention, as shown in FIG. 2D, since positive wall charges are formed on the data electrode 5 and negative wall charges are formed on the scanning electrode 2 during the pre-discharging period A, a voltage occurred by superimposition of internal voltages produced by the wall charge on the voltage from the outside to be applied to each electrode is formed in the discharging space. This enables reduction of the voltage to be applied from the outside corresponding to the internal voltage produced by the wall charges.

Figure 3:
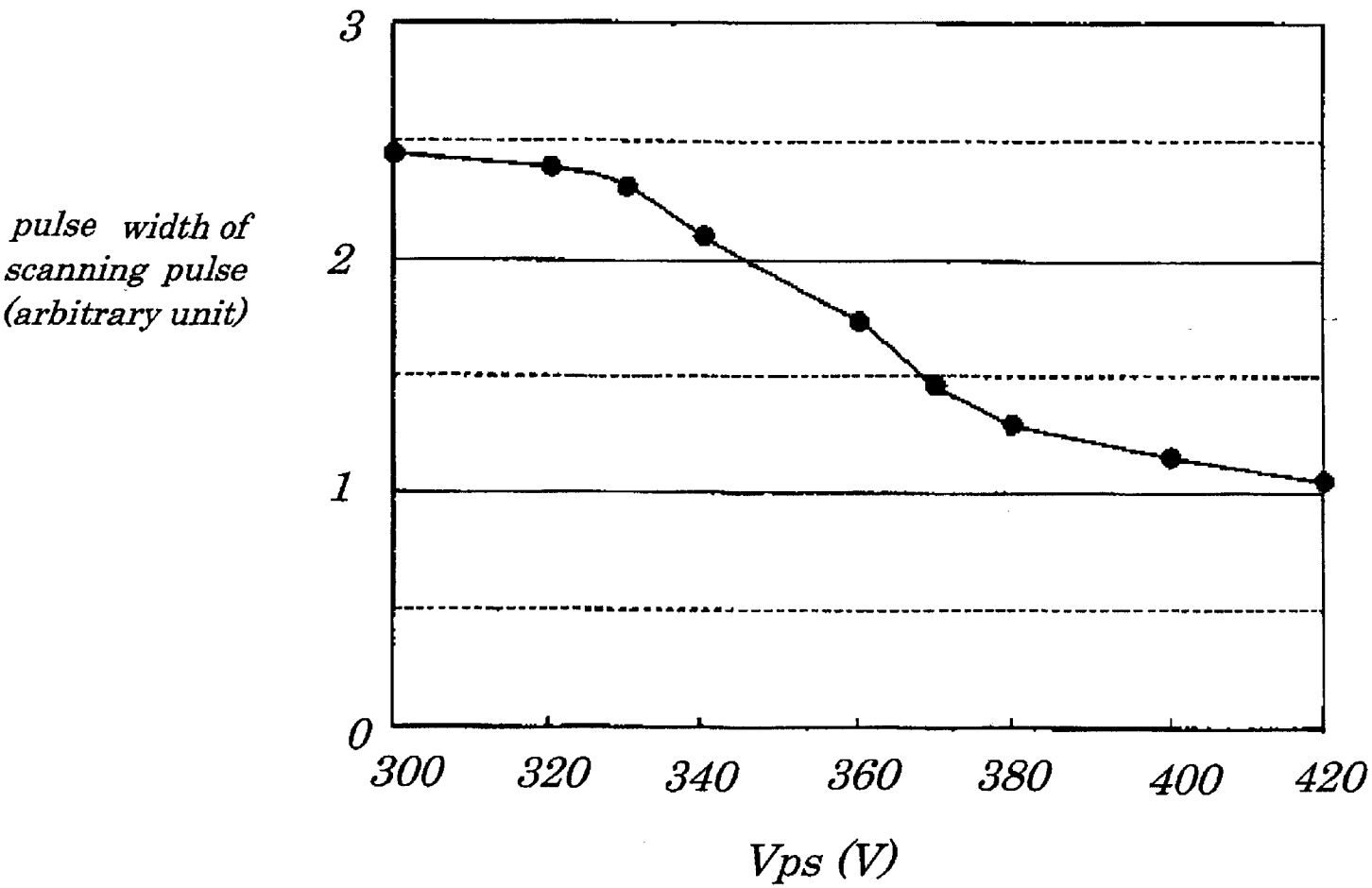
FIG. 3 is a graph showing a relation between an ultimate potential of a pre-discharging pulse and a pulse width of a scanning pulse according to the first embodiment of the present invention.

FIG. 3 is a graph showing a relation between the ultimate potential Vps of the pre-discharging pulse Pps and a pulse width of the scanning pulse Pw required to cause a writing discharge to occur with a probability of 99.9%. As shown in FIG. 3, when the ultimate potential Vps rises and the facing discharge comes to occur, the required pulse width of the scanning pulse Pw rapidly decreases. As a result, if same writing voltages (Vw and Vd) as in the conventional case are applied, the pulse width of the scanning pulse Pw can be made smaller, which shortens the selective operation period B. This enables more time to be assigned in the discharge sustaining period C, which can increase a number of the sustaining pulses Ps, that is, which can increase luminance in the display in the PDP. Moreover, if a same pulse width of the scanning pulse Pw as used in the conventional case is applied, it is possible to the data pulse voltage Vd at a lower one, which thus enables reduction in power consumption.

Next, effects that can be obtained by causing the surface discharge to occur prior to occurrence of the facing discharge will be described. In the discharge occurring by the pre-discharging pulse Pps between the scanning electrode 2 and the data electrode 5 during the pre-discharging period A, the data electrode 5 is used as a cathode. One of big factors that determine the discharge initiating threshold voltage is a secondary electron emission coefficient on a cathode surface. The higher the secondary electron emission coefficient is, the lower the discharge initiating threshold voltage can be set to be. Therefore, as the material for the protecting layers 10 formed on the scanning electrode 2 and the sustaining electrode 3, magnesium oxide which is highly resistant to sputtering and has a comparatively high secondary electron emission coefficient or a like is used. On the other hand, on a surface of the data electrode 5 is formed a phosphor layer 8 used to obtain visible emitted light. Since a material for the phosphor making up the phosphor layer 8 is selected by giving a top priority to light emitting characteristics, in ordinary cases, a phosphor having a very low secondary electron emission coefficient when compared with magnesium oxide is used. Therefore, one problem is that the discharge initiating threshold voltage in the case where the data electrode 5 is used as the cathode is remarkably high when compared with a case where the data electrode 5 is used as an anode. Another problem is that, if such the material having a low secondary electron emission coefficient is formed on a surface of the cathode, not only the discharge initiating threshold voltage is made high but also a continuous and stable discharge is made difficult. For example, when a voltage pulse that causes a electric electric potential difference between the electrodes to increase with time is applied, if a substance having a high secondary electron emission coefficient exists on the surface of the cathode, a feeble discharge occurs from a time when the electric electric potential difference between the electrodes exceeds the discharge initiating threshold voltage and the discharge continues in a stable state as the difference in voltages applied from the outside increases. This enables a discharge in a so-called positive characteristic region to occur. In contrast, if a substance having a low secondary electron emission coefficient exists on the surface of the cathode, phenomena occur in which, since the discharge occurs after the electric electric potential difference has become very large, a strong discharge occurs and the discharge stops due to formation of lots of wall charges having a polarity being opposite to that of outside charges on the electrodes. An amount of the wall charge formed by such the strong discharge varies greatly in every discharging cell 12, which causes variations in characteristics to occur in a subsequent driving operation. That is, such the discharge is not effective as the initializing discharge serving to stabilize a state of the discharging cell 12. However, even if such the substance having a low secondary electron emission coefficient is formed on the surface of the cathode, when activated particles such as electrons, discharge gas ions or discharge gas particles being pumped to a metastable level or a like exist in the discharging space, the discharge initiating threshold voltage is made remarkably lowered. Thus, when the discharge starts at a low voltage, as in the case in which such the substance having a high secondary electron emission coefficient exists on the cathode, occurrence of a feeble continuous discharge is made possible. If such the feeble discharge occurs between the surface electrodes prior to the occurrence of a facing discharge, since lots of activated particles are produced in the discharging space, the discharge initiating threshold voltage for the facing discharge is made lower, which enables stable and continuous occurrence of the feeble discharge. Thus, by controlling an order of the occurrence of the surface discharge and facing discharge, it is made possible to cause more effective initializing discharge to occur in a stable manner.

However, in order to cause the facing discharge to occur after the surface discharge has occurred, to simply set an ultimate potential Vps at a high level during the pre-discharging period A is not enough. As described above, an important thing is to cause the discharge between the surface electrodes to occur prior to the occurrence of the discharge between the facing electrodes during the pre-discharging period A and appropriate setting of the voltage that can satisfy conditions of the structure of the PDP is necessary.

Second Embodiment

In the second embodiment, a method for driving the PDP in which a relation between discharge initiating thresholds is changed, in particular, in which the discharge initiating threshold voltage for the facing discharge is lower than that for the surface discharge will be described.

Figure 4:
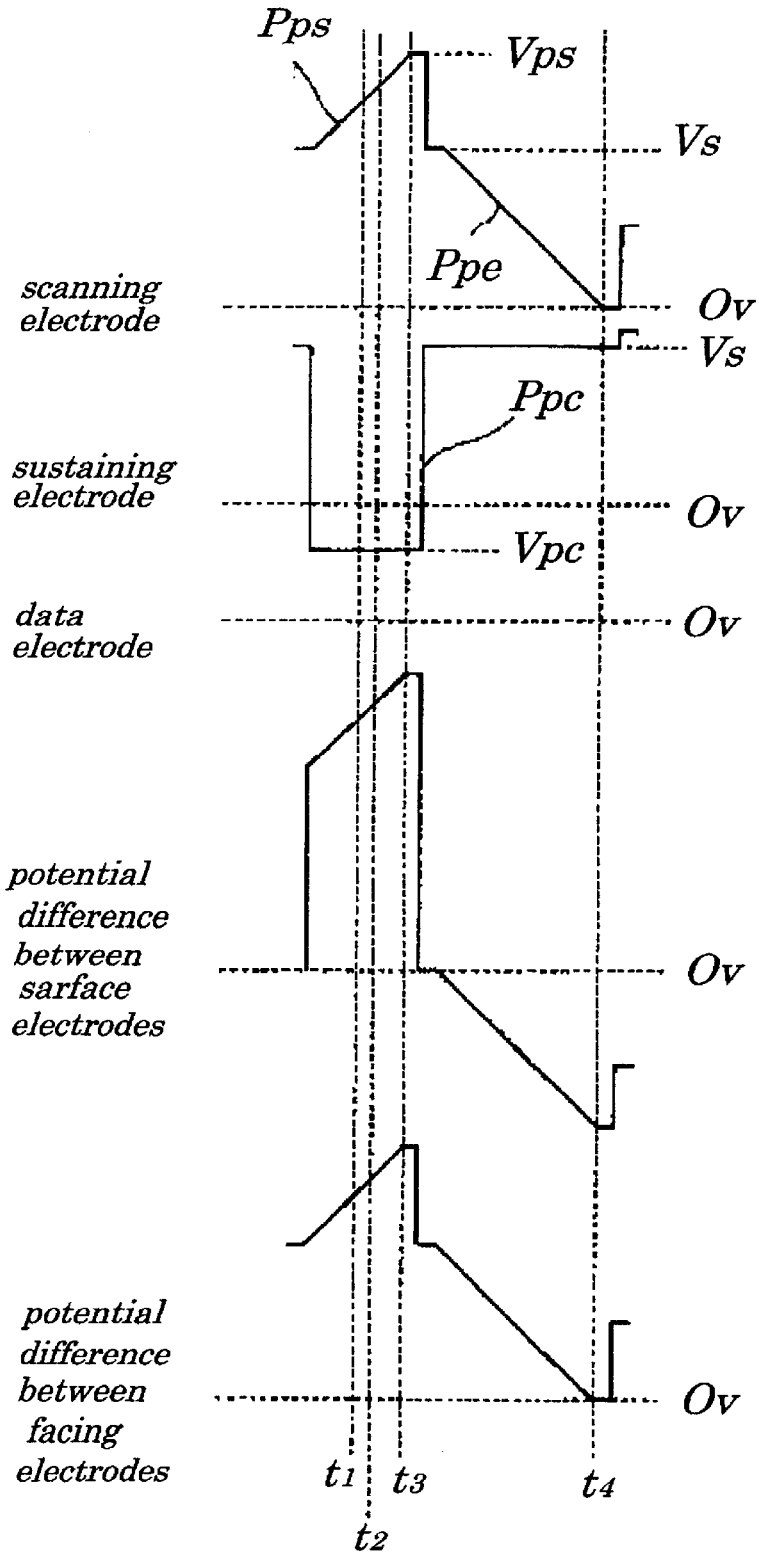
FIG. 4 is a timing chart showing a method for driving a PDP according to a second embodiment of the present invention.

FIG. 4 is a timing chart showing a method for driving the PDP according to the second embodiment of the present invention. Though only a pre-discharging period is shown in FIG. 4, as in the case of the first embodiment, a selective operation period, a discharge sustaining period, and a discharge sustaining terminating period are sequentially provided, following the pre-discharging period. In the second embodiment, as in the case of the first embodiment, a reference potential between surface electrodes, that is, between a scanning electrode 2 and a sustaining electrode 3 is used as a sustaining voltage Vs to sustain a discharge during the discharge sustaining period. Therefore, a electric electric potential of the scanning electrode 2 and of the sustaining electrode 3 being higher than the sustaining potential Vs is defined as a electric electric potential of positive polarity and a electric electric potential of the scanning electrode 2 and of the sustaining electrode 3 being lower than the sustaining potential Vs as a electric electric potential of negative polarity. The sustaining voltage Vs is set to be, for example, about 200 V. A reference potential of the data electrode 5 is 0 (zero) V.

Though basic configurations of the PDP to be driven by the method in the second embodiment are the same as those in the first embodiment, the discharge initiating threshold voltages differ due to differences in dimensions and/or materials in each component making up the PDP. For example, the discharge initiating threshold voltage between the surface electrodes is as high as 320 V, while the discharge initiating threshold between the facing electrodes in a state where lots of activated particles exist in discharging space is as low as 280 V.

In the second embodiment, a sawtooth-shaped pre-discharging pulse Pps having its ultimate potential being Vps of positive polarity is applied to the scanning electrode 2 and, at the same time, a rectangular pre-discharging pulse Ppc having its electric electric potential being Vpc of negative polarity is applied to the sustaining electrode 3. At this time, a electric electric potential of the data electrode 5 is fixed at 0 (zero) V. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, for example, the Vpc is set to be −60 V and the Vps to be 320 V.

By setting as above, when a electric electric potential of the pre-discharging pulse Pps becomes 260 V, a electric electric potential difference between the scanning electrode 2 and sustaining electrode 3 becomes 320 V and, as a result, a feeble discharge occurs continuously between the surface electrodes (at a time of $t_1$). Then, when a electric electric potential of the pre-discharging pulse Pps becomes 280 V, a difference in electric electric potentials between the facing electrodes also becomes 280 V. At this time, since lots of activated particles produced by the surface discharge exist in the discharging space, a feeble facing discharge between the scanning electrode 2 and the data electrode 5 occurs continuously and in a stable manner (at a time of $t_2$). Then, the electric electric potential of the pre-discharging pulse Pps reaches the electric electric potential Vps and the discharge stops at the same time when a change in the electric electric potential difference is stopped (at a time of $t_3$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric electric potential of the sustaining electrode 3 is fixed at the sustaining voltage Vs. Also, a electric electric potential of the data electrode 5 is fixed at 0 V. By the application of the pre-discharge erasing pulse Ppe, a discharge of a polarity being opposite to that of the above pre-discharge occurs between the surface electrodes and the wall charges formed on the scanning electrode 2 and on the sustaining electrode 3 are erased (at a time of $t_4$). Moreover, the operation of erasing wall charges during the pre-discharging period includes an operation of adjusting wall charges to have a smooth operation be performed in the subsequent processes such as selective operations, discharge sustaining operations or a like.

Thereafter, as in the first embodiment, by selecting a discharging cell during a selective operation period, by obtaining light emitted for displaying induced by a discharge during a discharge sustaining period and by stopping the discharge during a discharge sustaining terminating period, same display operations as in the first embodiment can be performed.

Thus, according to the embodiment, even in the PDP in which a relation between the discharge initiating threshold voltages has been changed, it is possible to cause a stable facing discharge to occur and positive wall charges to be formed on the data electrode 5. As a result, lowering of the data voltage Vd and shortening of the selective operation period are made possible.

Third Embodiment

In the third embodiment, a method for driving a PDP having same voltage characteristics as the PDP employed in the second embodiment had is described.

Figure 5:
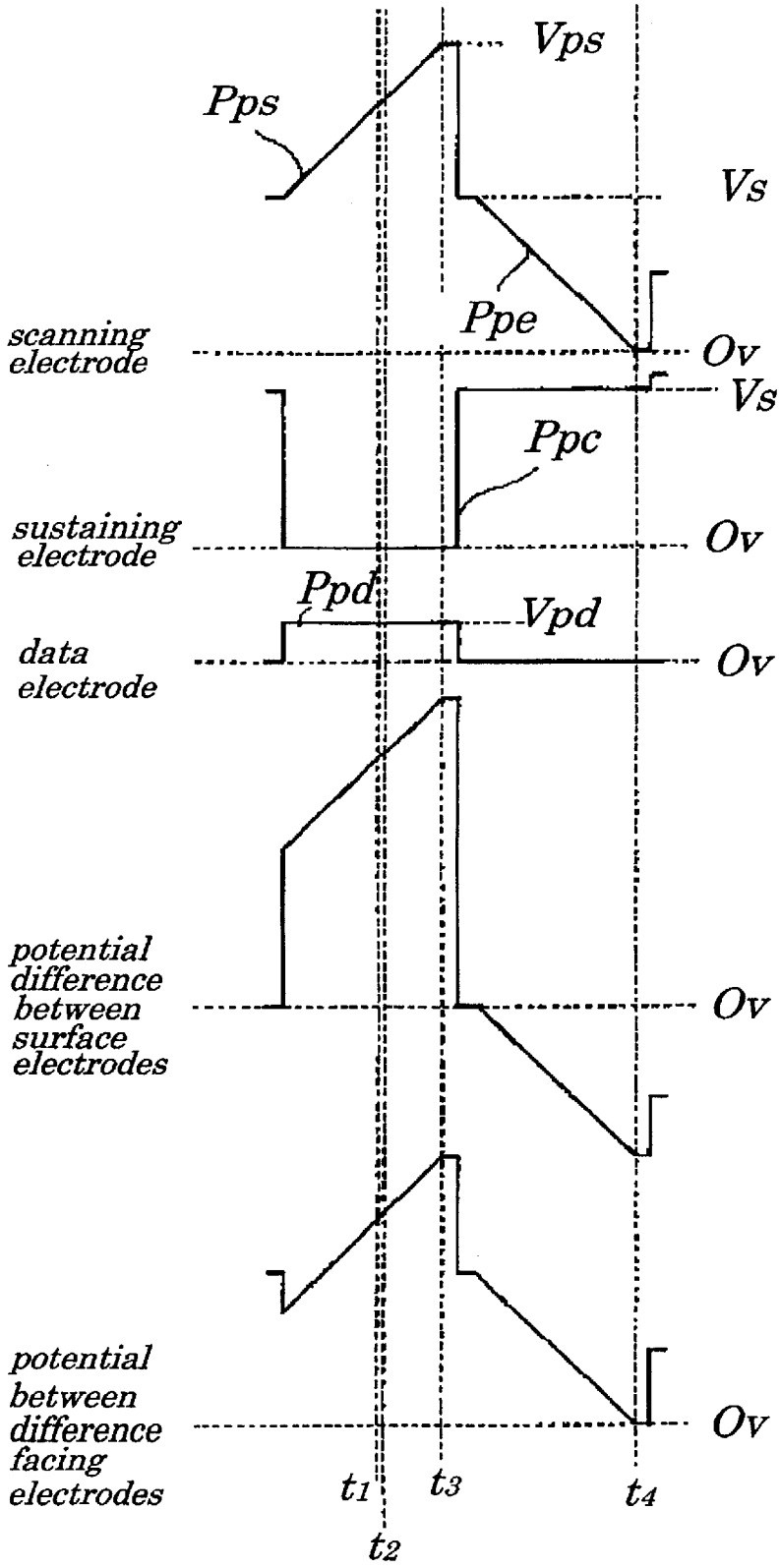
FIG. 5 is a timing chart showing a method for driving a PDP according to a third embodiment of the present invention.

FIG. 5 is a timing chart showing the method for driving the PDP according to the third embodiment of the present invention. Though only a pre-discharging period is shown in FIG. 5, as in the case of the first embodiment, a selective operation period, a discharge sustaining period, and a discharge sustaining terminating period are sequentially provided, following the pre-discharging period. Also, in the third embodiment, as in the case of the first embodiment, a reference potential between surface electrodes is used as a sustaining voltage Vs to sustain a discharge during the discharge sustaining period. Therefore, a electric electric potential of the scanning electrode 2 and of the sustaining electrode 3 being higher than the sustaining potential Vs is defined as a electric electric potential of positive polarity and a electric electric potential of the scanning electrode 2 and the sustaining electrode 3 being lower than the sustaining potential Vs as a electric electric potential of negative polarity. The sustaining voltage Vs is set to be, for example, about 200 V. A reference potential of the data electrode 5 is 0 (zero) V.

Configurations of the PDP to be driven by the method of the third embodiment are the same as those in the second embodiment. For example, a discharge initiating threshold voltage between the surface electrodes is set to be 320 V, while a discharge initiating threshold between the facing electrodes in a state where lots of activated particles exist in discharging space is set to be 280 V.

In the third embodiment, during the pre-discharging period, a sawtooth-shaped pre-discharging pulse Pps having its ultimate potential being Vps of positive polarity is applied to a scanning electrode 2 and, at the same time, a rectangular pre-discharging pulse Ppc having its electric potential being Vpc of negative polarity is applied to a sustaining electrode 3. Also, to a data electrode 5 is applied a pre-discharging pulse Ppd having its electric potential being Vpd is applied. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, for example, the Vpc is set to be 0 V and the Vps to be 400 V and the Vpd to be 50 V.

By setting as above, when a electric potential of the pre-discharging pulse Pps becomes 320 V, a electric potential difference between the scanning electrode 2 and sustaining electrode 3 becomes 320 V and a feeble discharge occurs continuously between the surface electrodes (at a time of $t_1$). At this time, since a electric potential difference between the facing electrodes is 270 V, no discharge occurs between the facing electrodes. Then, when the electric potential of the pre-discharging pulse Pps becomes 330 V, the electric potential difference between the facing electrodes becomes 280 V. At this time, since lots of activated particles produced by the surface discharge exist in discharging space, a feeble facing discharge between the scanning electrode 2 and data electrode 5 occurs continuously and in a stable manner (at a time of $t_2$). Then, the electric potential of the pre-discharging pulse Pps reaches the electric potential Vps and the discharge stops at the same time when a change in the electric potential difference is stopped (at a time of $t_3$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_4$). Moreover, the operation of erasing the wall charges during the pre-discharging period includes an operation of adjusting wall charges to have a smooth operation be performed in the subsequent processes such as selective operations, discharge sustaining operations or a like.

Thereafter, as in the first and second embodiments, by selecting a discharging cell during the selective operation period, by obtaining light emitted for displaying induced by the discharge during the discharge sustaining period and by stopping the discharge during the discharge sustaining terminating period, the same display operations as in the first and second embodiments can be performed.

Also, in the third embodiment, by causing a stable facing discharge to occur during the pre-discharging period, it is possible to cause positive wall charges to be formed on the data electrode 5. As a result, lowering of the data voltage Vd and shortening of the selective operation period are made possible.

Unlike in the case of the second embodiment in which the electric potential being Vpc has to be newly formed, in the third embodiment, since the electric potential Vpd of the pre-discharging pulse Ppd to be fed to the data electrode 5 can be set to be same as that of the electric potential Vd of the data pulse Pd to be fed during the selective operation period, no increase of a type of the electric potential is required, thus enabling inhibition of a rise in costs.

Fourth Embodiment

Configurations of a PDP to be driven by a method of the fourth embodiment are basically a same as those of the PDP driven by the method of the first embodiment. That is, one discharging cell 12 is placed at a point of intersection of one scanning electrode 2, one sustaining electrode 3 and one data electrode 5 intersecting the scanning electrode 2 and sustaining electrode 3 at right angles. However, in order to perform a color display, a plurality of phosphors including three types, for example, one for a red color, another for a green color and other for a blue color, is applied, each being partitioned by the rib 7. As a result, on one data electrode 5 is formed a phosphor layer 8 being partitioned by the rib 7 and each of the partitioned phosphor layers 8 providing one same color.

Figure 6:
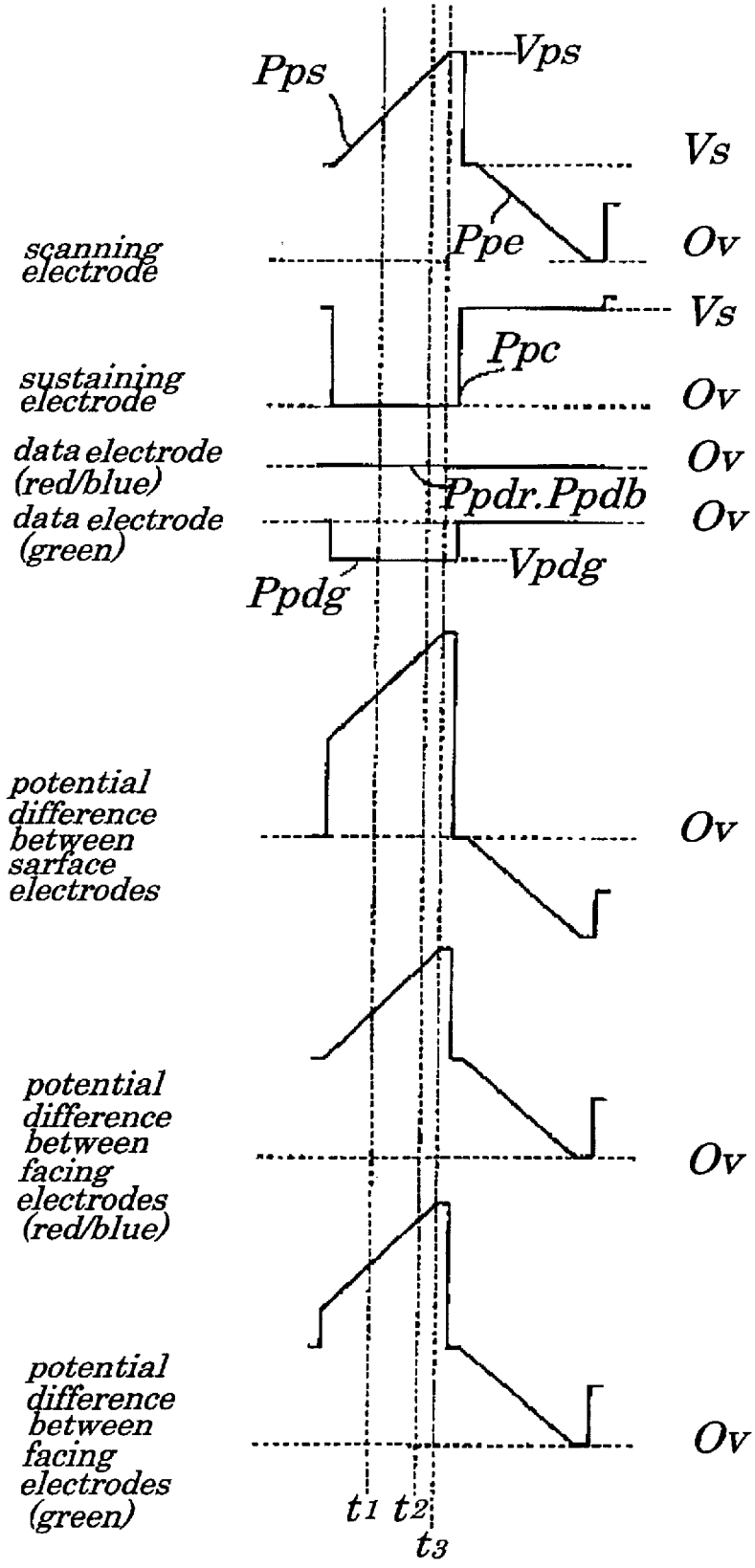
FIG. 6 is a timing chart showing a method for driving a PDP according to a fourth embodiment of the present invention.

FIG. 6 is a timing chart showing the method for driving the PDP according to the fourth embodiment of the present invention. Though only a pre-discharging period is shown in FIG. 6, as in the case of the first embodiment, a selective operation period, a discharge sustaining period, and a discharge sustaining terminating period are sequentially provided, following the pre-discharging period. In the fourth embodiment, as in the case of the first and second embodiments, a reference potential between surface electrodes, that is, between the scanning electrode 2 and the sustaining electrode 3 is used as a sustaining voltage Vs to sustain a discharge during the discharge sustaining period. Therefore, a electric potential of the scanning electrode 2 and of the sustaining electrode 3 being higher than the sustaining potential Vs is defined as a electric potential of positive polarity and a electric potential of the scanning electrode 2 and of the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

In the fourth embodiment, during the pre-discharging period, a sawtooth-shaped pre-discharging pulse Pps having its ultimate potential being Vps of positive polarity is applied to the scanning electrode 2 and, at the same time, a rectangular pre-discharging pulse Ppc having its electric potential being Vpc of negative polarity is applied to the sustaining electrode 3. At this time, a pre-discharging pulse Ppd is fed to the data electrode 5. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. However, in ordinary cases, since a material for each of the phosphors is selected by giving a priority to a light emitting characteristic of each of the phosphors, in many cases, discharge characteristics can not be defined uniformly. A discharge using the data electrode 5 as a cathode, in particular, is greatly influenced by a secondary electron emission coefficient of a phosphor on the data electrode 5. Because of this, a discharge initiating threshold voltage between the surface electrodes in a state where lots of activated particles exist in discharging space varies depending on emitted light color and, for example, it is 330 V for the red and blue colors and it is 390 V for the green color. On the other hand, a discharge initiating threshold voltage between the surface electrodes is constant irrespective of the emitted light color and is, for example, 250 V. In the case of the PDP as described above, the ultimate potential Vps of the pre-discharging pulse Pps is set to be 360 V and the electric potential Vpc of the pre-discharging pulse Ppc is set to be 0 V. Moreover, a electric potential Vpdg of a pre-discharging pulse Ppdg to be fed to the data electrode 5 corresponding to the discharging cell 12 in which a green-colored phosphor layer 8 is formed, is set to be −60 V and both a electric potential Vpdr of a pre-discharging Ppdr to be fed to the data electrode 5 corresponding to the discharging cell 12 in which a red-colored phosphor layer 8 is formed and a electric potential Vpdb of a pre-discharging Ppdb to be fed to the data electrode 5 corresponding to the discharging cell 12 in which a blue-colored phosphor layer 8 is formed, are set to be 0 V, that is, are set to be in a state where no pulse is applied.

By setting as above, when the electric potential of the pre-discharging pulse Pps becomes 250 V, a electric potential difference between the scanning electrode 2 and sustaining electrode 3 exceeds the discharge initiating threshold voltage and, as a result, a feeble discharge occurs continuously between the surface electrodes (at a time of $t_1$). Then, when the electric potential of the pre-discharging pulse Pps has become 330 V, in the discharging cells for the red and blue colors, the electric potential difference between the facing electrodes becomes 330 V and, in the discharging cell for the green color, the electric potential difference between the facing electrodes becomes 390 V. At this time, since lots of activated particles produced by the surface discharge exist in discharging space, a feeble facing discharge between the scanning electrode 2 and data electrode 5 occurs continuously and in a stable manner (at a time of $t_2$). The facing discharge continues in a stable manner by activated particles produced by the facing discharge itself as the electric potential of the scanning electrode 2 rises. Then, the electric potential of the pre-discharging pulse Pps reaches the electric potential Vps and the discharge stops at the same time when a change in the electric potential difference is stopped (at a time of $t_3$). As a result, negative wall charges are formed on the scanning electrode 2 and positive wall charges are formed on the sustaining electrode 3 and further almost a same amount of positive wall charges are formed on all the data electrode 5.

Thereafter, as in the first, second, and third embodiments, after feeding the pre-discharging pulse Ppe, by selecting a discharging cell during the selective operation period, by obtaining light emitted for displaying induced by the discharge during the discharge sustaining period and by stopping the discharge during the discharge sustaining terminating period, same display operations as in the first, second, and third embodiments can be performed.

In the fourth embodiment, by causing a facing discharge to occur during the pre-discharging period, formation of positive wall charges on the data electrode 5 is made possible. This enables lowering of the data voltage Vd and shortening of the selective operation period.

Moreover, according to the fourth embodiment, since the electric potential Vpd corresponding to each color to be provided by the phosphor layer 8 is fed to the data electrode 5, the difference in the discharge initiating threshold voltage is not affected by differences in materials for the phosphor, which thus enables start timing for the facing discharge to be matched. As a result, almost the same amount of wall charges for each of the colors of the phosphor layer 8 can be formed, which enables the discharge characteristic during the subsequent selective operation period to be made more uniform.

Fifth Embodiment

Figure 7:
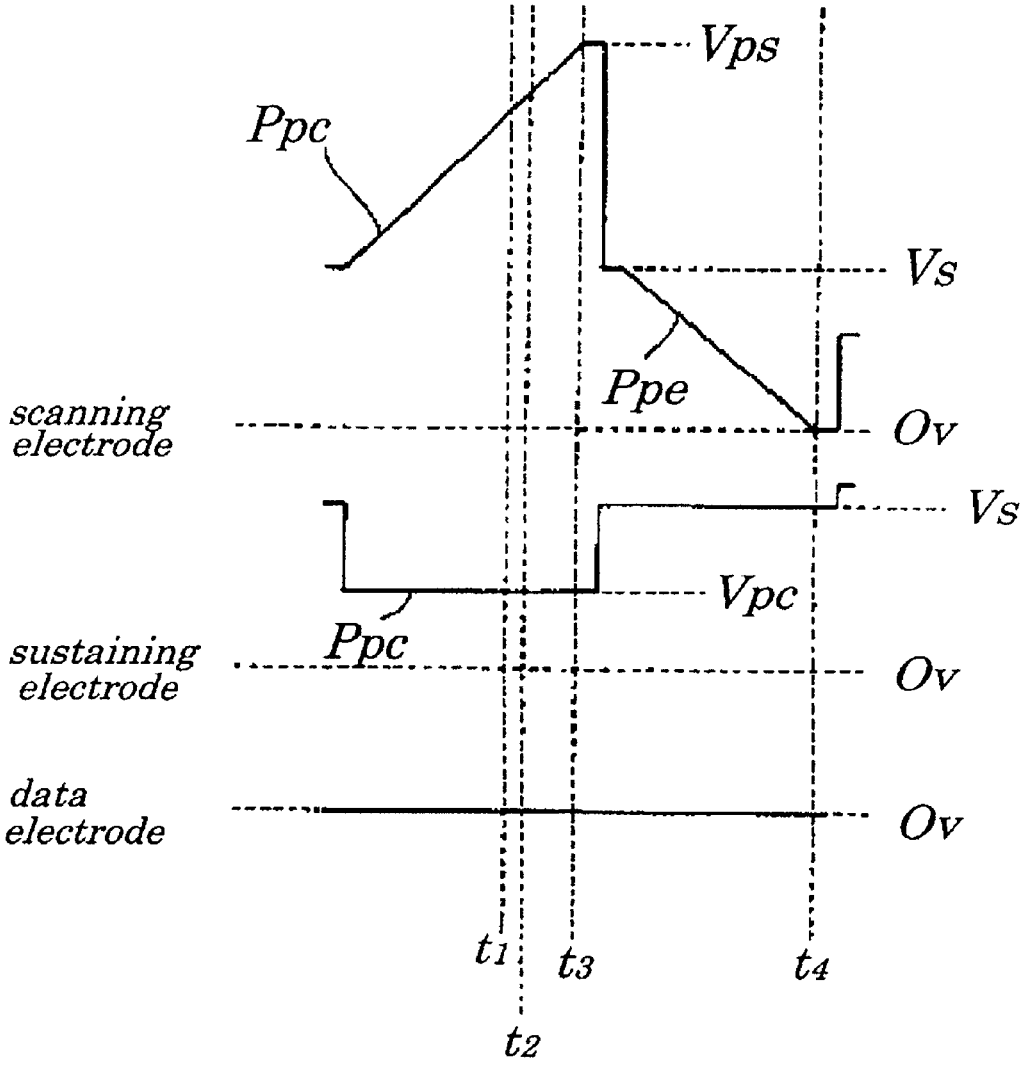
FIG. 7 is a timing chart showing a method for driving a PDP according to a fifth embodiment of the present invention.

In a method for driving a PDP of a fifth embodiment, an example in which black luminance is decreased, that is, contrast is improved is described. FIG. 7 is a timing chart showing the method for driving the PDP according to a fifth embodiment. Though only a pre-discharging period is shown in FIG. 7, as in the case of the first embodiment, a selective operation period, a discharge sustaining period, and a discharge sustaining terminating period are sequentially provided, following the pre-discharging period. In the fifth embodiment, as in the case of the first embodiment, a reference potential between surface electrodes, that is, between a scanning electrode 2 and a sustaining electrode 3 is used as a sustaining voltage Vs to sustain a discharge during the discharge sustaining period. Therefore, a electric potential of the scanning electrode 2 and the sustaining electrode 3 being higher than the sustaining potential Vs is defined as a electric potential of positive polarity and a electric potential of the scanning electrode 2 and the sustaining electrode 3 being lower than the sustaining potential Vs as a electric potential of negative polarity. The sustaining voltage Vs is set to be, for example, about 170 V. A reference potential of the data electrode 5 is 0 (zero) V.

Configurations of the PDP to be driven by the method of the fifth embodiment are the same as those in the first embodiment. The discharge initiating threshold voltage between the surface electrodes is set to be 250 V, while the discharge initiating threshold between the facing electrodes in a state where lots of activated particles exist in discharging space, is set to be 350 V.

In the fifth embodiment, during the pre-discharging period, a sawtooth-shaped pre-discharging pulse Pps having its ultimate potential being Vps of positive polarity is applied to the scanning electrode 2 and, at the same time, a rectangular pre-discharging pulse Ppc having its electric potential being Vpc of negative polarity is applied to the sustaining electrode 3. At this time, the electric potential of the data electrode 5 is fixed at 0 (zero) V. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vpc is set to be 80 V and the Vps is set to be 400 V.

By setting as above, when the electric potential of the pre-discharging pulse Pps becomes 330 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps has become 350 V, the electric potential difference between the facing electrodes becomes 350 V. At this time, since lots of activated particles produced by the surface discharge exist in discharging space, a feeble facing discharge between the scanning electrode 2 and data electrode 5 occurs continuously and in a stable manner (at a time of $t_2$). Then, the electric potential of the pre-discharging pulse Pps reaches the electric potential Vps and the discharge stops at the same time when a change in the electric potential difference is stopped (at a time of $t_3$).

To the scanning electrode 2 is applied a sawtooth-shaped pre-discharge erasing pulse Ppe of negative polarity, following the application of the pre-discharging pulse Pps. An ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_4$). Moreover, the operation of erasing the wall charges during the pre-discharging period includes an operation of adjusting wall charges to have a smooth operation be performed in the subsequent processes such as selective operations, discharge sustaining operations or a like.

Figures 8A, 8B:
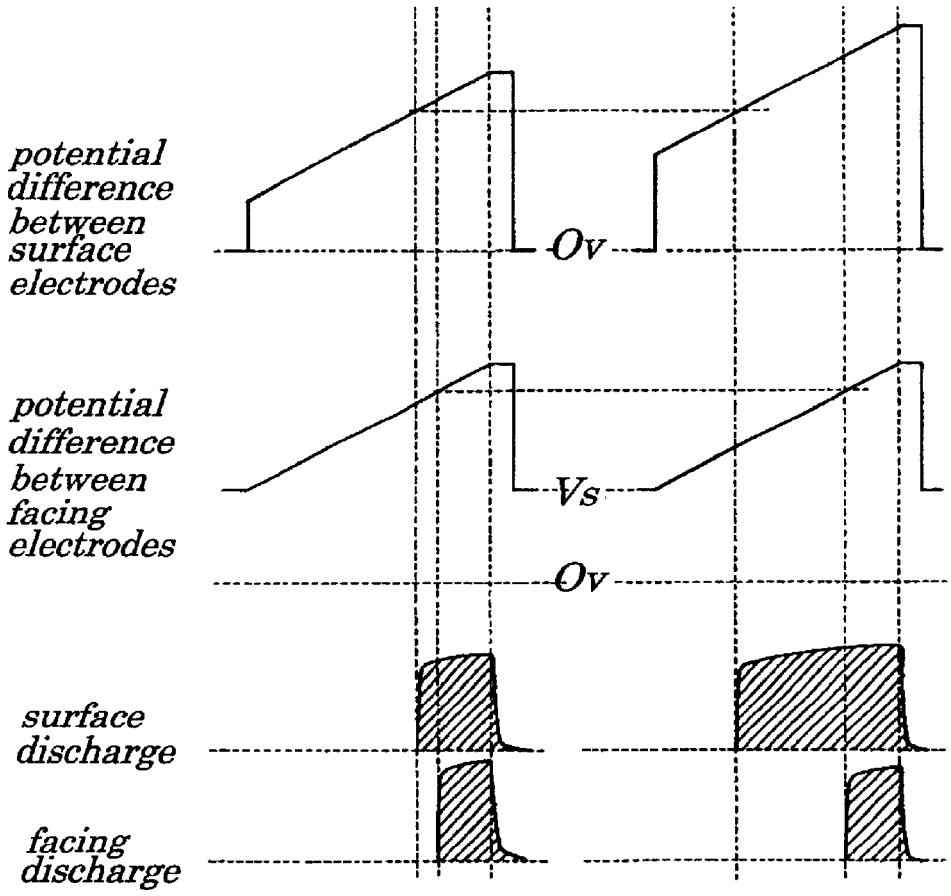
FIGS. 8A and 8B are schematic diagrams showing electric electric potential differences between electrodes and states of discharges in the fifth embodiment and in the first embodiment of the present invention.

The method for driving the PDP of the fifth embodiment is the same as that employed in the first embodiment except that a electric potential of the pre-discharging pulse Ppc to be applied to the sustaining electrode 3 is set to be 80 V. States of the discharge induced by the pre-discharging pulse are explained below by comparing the discharge in the fifth embodiment with that in the first embodiment. FIGS. 8A and 8B are timing charts schematically showing electric potential differences between the scanning electrode 2 and the sustaining electrode 3 or between the scanning electrode 2 and the data electrode 5 and states of the discharges in the fifth embodiment and in the first embodiment respectively.

Figure 9:
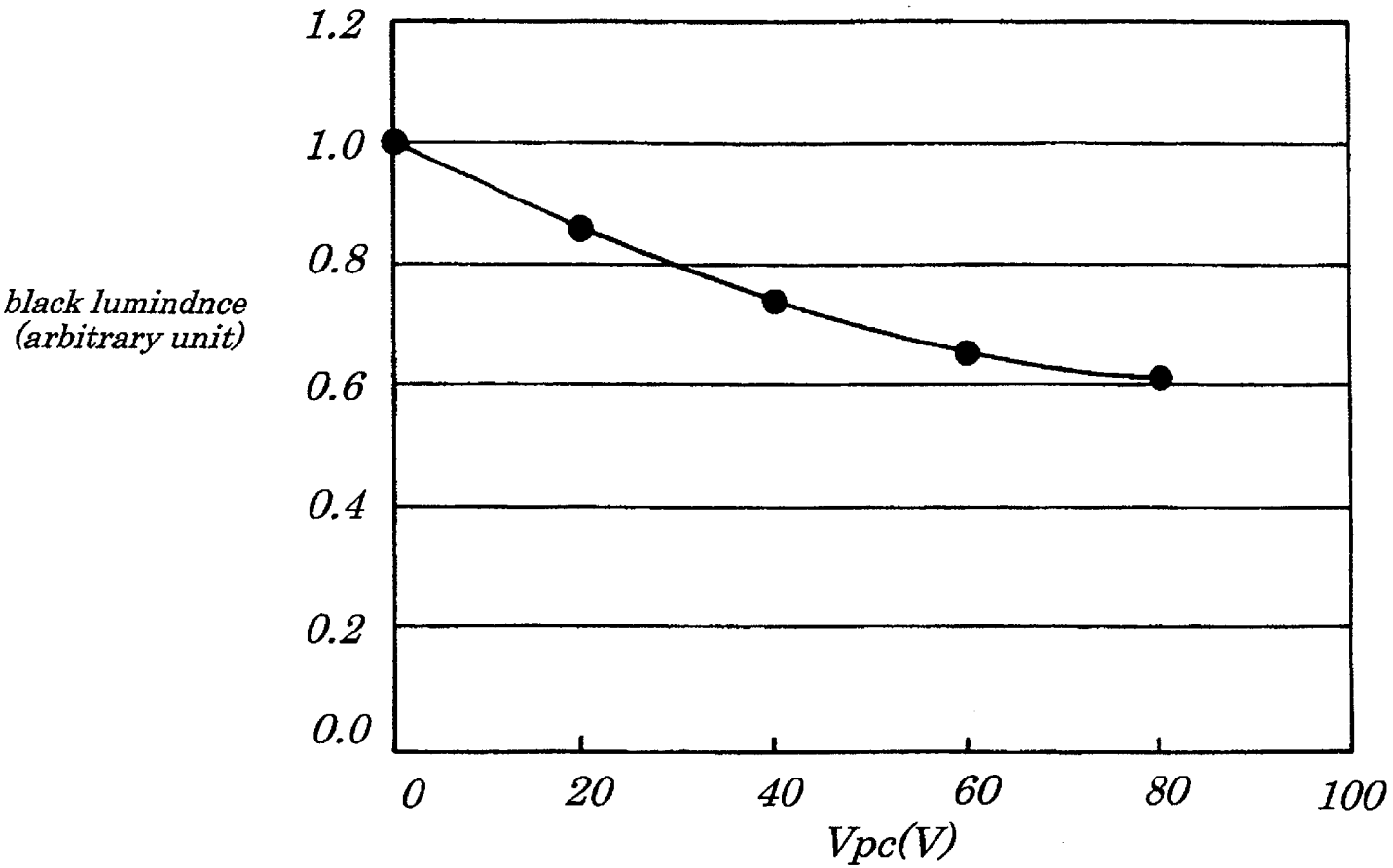
FIG. 9 is a graph showing a relation between a pre-discharging pulse voltage and black luminance in the fifth embodiment of the present invention.

In both the fifth and first embodiments, the facing discharge between the scanning electrode 2 and data electrode 5 occurs continuously from a time when a electric potential of the scanning electrode 2 becomes 350 V to a time when the electric potential of the scanning electrode 2 reaches 400 V being its highest electric potential. The surface discharge between the scanning electrode 2 and sustaining electrode 3 occurs continuously from a time when the electric potential of the scanning electrode 2 reaches 250 V to a time when its electric potential reaches 400 V being its highest electric potential in the first embodiment. On the other hand, the surface discharge between the scanning electrode 2 and sustaining electrode 3 does not occur until the electric potential of the scanning electrode 2 reaches 330 V. An amount of the discharge in the pre-discharge in the fifth embodiment can be smaller than that in the first embodiment. In the PDP, since ultraviolet rays emitted by the discharge are converted to visible light which is perceived as emitted light, a decrease in the amount of the discharge leads to lowering in luminance in displaying. FIG. 9 is a graph showing a change in luminance of the emitted light by the pre-discharge occurring when the electric potential Vpc of the pre-discharging pulse Pps is changed from 0 (zero) V (state in the first embodiment). As shown in FIG. 9, as the electric potential Vpc increases, the luminance decreases and, for example, when the electric potential Vpc becomes 80 V, the luminance is lowered by about 40%. Thus, by light emitting by the pre-discharge, the problem of the luminance in an OFF state of all display, that is, of the luminance in a black display is addressed. As a result, the black luminance is decreased, which can improve contrast in the PDP.

Thereafter, as in the first embodiment, by selecting a discharging cell during the selective operation period, by obtaining light emitted for displaying induced by the discharge during the discharge sustaining period and by stopping the discharge during the discharge sustaining terminating period, same display operations as in the first embodiment can be performed.

In the fifth embodiment, by causing a facing discharge to occur during the pre-discharging period, formation of positive wall charges on the data electrode 5 is made possible. This enables lowering of the data voltage Vd and shortening of the selective operation period.

Sixth Embodiment

Figure 10:
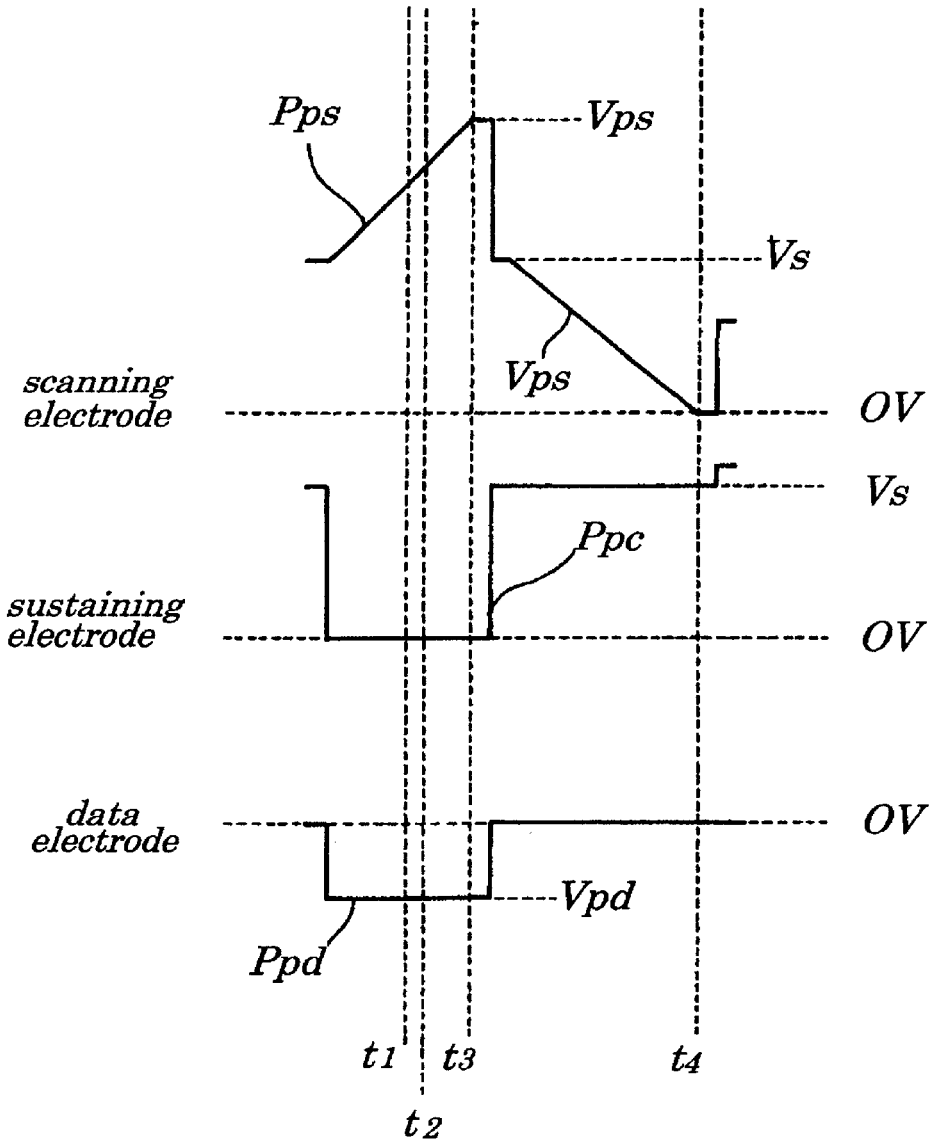
FIG. 10 is a timing chart showing a method for driving a PDP according to a sixth embodiment of the present invention.

FIG. 10 is a timing chart showing a method for driving a PDP according to a sixth embodiment of the present invention. Though only a pre-discharging period is shown in FIG. 10, as in the case of the first embodiment, a selective operation period, a discharge sustaining period, and a discharge sustaining terminating period are sequentially provided, following the pre-discharging period. In the sixth embodiment, as in the case of the first embodiment, a reference potential between surface electrodes is used as a sustaining voltage Vs to sustain a discharge during the discharge sustaining period. Therefore, a electric potential of the scanning electrode 2 and the sustaining electrode 3 being higher than the sustaining potential Vs is defined as a electric potential of positive polarity and a electric potential of the scanning electrode 2 and the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the sixth embodiment are the same as those in the first embodiment. The discharge initiating threshold voltage between the surface electrodes is set to be 250 V, while the discharge initiating threshold between the facing electrodes in a state where lots of activated particles exist in discharging space, is set to be 350 V.

In the sixth embodiment, during the pre-discharging period, a sawtooth-shaped pre-discharging pulse Pps having its ultimate potential being Vps of positive polarity is applied to the scanning electrode 2 and, at the same time, a rectangular pre-discharging pulse Ppc having its electric potential being Vpc of negative polarity is applied to the sustaining electrode 3. Moreover, a rectangular pre-discharging pulse Ppd having its electric potential being Vpd is applied to the data electrode 5. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vps is set to be 320 V, the Vpc is set to be 0 V and the Vpd is set to be −80 V.

By setting as above, when the electric potential of the pre-discharging pulse Pps becomes 250 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps has become 270 V, the electric potential difference between the facing electrodes becomes 350 V. At this time, since lots of activated particles produced by the surface discharge exist in discharging space, a feeble facing discharge between the scanning electrode 2 and data electrode 5 occurs continuously and in a stable manner (at a time of $t_2$). Then, the electric potential of the pre-discharging pulse Pps reaches the electric potential Vps and the discharge stops at the same time when a change in the electric potential difference is stopped (at a time of $t_3$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_4$). Moreover, the operation of erasing the wall charges during the pre-discharging period includes an operation of adjusting wall charges to have a smooth operation be performed in the subsequent processes such as selective operations, discharge sustaining operations or a like.

Thereafter, as in the first embodiment, by selecting a discharging cell during the selective operation period, by obtaining light emitted for displaying induced by the discharge during the discharge sustaining period and by stopping the discharge during the discharge sustaining terminating period, same display operations as in the first embodiment can be performed.

In the sixth embodiment, by causing a facing discharge to occur during the pre-discharging period, formation of positive wall charges on the data electrode 5 is made possible. This enables lowering of the data voltage Vd and shortening of the selective operation period.

Figures 11A, 11B:
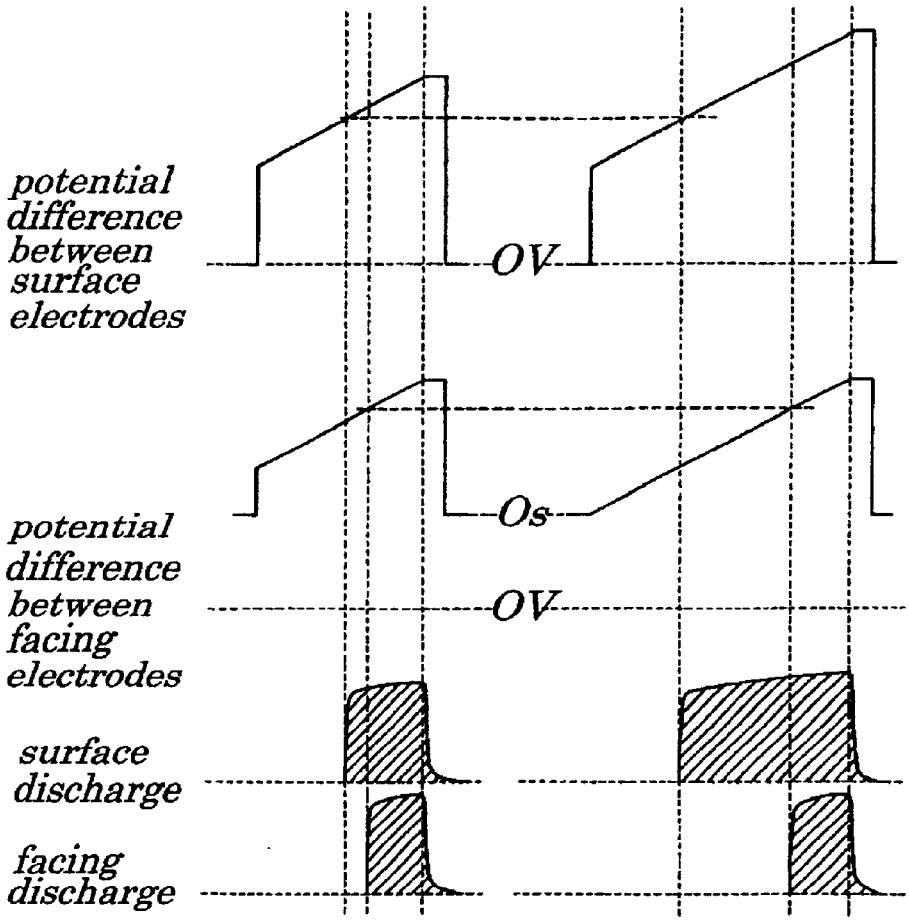
FIGS. 11A and 11B are schematic diagrams showing electric electric potential differences between electrodes and states of discharges in the sixth embodiment and in the first embodiment of the present invention.

State of discharges by each of the pre-discharging pulses in the sixth embodiment and in the first embodiment will be explained by comparison. FIGS. 11A and 11B are timing charts schematically showing electric potential differences between the scanning electrode 2 and sustaining electrode 3 or between the scanning electrode 2 and the data electrode 5 and states of discharges in the sixth embodiment and in the first embodiment respectively.

The surface discharge between the scanning electrode 2 and the sustaining electrode 3 occurs at a time when the electric potential of the scanning electrode 2 becomes 250 V in both the sixth and first embodiments. However, in the case of the first embodiment, the surface discharge continues until the electric potential of the scanning electrode 2 becomes 400 V, while the surface discharge stops at a time when the electric potential of the scanning electrode 2 reaches 320 V in the case of the sixth embodiment. Moreover, the facing discharge between the scanning electrode 2 and the data electrode 5 continues from a time when the electric potential of the scanning electrode 2 reaches 350 V to a time when it reaches its highest electric potential being 400 V in the case of the first embodiment, while the surface discharge continues from a time when the electric potential of the scanning electrode 2 reaches 270 V to a time when it reaches its highest electric potential being 320 V in the case of the sixth embodiment. When the relation among above electric potentials is expressed by a electric potential difference between the scanning electrode 2 and data electrode 5, in both the embodiments, the facing discharge continues from a time when the electric potential difference becomes 350 V to a time when it becomes 400 V. That is, an amount of the facing discharge is almost the same in both the sixth and first embodiment, however, only duration of the surface discharge is shortened in the sixth embodiment. This reduces an amount of emitted light in the pre-discharge, as in the fifth embodiment, thus enabling contrast to be improved in the sixth embodiment.

Moreover, according to the sixth embodiment, when the pre-discharging pulse Ppd is fed to the data electrode, by selecting the electric potential Vpd of the discharging pulse Ppd so as to respond to a discharging characteristic of a phosphor having each color applied to the phosphor layer 8, a difference in the discharging characteristic among the phosphors can be accommodated Also, according to the sixth embodiment, since the ultimate potential Vps of the pre-discharging pulse Pps can be set to be lower, use of parts having a low withstand voltage and being comparatively cheap is made possible, thus costs of the PDP can be reduced as a whole. Furthermore, since the pre-discharging pulse having the lower electric potential is used, time for the application of the pre-discharging pulse Pps can be shortened, which thus enables a ratio of the pre-discharging period to the entire period to be lowered and the time to be assigned to the discharge sustaining period to be made longer. As a result, it is possible to further increase the luminance.

Seventh Embodiment

Figure 12:
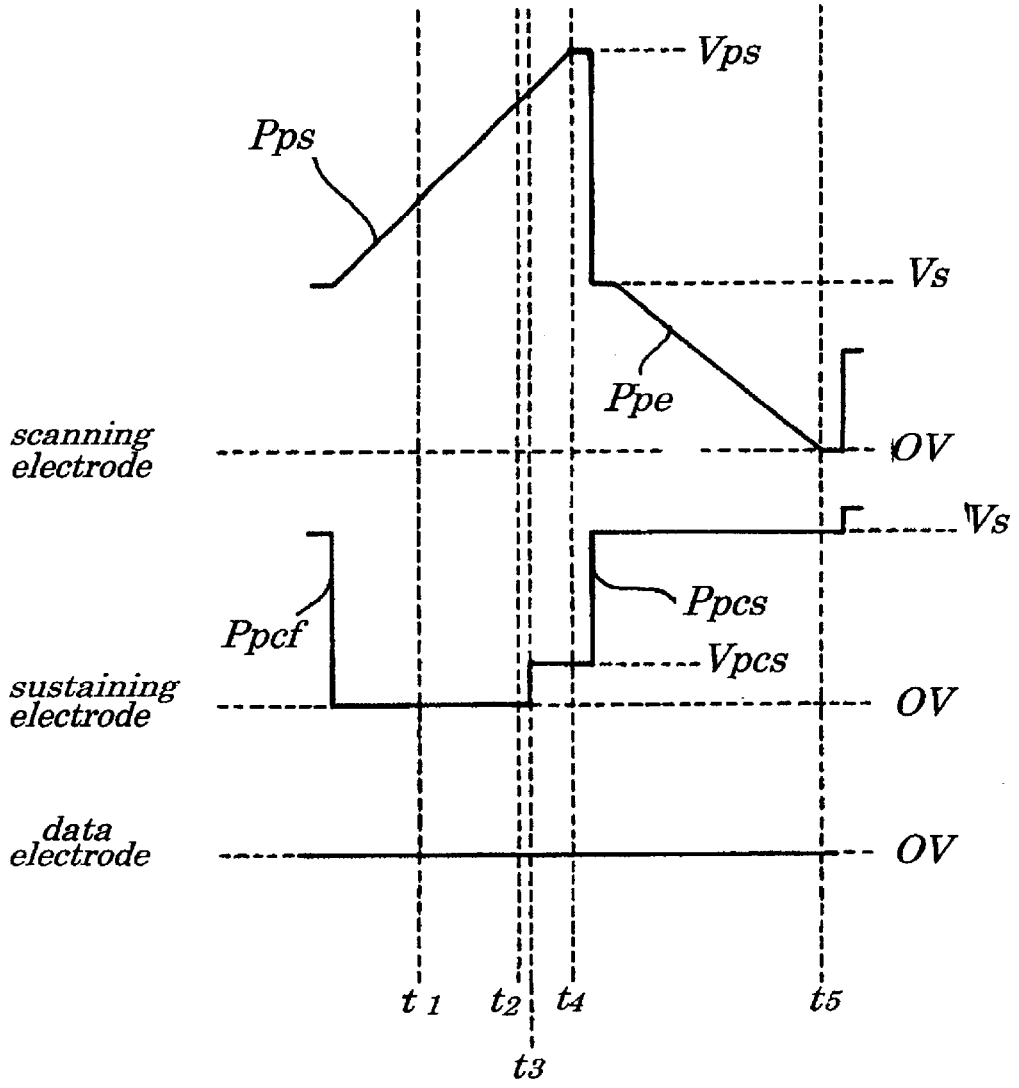
FIG. 12 is a timing chart showing a method for driving a PDP according to a seventh embodiment of the present invention.

FIG. 12 is a timing chart showing a method for driving a PDP according to a seventh embodiment of the present invention. Though only a pre-discharging period is shown in FIG. 12, as in the case of the first embodiment, a selective operation period, a discharge sustaining period, and a discharge sustaining terminating period are sequentially provided, following the pre-discharging period. In the seventh embodiment, as in the case of the first embodiment, a reference potential between surface electrodes is used as a sustaining voltage Vs to sustain a discharge during the discharge sustaining period. Therefore, a electric potential of the scanning electrode 2 and the sustaining electrode 3 being higher than the sustaining potential Vs is defined as a electric potential of positive polarity and a electric potential of the scanning electrode 2 and the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the seventh embodiment are the same as those in the first embodiment. The discharge initiating threshold voltage between the surface electrodes is set to be 250 V, while the discharge initiating threshold between the facing electrodes, that is, between the scanning electrode 2 and the data electrode 5 in a state where lots of activated particles exist in discharging space, is set to be 350 V.

In the seventh embodiment, during the pre-discharging period, a sawtooth-shaped pre-discharging pulse Pps having its ultimate potential being Vps of positive polarity is applied to the scanning electrode 2. On the other hand, a rectangular first pre-discharging pulse Ppcf having a electric potential being Vpcf and a rectangular second pre-discharging pulse Ppcs having a electric potential being Vpcs are successively applied to the sustaining electrode 3. At this time, the electric potential of the data electrode 5 is set to be 0 (zero) V. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vps is set to be 400 V, the Vpcf to be 0 V and the Vpcs to be 40 V. Moreover, a pulse width of the first pre-discharging pulse Ppcf is adjusted so that the second pre-discharging pulse Ppcs is applied when the electric potential of the scanning electrode 2 becomes 360 V.

By setting as above, when the electric potential of the pre-discharging pulse Pps becomes 250 V, a electric potential difference between the scanning electrode 2 and sustaining electrode 3 becomes 250 V and, as a result, a feeble discharge occurs continuously between the surface electrodes (at a time of $t_1$) Then, when the electric potential of the pre-discharging pulse Pps has become 350 V, the electric potential difference between the facing electrodes, that is, between the scanning electrode 2 and the data electrode 5, becomes 350 V. At this time, since lots of activated particles produced by the surface discharge exist in discharging space, a feeble facing discharge between the scanning electrode 2 and data electrode 5 occurs continuously and in a stable manner (at a time of $t_2$) Then, when the electric potential of the pre-discharging pulse Pps reaches 360 V, the second pre-discharging pulse Ppcs is applied to the sustaining electrode 3 and a difference in the surface electric potentials between the scanning electrode 2 and sustaining electrode 3 decreases and, as a result, the surface discharge stops (at a time of $t_3$). On the other hand, the facing discharge that has once occurred continues in a stable manner even after the surface discharge is stopped by activated particles formed by the facing discharge itself. Then, the electric potential of the pre-discharging pulse Pps reaches the electric potential Vps and the discharge stops at a same time when a change in the electric potential difference stops (at a time of $t_4$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_5$). Moreover, the operation of erasing wall charges during the pre-discharging period includes an operation of adjusting wall charges to have a smooth operation be performed in the subsequent processes such as selective operations, discharge sustaining operations or a like.

Thereafter, as in the first embodiment, by selecting a discharging cell during the selective operation period, by obtaining light emitted for displaying induced by the discharge during the discharge sustaining period and by stopping the discharge during the discharge sustaining terminating period, same display operations as in the first embodiment can be performed.

In the seventh embodiment, by causing a facing discharge to occur during the pre-discharging period, formation of positive wall charges on the data electrode 5 is made possible. This enables lowering of the data voltage Vd and shortening of the selective operation period.

Figures 13A, 13B:
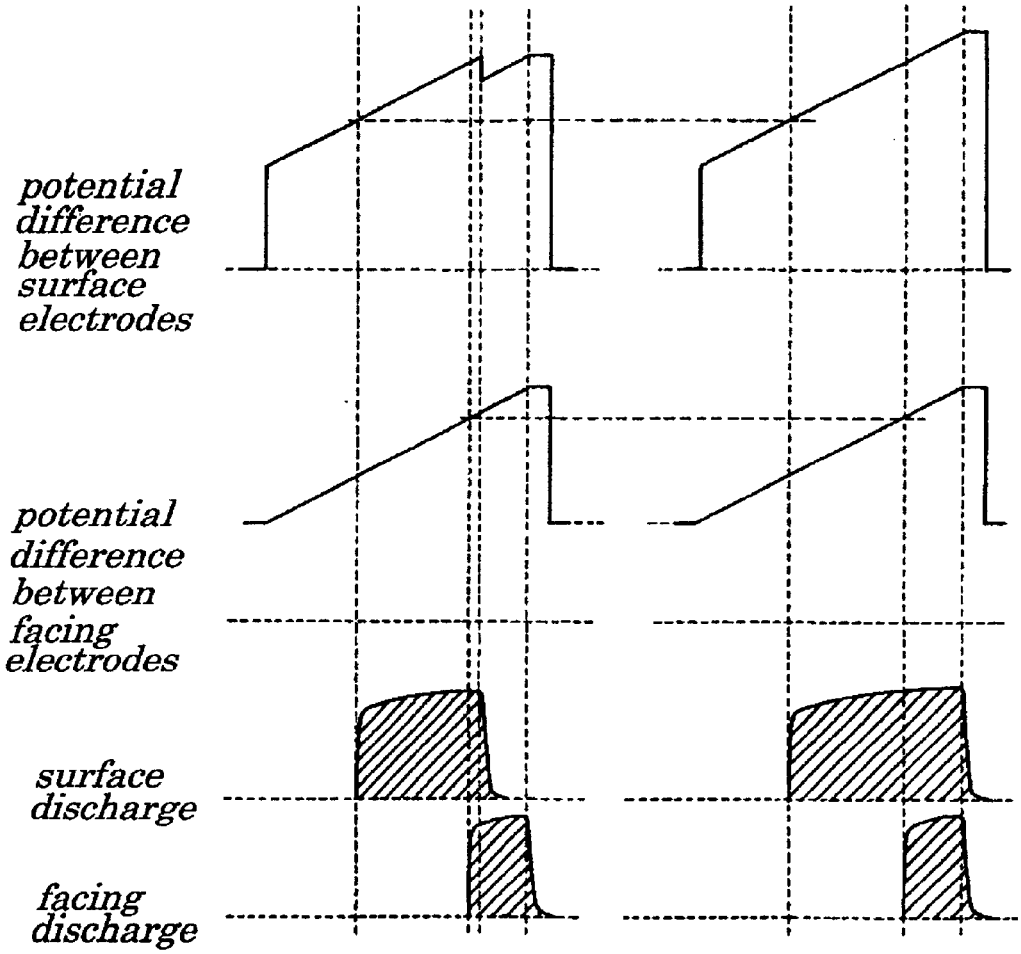
FIGS. 13A and 13B are schematic diagrams showing electric electric potential differences between electrodes and states of discharges in the seventh embodiment and in the first embodiment of the present invention.

The method for driving the PDP of the seventh embodiment is the same as in the first embodiment except that the second pre-discharging pulse Ppcs is applied to the sustaining electrode 3. States of the discharge induced by each of the pre-discharging pulses Ppsf and Ppcs are explained by comparing the discharges in the fifth embodiment with that in the first embodiment below. FIGS. 13A and 13B are timing charts schematically showing electric potential differences between the scanning electrode 2 and sustaining electrode 3 or between the scanning electrode 2 and the data electrode 5 and states of discharge in the seventh embodiment and in the first embodiment respectively.

The surface discharge between the scanning electrode 2 and the sustaining electrode 3 occurs at a time when the electric potential of the scanning electrode 2 has become 250 V in both the seventh and first embodiments. However, in the case of the first embodiment, the surface discharge continues until the electric potential of the scanning electrode 2 becomes 400 V, while the surface discharge stops at a time when the electric potential of the scanning electrode 2 reaches 360 V in the case of the seventh embodiment. Moreover, the facing discharge between the scanning electrode 2 and the data electrode 5 continues from a time when the electric potential of the scanning electrode 2 reaches 350 V to a time when it reaches its highest electric potential being 400 V in both the seventh and first embodiments. That is, an amount of the facing discharge is almost the same in both the sixth and first embodiment, however, only duration of the surface discharge is shortened. This reduces an amount of emitted light by the pre-discharge, thus enabling contrast to be improved.

In the seventh embodiment, as one example, the electric potential Vpcs of the second pre-discharging pulse Ppcs and the timing of application of the discharging pulse are set so that the surface discharge stops after occurrence of the facing discharge. After the surface discharge has been completed, activated particles such as the electrons or a like decreases exponentially. However, for about 20 $\mu$s, an amount of activated particles large enough to induce a stable surface discharge is still left. Therefore, even when the surface discharge stops before the facing discharge occurs, if the electric potential difference between the facing electrodes reaches the facing discharge initiating threshold voltage within about 20 $\mu$s after the end of the surface discharge, the stable facing discharge can be achieved. Therefore, the timing with which the surface discharge is stopped is not limited to the time after the facing discharge has occurred and the surface discharge can be also stopped before the facing discharge occurs or at the same time when the facing discharge occurs.

Eight Embodiment

Figure 14:
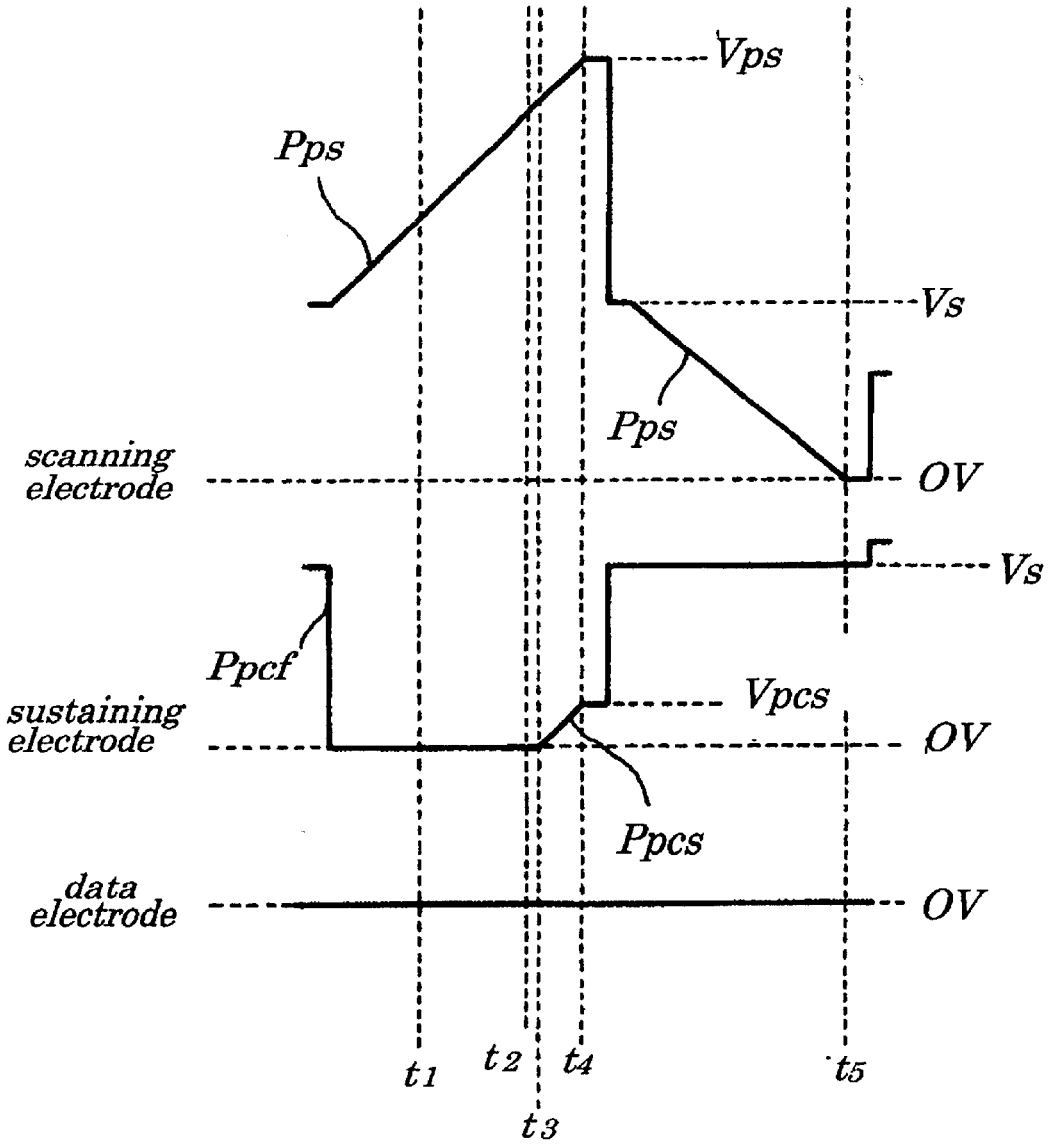
FIG. 14 is a timing chart showing a method for driving a PDP according to an eighth embodiment of the present invention.

FIG. 14 is a timing chart showing a method for driving a PDP according to an eighth embodiment of the present invention. Though only a pre-discharging period is shown in FIG. 14, as in the case of the first embodiment, a selective operation period, a discharge sustaining period, and a discharge sustaining terminating period are sequentially provided, following the pre-discharging period. In the eighth embodiment, as in the case of the first embodiment, a reference potential between surface electrodes is used as a sustaining voltage Vs to sustain a discharge during the discharge sustaining period. Therefore, a electric potential of the scanning electrode 2 and of the sustaining electrode 3 being higher than the sustaining potential Vs is defined as a electric potential of positive polarity and a electric potential of the scanning electrode 2 and of the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the eighth embodiment are the same as those in the first embodiment. The discharge initiating threshold voltage between the surface electrodes is set to be 250 V, while the discharge initiating threshold between the facing electrodes, that is, between the scanning electrode 2 and the data electrode 5 in a state where lots of activated particles exist in discharging space, is set to be 350 V.

In the eighth embodiment, during the pre-discharging period, a sawtooth-shaped pre-discharging pulse Pps having its ultimate potential being Vps of positive polarity is applied to the scanning electrode 2. On the other hand, a rectangular first pre-discharging pulse Ppcf having a electric potential being Vpcf and a rectangular second pre-discharging pulse Ppcs having a electric potential being Vpcs are successively applied to the sustaining electrode 3. At this point, slops of the pre-discharging pulse Pps and the second pre-discharging pulse Ppcs are set to be equal to each other. A electric potential of the data electrode 5 is set to be 0 V. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vps is set to be 400 V, the Vpcf to be 0 V and the Vpcs to be 40 V. Moreover, a pulse width of the first pre-discharging pulse Ppcf is adjusted so that the second pre-discharging pulse Ppcs is applied when the electric potential of the scanning electrode 2 becomes 360 V.

By setting as above, when the electric potential of the pre-discharging pulse Pps becomes 250 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps has become 350 V, the electric potential difference between the facing electrodes becomes 350 V. At this time, since lots of activated particles produced by the surface discharge exist in discharging space, a feeble facing discharge between the scanning electrode 2 and data electrode 5 occurs continuously and in a stable manner (at a time of $t_2$). Moreover, when the electric potential of the pre-discharging pulse Pps reaches 360 V, the second pre-discharging pulse Ppcs is applied to the sustaining electrode 3. At this time, since a slope of the second pre-discharging pulse Ppcs is almost the same as that of the pre-discharging pulse Pps, thereafter the difference in electric potentials between the scanning electrode 2 and sustaining electrode 3 does not change and becomes constant and therefore the surface discharge stops (at a time of $t_3$). On the other hand, the facing discharge that has once occurred continues in a stable manner even after the surface discharge is stopped by activated particles formed by the facing discharge itself. Then, the electric potential of the pre-discharging pulse Pps reaches the electric potential Vps and the discharge stops at a same time when a change in the electric potential difference is stopped (at a time of $t_4$).

To the scanning electrode 2 is applied a sawtooth-shaped pre-discharge erasing pulse Ppe of negative polarity, following the application of the pre-discharging pulse Pps. An ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_5$). Moreover, the operation of erasing the wall charges during the pre-discharging period includes an operation of adjusting wall charges to have a smooth operation be performed in the subsequent processes such as selective operations, discharge sustaining operations or a like.

Thereafter, as in the first embodiment, by selecting a discharging cell during the selective operation period, by obtaining light emitted for displaying induced by the discharge during the discharge sustaining period and by stopping the discharge during the discharge sustaining terminating period, same display operations as in the first embodiment can be performed.

In the eighth embodiment, by causing a facing discharge to occur during the pre-discharging period, formation of positive wall charges on the data electrode 5 is made possible. This enables lowering of the data voltage Vd and shortening of the selective operation period.

The method for driving the PDP of the eighth embodiment is the same as in the first embodiment except that the sawtooth-shaped second pre-discharging pulse Ppcs is applied to the sustaining electrode 3. Therefore, it is possible to decrease an amount of occurrence of the surface discharge without impeding stable facing discharges. As a result, contrast can be improved without impairing a driving characteristic.

Figure 15:
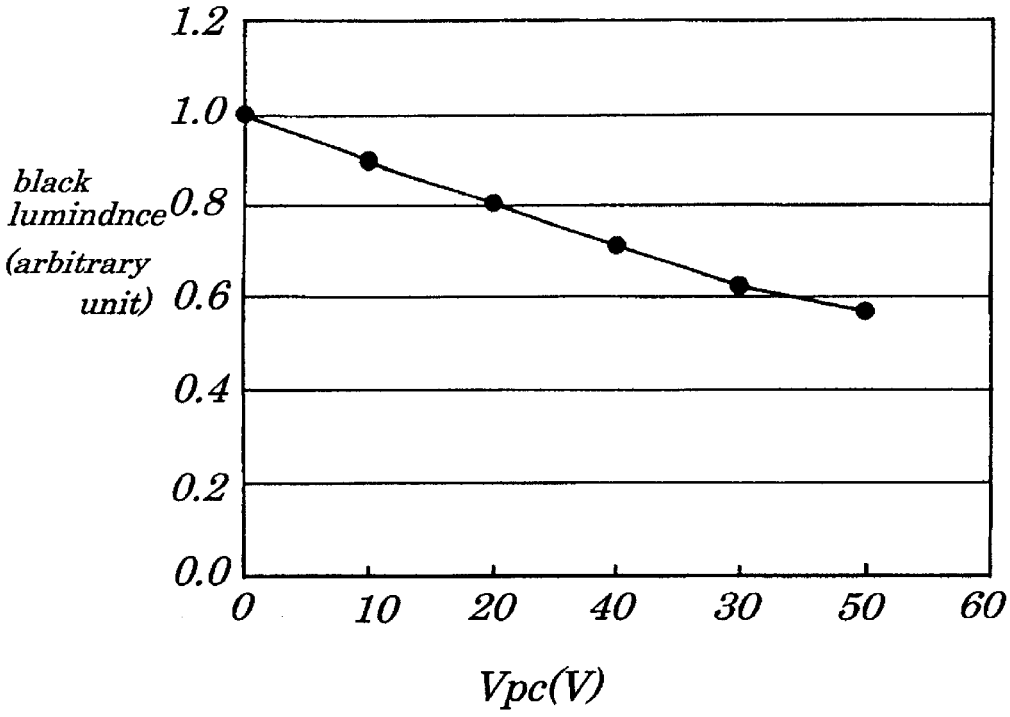
FIG. 15 is a graph showing a relation between a second pre-discharging pulse voltage and black luminance in the eighth embodiment of the present invention.

FIG. 15 is a graph showing a change in luminance in a black display occurring when the ultimate potential Vpcs of the second pre-discharging pulse Ppcs is changed. As shown in FIG. 15, as the ultimate potential Vpcs increases, the luminance in the black display decreases and, for example, when the ultimate potential Vpcs is set to be 50 V, the luminance is lowered by about 40%.

Figure 16:
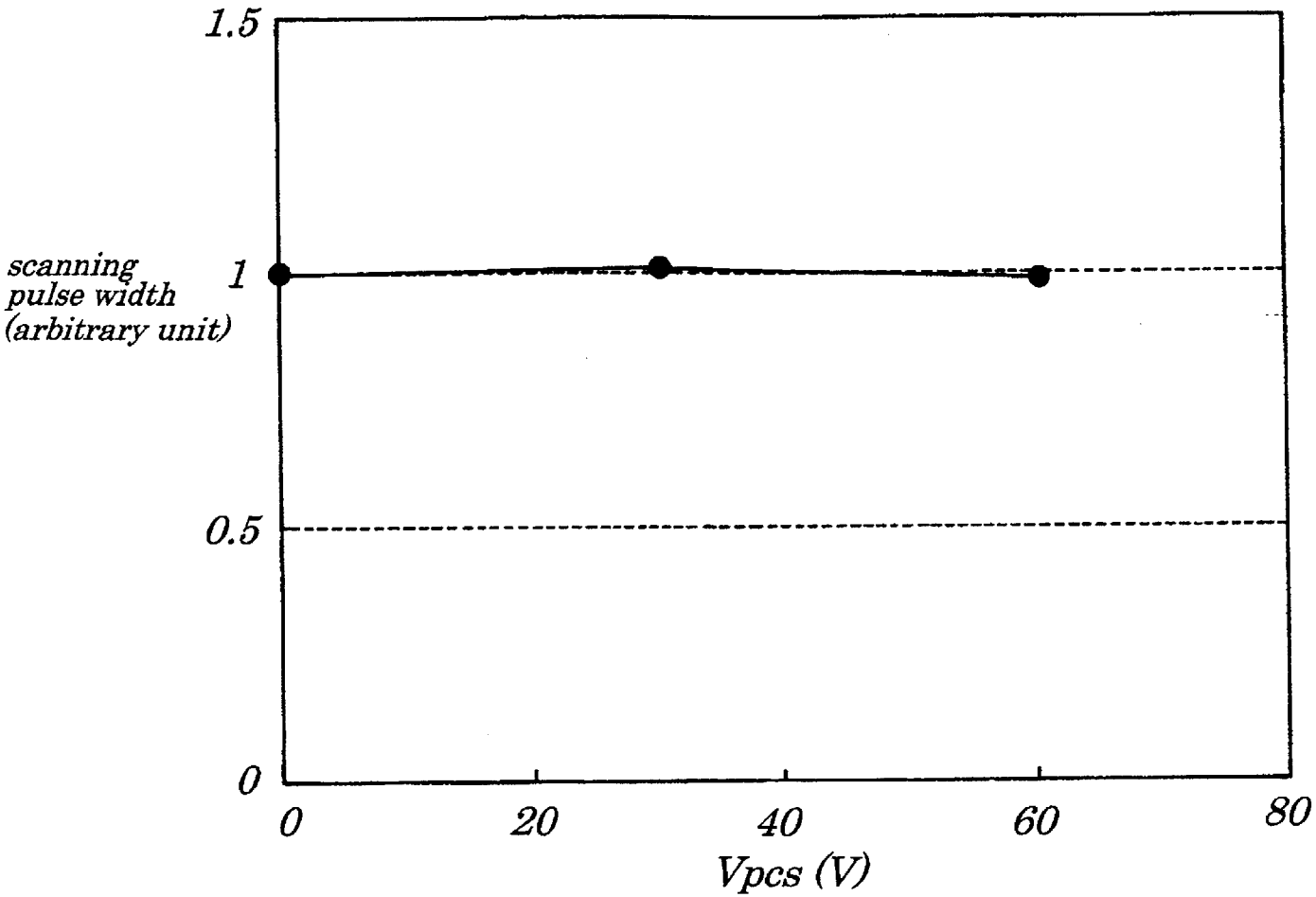
FIG. 16 is a graph showing a relation between the second pre-discharging pulse and a width of a scanning pulse in the eighth embodiment of the present invention.

FIG. 16 is a graph showing a relation between the ultimate potential Vpcs of the second pre-discharging pulse Ppcs and a pulse width of a scanning pulse Pw required to cause a writing discharge to occur at a probability of 99.9% in the selective operation period in the eighth embodiment. As is apparent from FIG. 16, even if the discharge between the surface electrodes by application of the second pre-discharging pulse Ppcs decreases, the pulse width of the scanning pulse Pw does not change. This indicates that contrast can be improved without impairing driving characteristics.

Moreover, in the eighth embodiment, slopes of the second pre-discharging pulse Ppcs and of the pre-discharging pulse Pps are set to be almost the same, however, even if the slope of the second pre-discharging pulse Ppcs is larger than that of the pre-discharging pulse Pps, there is no increase in the electric potential difference between surface electrodes and therefore the same effects obtained in the above embodiments can be achieved in the eighth embodiment as well.

Figure 17:
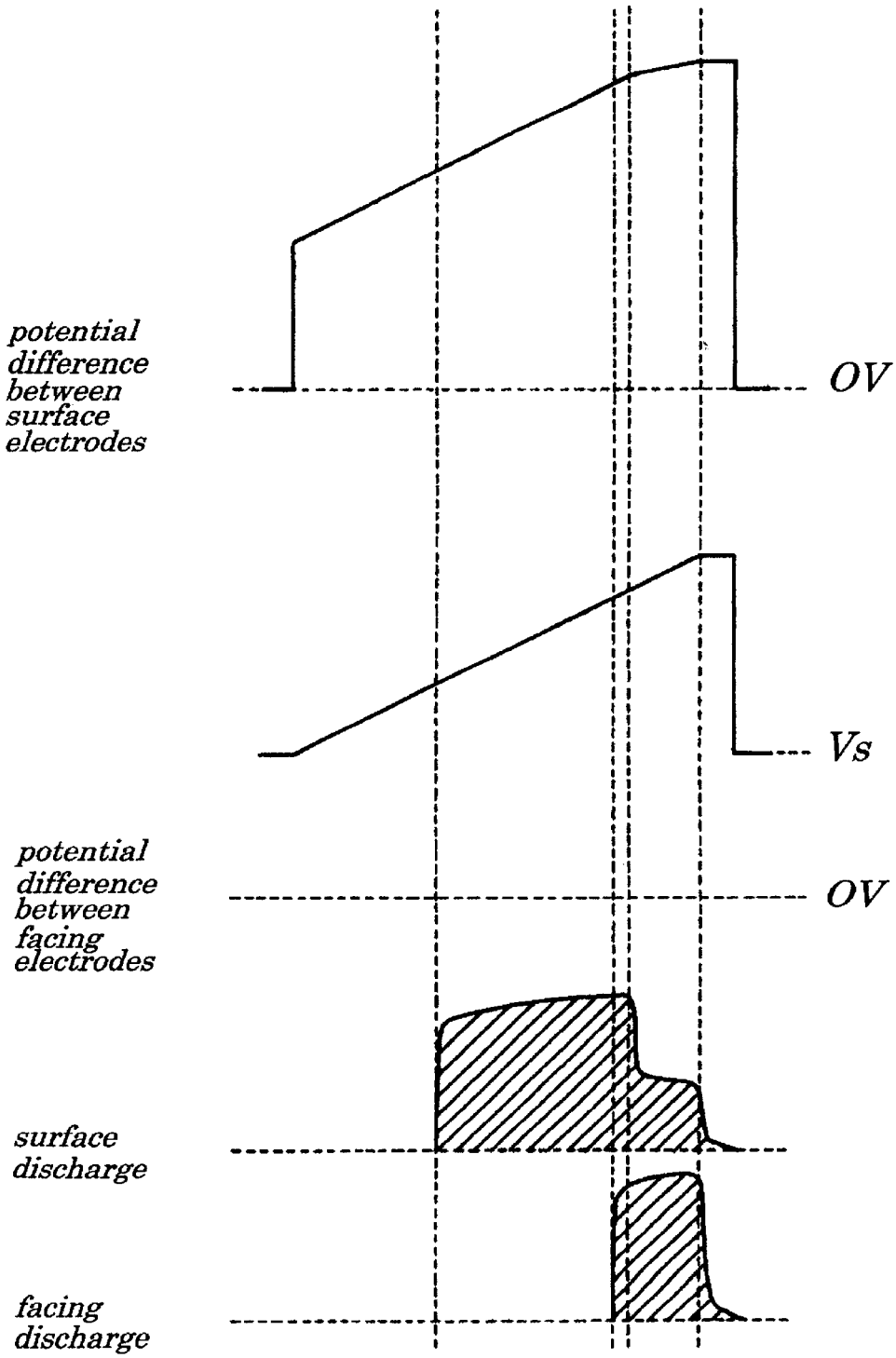
FIG. 17 is a timing chart schematically illustrating electric electric potential differences between electrodes and states of discharge in the eighth embodiment of the present invention.

FIG. 17 is a timing chart schematically illustrating electric potential differences between surface electrodes and between facing electrodes in a case where a slope of the second pre-discharging pulse Ppcs is smaller than that of the pre-discharging pulse Pps, for example, where the slope of the second pre-discharging pulse Ppcs is set to be one half that of the pre-discharging pulse Pps. As shown in FIG. 17, by application of the second pre-discharging pulse Ppcs, since an increase rate of the electric potential difference between the surface electrodes decreases thereafter, a surface discharge occurring after the application of the second pre-discharging pulse Ppcs becomes weak compared with a discharge between surface electrodes occurring before the application of the second pre-discharging pulse Ppcs. Therefore, the entire amount of the discharge can be made smaller compared with a case of no application of the second pre-discharging pulse Ppcs at all. As a result, it is possible to lower luminance in the black display and to improve contrast.

Figure 18A:
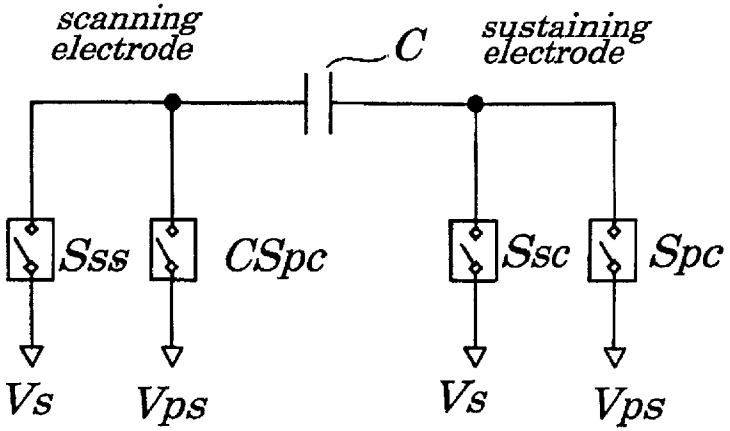
FIGS. 18A and 18B are circuit diagrams showing configurations of pre-discharging generating circuits, respectively, in the first and eighth embodiments and in the seventh embodiment.
Figure 18B:
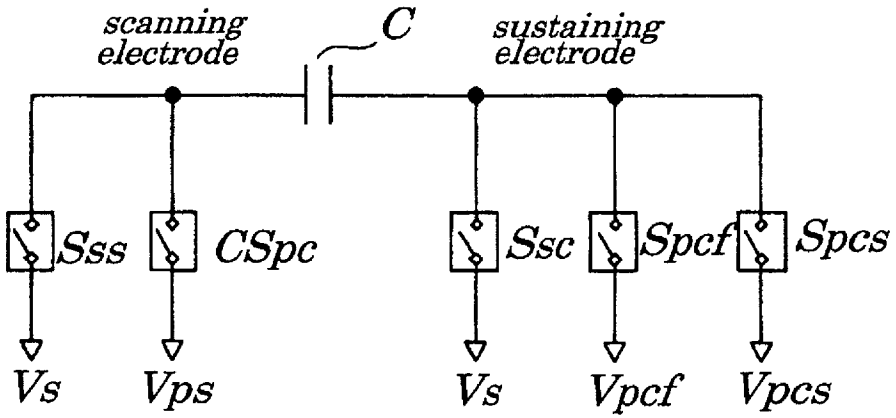

Results from operations in the seventh and eighth embodiments are the same, however, configurations of circuits to produce each driving waveform are different from each other. The circuit configurations and their operations in both the embodiments will be explained by referring to FIGS. 18A and 18B. FIGS. 18A and 18B are schematic circuit diagrams illustrating operations of the circuits to produce the pre-discharging pulses, respectively, in the first and eighth embodiments and in the seventh embodiment.

Generally, in a PDP, since a scanning electrode 2 is placed in juxtaposition with a sustaining electrode 3 with a dielectric layer 9 being interposed between the two electrodes 2 and 3, when a current flowing by a discharge is neglected, it can be considered that a capacitor using the scanning electrode 2 and sustaining electrode 3 as electrodes is electrically formed. Therefore, in FIG. 18, the PDP is represented as a panel capacitor component C. A data electrode 5 is not shown in FIG. 18.

First, operations of the circuit in the first embodiment are described by referring to FIG. 18A. In FIG. 18A, only switches Sss and Ssc are closed before application of the pre-discharging pulses Pps and Ppc, and the electric potentials of the scanning electrode 2 and the sustaining electrode 3 are at a electric potential Vs. Then, switches Sss and Ssc are opened and switches CSps and Spc are closed. This causes the electric potential of the sustaining electrode 3 to be immediately changed to be Vpc (being 0 V). On the other hand, a switch CSps is a switch that is controlled so as to feed a sawtooth-shaped pulse and therefore a sawtooth-shaped pre-discharging pulse Pps is applied to the scanning electrode 2. After the electric potential of the scanning electrode 2 has reached the electric potential Vps, the switches CSps and Spc are opened and the switches Sss and Ssc are closed. This causes both the electric potentials of the scanning electrode 2 and sustaining electrode 3 to be the electric potential Vs once. Then, operations moves to a process of terminating the pre-discharge.

Next, operations of the circuit in the seventh embodiment are described by referring to FIG. 18B. In FIG. 18B, as in the first embodiment, in an initial state, the switches Sss and Ssc are closed and both the electric potentials of the scanning electrode 2 and sustaining electrode 3 are a electric potential Vs. Next, the switches Sss and Ssc are opened and the switches CSps and Spcf are closed. This causes the electric potential of the sustaining electrode 3 to be immediately changed to be Vpc (being 0 V). On the other hand, a switch CSps is a switch that is controlled so as to feed a sawtooth-shaped pulse and therefore a sawtooth-shaped pre-discharging pulse Pps is applied to the scanning electrode 2. Then, while the pre-discharging pulse is being applied, the switch Spcf is opened and the switch Spcs is closed. This causes the electric potential of the sustaining electrode 3 to be changed to be the electric potential Vpcs. After the electric potential of the scanning electrode 2 has reached the electric potential Vps, the switches CSps and Spcs are opened and the switches Sss and Ssc are closed. This causes both the electric potentials of the scanning electrode 2 and sustaining electrode 3 to be the electric potential Vs once. Then, operations moves to the process of terminating the pre-discharge.

Thus, in order to obtain driving waveforms required in operations in the seventh embodiment, a power source and the switch Spc required to acquire the electric potential Vpcs have to be additionally mounted on circuits used in the first embodiment.

Next, operations of circuits in the eighth embodiment will be explained by referring to FIG. 18A. Same circuits as used in the first embodiment can be employed in the eighth embodiment. In FIG. 18A, as in the first embodiment, in an initial state, the switches Sss and Ssc are closed and both the scanning electrode 2 and sustaining electrode 3 are at a electric potential Vs. Then, the switches Sss and Ssc are opened and the switches CSps and Spc are closed. This causes the electric potential of the sustaining electrode 3 to be immediately changed to be Vpc (being 0 V). On the other hand, a switch CSps is a switch that is controlled so as to feed a sawtooth-shaped pulse and therefore a sawtooth-shaped pre-discharging pulse Pps is applied to the scanning electrode 2. Next, while the pre-discharging pulse is being applied, the switch Spc is opened.

This causes all the switches connected to the sustaining electrode 3 to be opened and the sustaining electrode 3 is at a floating electric potential. On the other hand, the sawtooth-shaped pre-discharging pulse Pps is continuously fed to the scanning electrode 2, which causes its electric potential to gradually rise. As a result, since the scanning electrode 2 and the sustaining electrode 3 are capacitively coupled to each other through a capacitor component of the panel, the electric potential of the sustaining electrode 3 being a floating electric potential rises as the electric potential of the scanning electrode 2 rises. This causes the sawtooth-shaped second pre-discharging pulse Ppcs to be apparently applied to the sustaining electrode 3. Then, after the electric potential of the scanning electrode 2 has reached the electric potential Vps, the switch CSps is opened and the switches Sss and Ssc are closed. This causes both the scanning electrode 2 and sustaining electrode 3 to be at the electric potential Vs once. Then, operations moves to a process of terminating the pre-discharge.

Thus, the method of the eighth embodiment makes it possible to lower the luminance in the black display, without mounting any additional circuit on those used in the first embodiment and therefore it is more advantageous from a viewpoint of costs than that employed in the seventh embodiment.

Moreover, in the eighth embodiment, the electric potential Vpcs of the second pre-discharging pulse Ppcs and its application timing are set, as one of operational examples, so that the surface discharge stops after occurrence of the facing discharge, however, as in the seventh embodiment, even if the surface discharge stops before the occurrence of the facing discharge, a stable facing discharge can be induced in the eighth embodiment.

Ninth Embodiment

Figure 19:
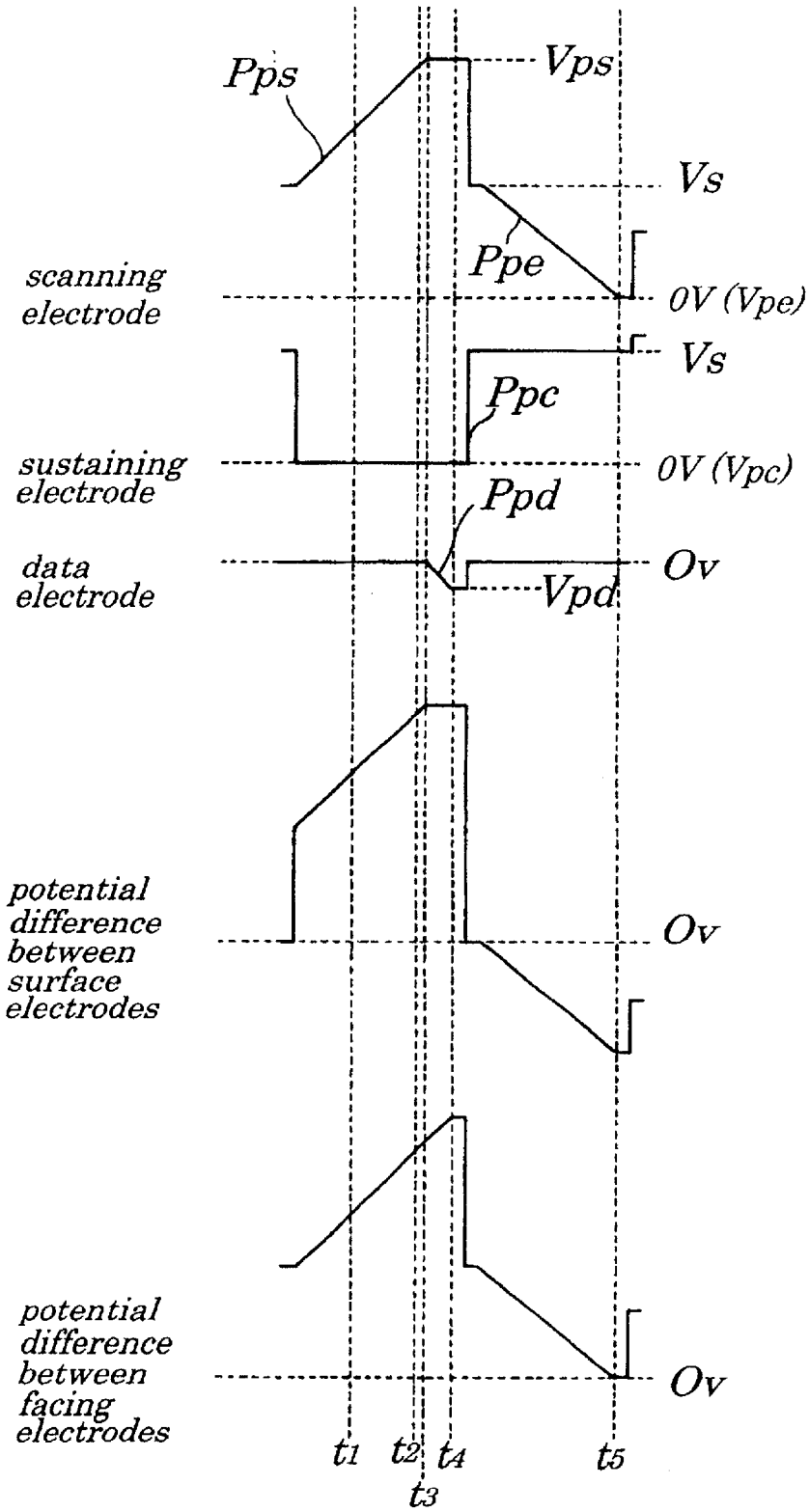
FIG. 19 is a timing chart showing a method for driving a PDP according to a ninth embodiment of the present invention.

FIG. 19 is a timing chart showing a method for driving a PDP according to a ninth embodiment of the present invention. Though only a pre-discharging period is shown in FIG. 19, as in the case of the first embodiment, a selective operation period, a discharge sustaining period, and a discharge sustaining terminating period are sequentially provided, following the pre-discharging period. In the ninth embodiment, as in the case of the first embodiment, a reference potential between surface electrodes is used as a sustaining voltage Vs to sustain a discharge during the discharge sustaining period. Therefore, a electric potential of the scanning electrode 2 and of the sustaining electrode 3 being higher than the sustaining potential Vs is defined as a electric potential of positive polarity and a electric potential of the scanning electrode 2 and of the sustaining electrode 3 being lower than the sustaining potential Vs as a electric potential of negative polarity. The sustaining voltage Vs is set to be, for example, about 170 V. A reference potential of the data electrode 5 is 0 (zero) V.

Configurations of the PDP to be driven by the method of the ninth embodiment are the same as those in the first embodiment. The discharge initiating threshold voltage between the surface electrodes is set to be 250 V, while the discharge initiating threshold between the facing electrodes, that is, between the scanning electrode 2 and the data electrode 5 in a state where lots of activated particles exist in discharging space, is set to be 350 V.

In the eighth embodiment, during the pre-discharging period, a sawtooth-shaped pre-discharging pulse Pps having its ultimate potential being Vps of positive polarity is applied to the scanning electrode 2. On the other hand, a rectangular pre-discharging pulse Ppc having a electric potential being Vpc is fed to the sustaining electrode 3. Moreover, a sawtooth-shaped pre-discharging pulse Ppd having its ultimate potential being Vpd of negative polarity is fed to the data electrode 5 after the pre-discharging pulses Pps and Ppc have been applied. A difference in ultimate potentials between surface electrodes, that is, between the scanning electrode 2 receiving the pre-discharging pulse Pps and sustaining electrodes 3 receiving the pre-discharging pulse Ppc, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, for example, the Vps is set to be 360 V, the Vpc to be 0 V and the Vpd to be −40 V. Moreover, a pulse width of the pre-discharging pulse Ppd is adjusted so as to be applied when the electric potential of the scanning electrode 2 becomes 360 V.

By setting as above, when the electric potential of the pre-discharging pulse Pps becomes 250 V, a electric potential difference between the scanning electrode 2 and sustaining electrode 3 becomes 250 V and a feeble discharge occurs continuously between the surface electrodes (at a time of $t_1$). Then, when the electric potential of the pre-discharging pulse Pps has become 350 V, the electric potential difference between the facing electrodes becomes 350 V. At this time, since lots of activated particles produced by the surface discharge exist in discharging space, a feeble facing discharge between the scanning electrode 2 and data electrode 5 occurs continuously and in a stable manner (at a time of $t_2$). Moreover, when the electric potential of the pre-discharging pulse Pps reaches 360 V, since the electric potential of the scanning electrode 2 is held thereafter, the electric potential difference between the scanning electrode 2 and sustaining electrode 3 become constant and therefore the surface discharge stops (at a time of $t_3$). On the other hand, from a time when the electric potential of the scanning electrode 2 becomes 360 V, since the pre-discharging pulse Ppd of negative polarity is fed to the data electrode 5, the electric potential difference between the facing electrodes continues to increase and therefore the facing discharge continues to occur. Then, when the electric potential of the data electrode 5 becomes −40 V and the electric potential difference between the facing electrodes becomes 400 V, the discharge stops (at a time of $t_4$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_5$). Moreover, the operation of erasing the wall charges during the pre-discharging period includes an operation of adjusting wall charges to have a smooth operation be performed in the subsequent processes such as selective operations, discharge sustaining operations or a like.

Thereafter, as in the first embodiment, by selecting a discharging cell during the selective operation period, by obtaining light emitted for displaying induced by the discharge during the discharge sustaining period and by stopping the discharge during the discharge sustaining terminating period, same display operations as in the first embodiment can be performed.

In the ninth embodiment, by causing a facing discharge to occur during the pre-discharging period, formation of positive wall charges on the data electrode 5 is made possible. This enables lowering of the data voltage Vd and shortening of the selective operation period.

In the method of driving the PDP of the ninth embodiment, changes in the electric potential difference between the surface electrodes, that is, between the scanning electrode 2 and the sustaining electrode 3 and in the electric potential difference between the facing electrodes, that is, between the scanning electrode 2 and the data electrode 5 are the same as those in the eighth embodiment and, as a result, the luminance in the black display can be lowered. Moreover, according to the ninth embodiment, the Vps being the highest electric potential out of electric potentials to be applied to each of the electrodes can be set to be lower, compared with the case of the seventh and eighth embodiments and, therefore, use of parts having a low withstand voltage and being comparatively cheap is made possible, thus costs of the PDP can be reduced as a whole.

Tenth Embodiment

Figure 20:
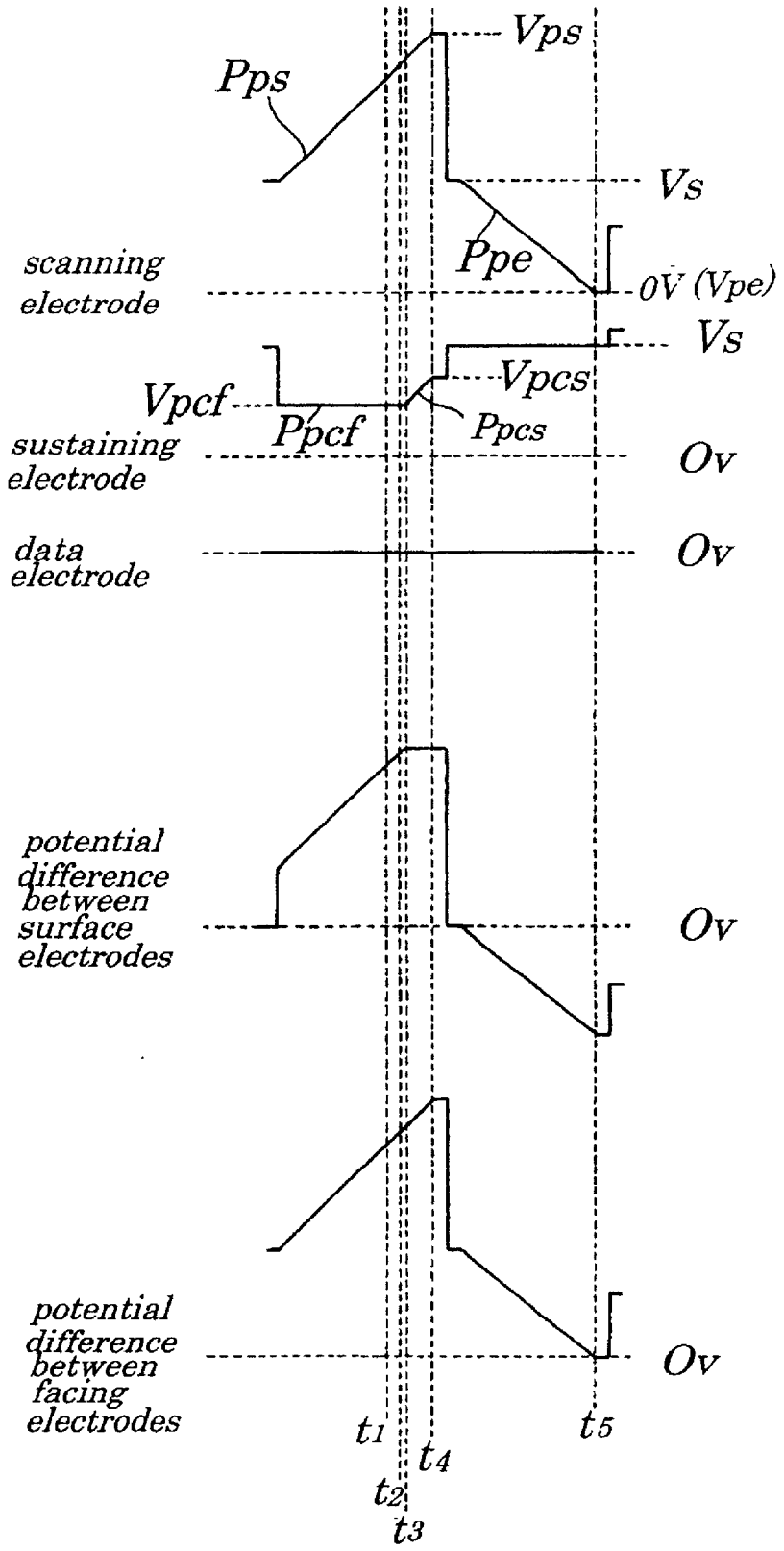
FIG. 20 is a timing chart showing a method for driving a PDP according to a tenth embodiment of the present invention.

FIG. 20 is a timing chart showing a method for driving a PDP according to a tenth embodiment of the present invention. Though only a pre-discharging period is shown in FIG. 20, as in the case of the first embodiment, a selective operation period, a discharge sustaining period, and a discharge sustaining terminating period are sequentially provided, following the pre-discharging period. In the tenth embodiment, as in the case of the first embodiment, a reference potential between surface electrodes is used as a sustaining voltage Vs to sustain a discharge during the discharge sustaining period. Therefore, a electric potential of the scanning electrode 2 and of the sustaining electrode 3 being higher than the sustaining potential Vs is defined as a electric potential of positive polarity and a electric potential of the scanning electrode 2 and the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the tenth embodiment are the same as those in the first embodiment. The discharge initiating threshold voltage between the surface electrodes is set to be 250 V, while the discharge initiating threshold between the facing electrodes, that is, between the scanning electrode 2 and the data electrode 5 in a state where lots of activated particles exist in discharging space, is set to be 350 V.

In the tenth embodiment, during the pre-discharging period, a sawtooth-shaped pre-discharging pulse Pps having its ultimate potential being Vps of positive polarity is applied to the scanning electrode 2. On the other hand, a rectangular first pre-discharging pulse Ppcf having a electric potential being Vpcf and a sawtooth-shaped second pre-discharging pulse Ppcs are successively fed to the sustaining electrode 3. Slopes of the pre-discharging pulse Pps and of the second pre-discharging pulse Ppcs are set to be almost the same. The electric potential of the data electrode 5 is set to be 0 V. A difference in ultimate potentials between surface electrodes, that is, between the scanning electrode 2 receiving the pre-discharging pulse Pps and sustaining electrodes 3 receiving the second pre-discharging pulse, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vps is set to be 400 V, the Vpcf to be 80 V and the Vpcs to be 120 V. Moreover, a pulse width of the first pre-discharging pulse Ppcf is adjusted so that the second pre-discharging pulse Ppcs is applied when the electric potential of the scanning electrode 2 becomes 360 V.

By setting as above, when the electric potential of the pre-discharging pulse Pps becomes 330 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps reaches 350 V, the electric potential difference between the facing electrodes becomes 350 V. At this time, since lots of activated particles produced by the surface discharge exist in discharging space, a feeble facing discharge between the scanning electrode 2 and data electrode 5 occurs continuously and in a stable manner (at a time of $t_2$). Moreover, when the electric potential of the pre-discharging pulse Pps reaches 360 V, the second pre-discharging pulse Ppcs is fed to the sustaining electrode 3. At this point, since the slope of the second pre-discharging pulse Ppcs is almost the same as that of the pre-discharging pulse Pps, the electric potential difference between the surface electrodes does not change and becomes constant and therefore the surface discharge stops (at a time of $t_3$). On the other hand, the surface discharge that has once occurred continues in a stable manner even after the surface discharge is stopped by activated particles formed by the surface discharge itself. Then, the electric potential of the pre-discharging pulse Pps reaches the electric potential Vps and the discharge stops at the same time when a change in the electric potential difference is stopped (at a time of $t_4$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_5$). Moreover, the operation of erasing the wall charges during the pre-discharging period A includes an operation of adjusting wall charges to have a smooth operation be performed in the subsequent processes such as selective operations, discharge sustaining operations or a like.

Thereafter, as in the first embodiment, by selecting a discharging cell 12 during the selective operation period B, by obtaining light emitted for displaying induced by the discharge during the discharge sustaining period C and by stopping the discharge during the discharge sustaining terminating period B, same display operations as in the first embodiment can be performed.

In the tenth embodiment, by causing a facing discharge to occur during the pre-discharging period A, formation of positive wall charges on the data electrode 5 is made possible. This enables lowering of the data voltage Vd and shortening of the selective operation period B.

The method for driving the PDP of the tenth embodiment is the same as in the eighth embodiment except that the electric potential Vpcf of the first pre-discharging pulse Ppcf is set to be 80 V. However, though, in the eighth embodiment, the discharge between the surface electrodes occurs during a period in which the electric potential of the scanning electrode 2 having received the pre-discharging pulse Pps changes from 250 V to 360 V, in the tenth embodiment, the discharge between the surface electrodes occurs only during a period in which the electric potential of the scanning electrode 2 having received the pre-discharging pulse Pps changes from 330 V to 360 V. As a result, it is possible to more lower the luminance in the black display.

Moreover, in the tenth embodiment, as in the eighth embodiment, no addition of new circuits to apply the second pre-discharging pulse Ppcs is required. Furthermore, it is not necessary that the slope of the second pre-discharging pulse Ppcs occurring when the voltage is increasing is equal to that of the pre-discharging pulse Pps. Even when the slope of the second pre-discharging pulse Ppcs is smaller than that of the pre-discharging pulse Pps, the effect to lower the black luminance can be obtained as well.

Eleventh Embodiment

Figure 21:
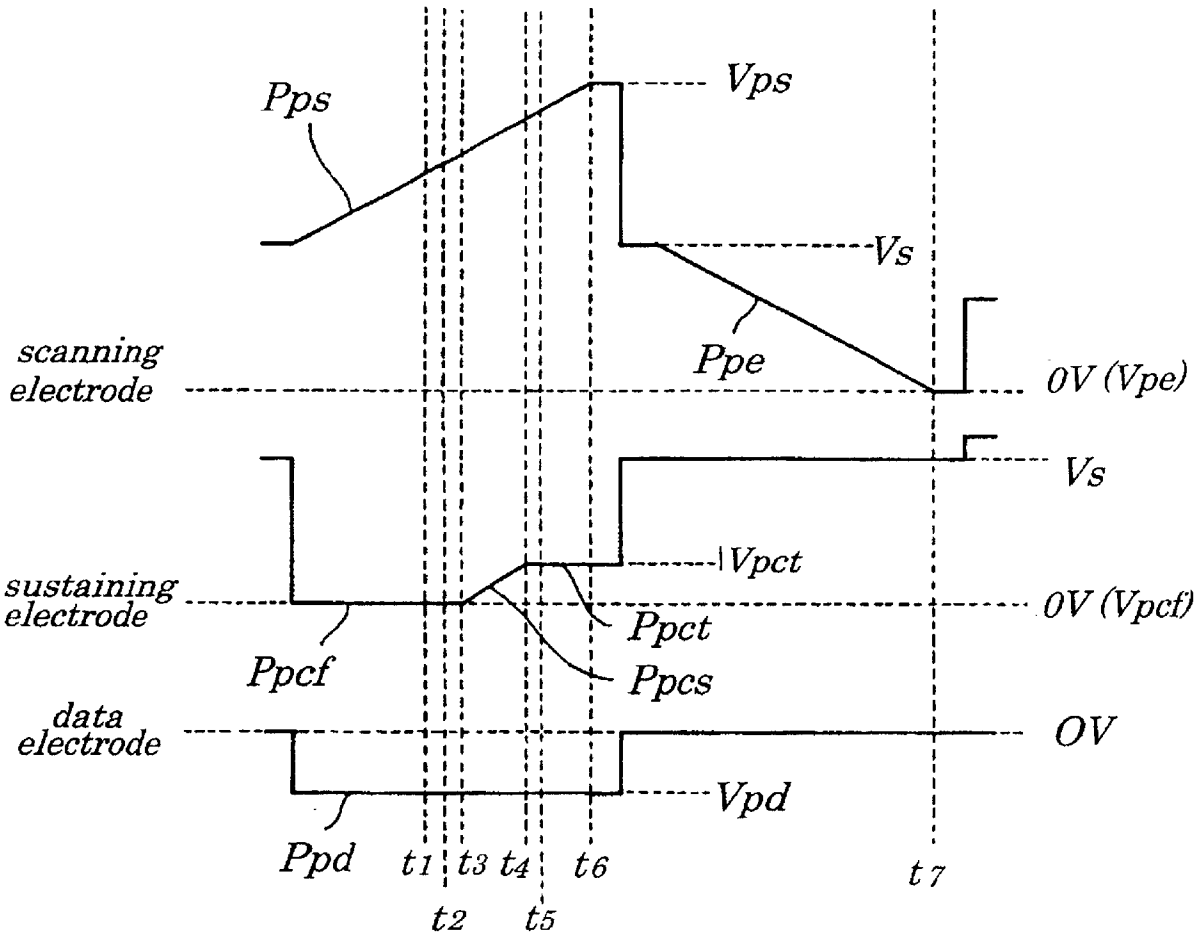
FIG. 21 is a timing chart showing a method for driving a PDP according to an eleventh embodiment of the present invention.
Figure 22:
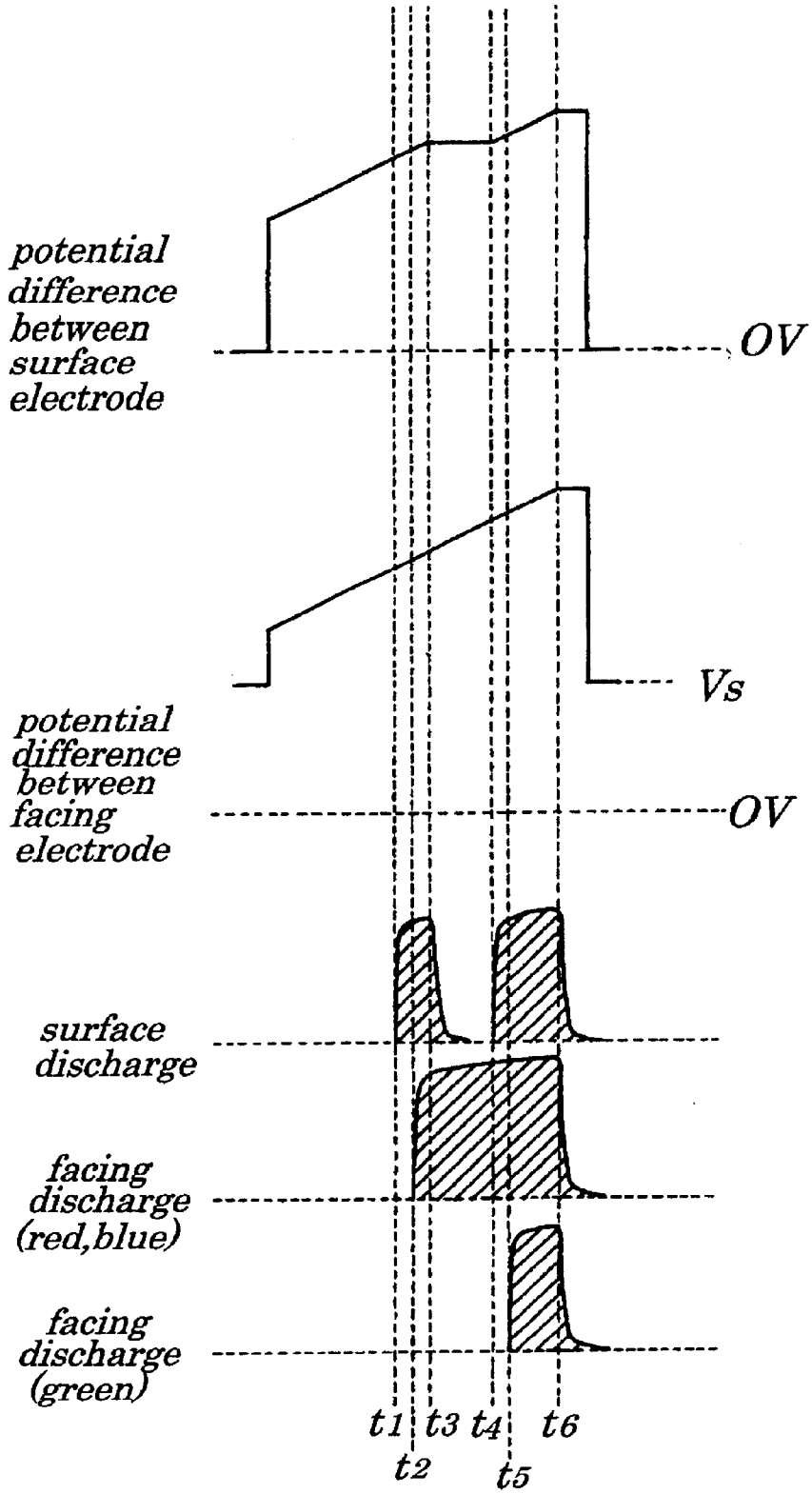
FIG. 22 is a timing chart schematically illustrating electric electric potential differences between electrodes and states of discharge in the eleventh embodiment of the present invention.
Figure 23:
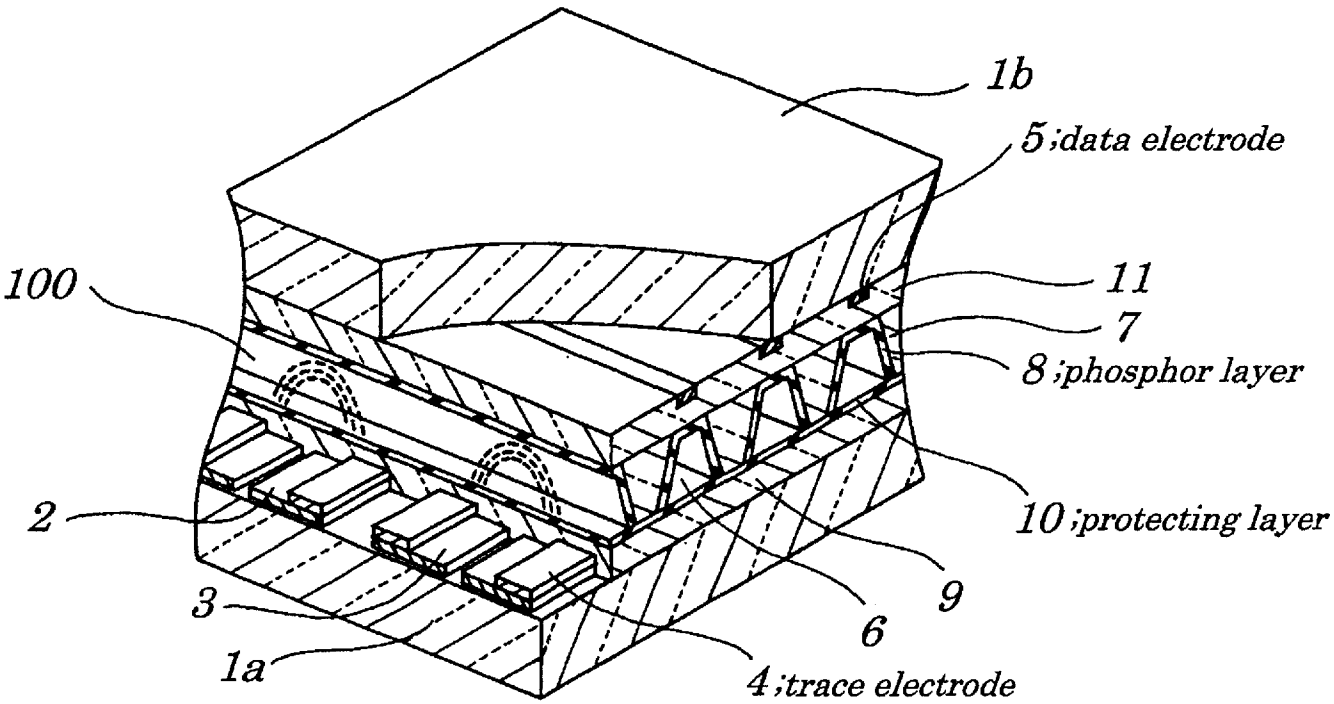
FIG.23(PRIOR ART)
FIG. 23 is a cross-sectional view showing main portions of a conventional PDP.
Figure 24:
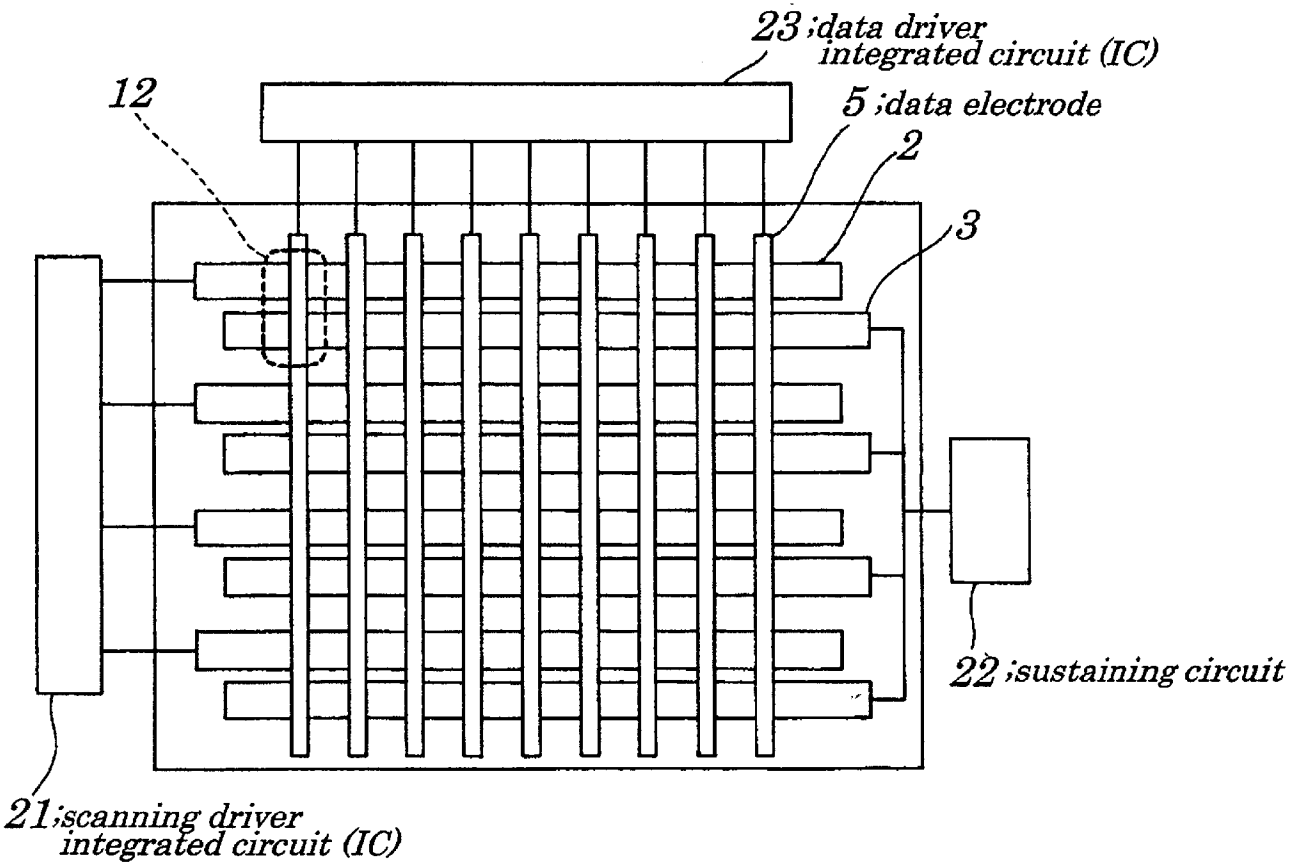
FIG.24 (PRIOR ART)
FIG. 24 is a schematic diagram illustrating an arrangement of electrodes in the conventional PDP.
Figure 25:
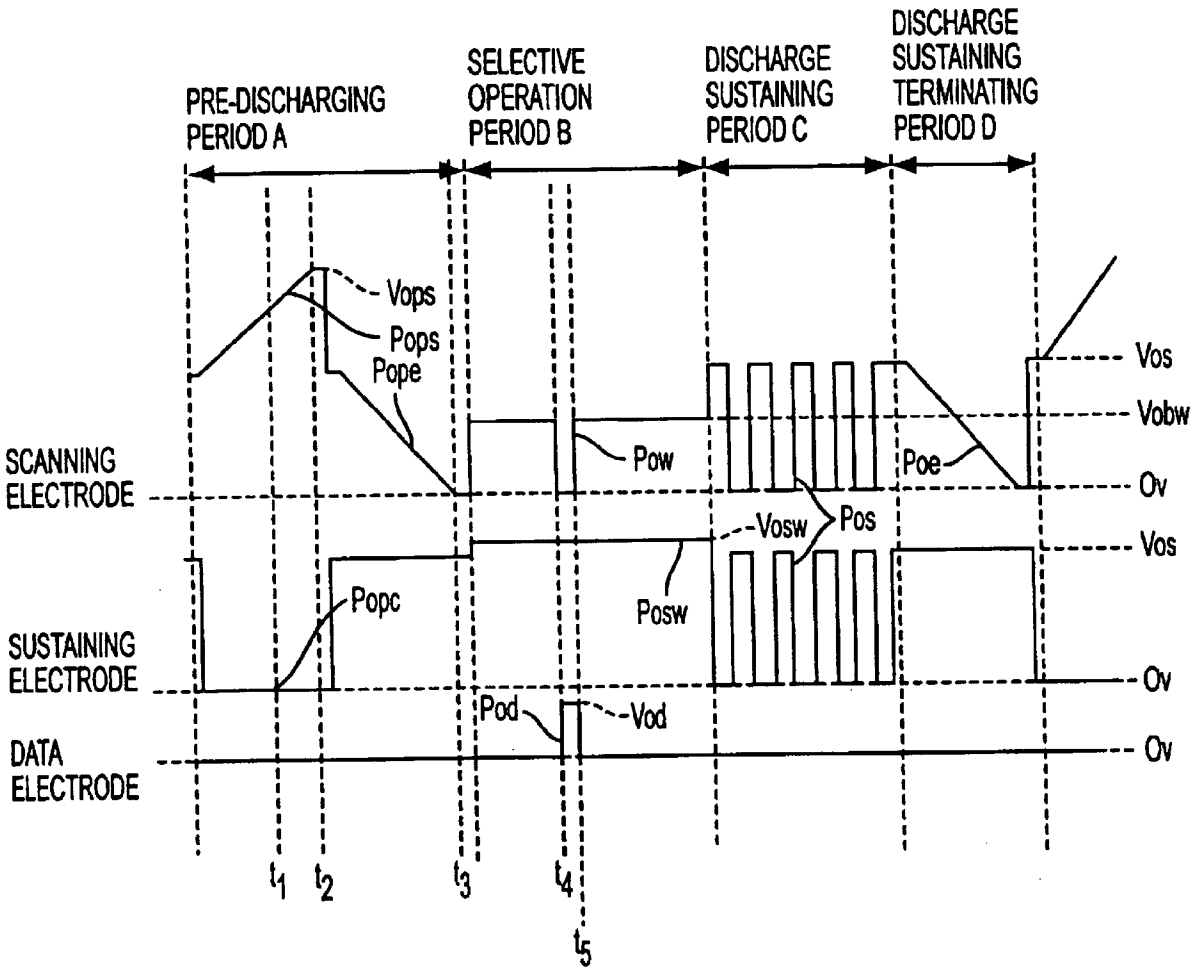
FIG. 25 PRIOR ART
FIG. 25 is a timing chart explaining a conventional method for driving the conventional PDP.
Figures 26A, 26B, 26C, 26D, 26E:
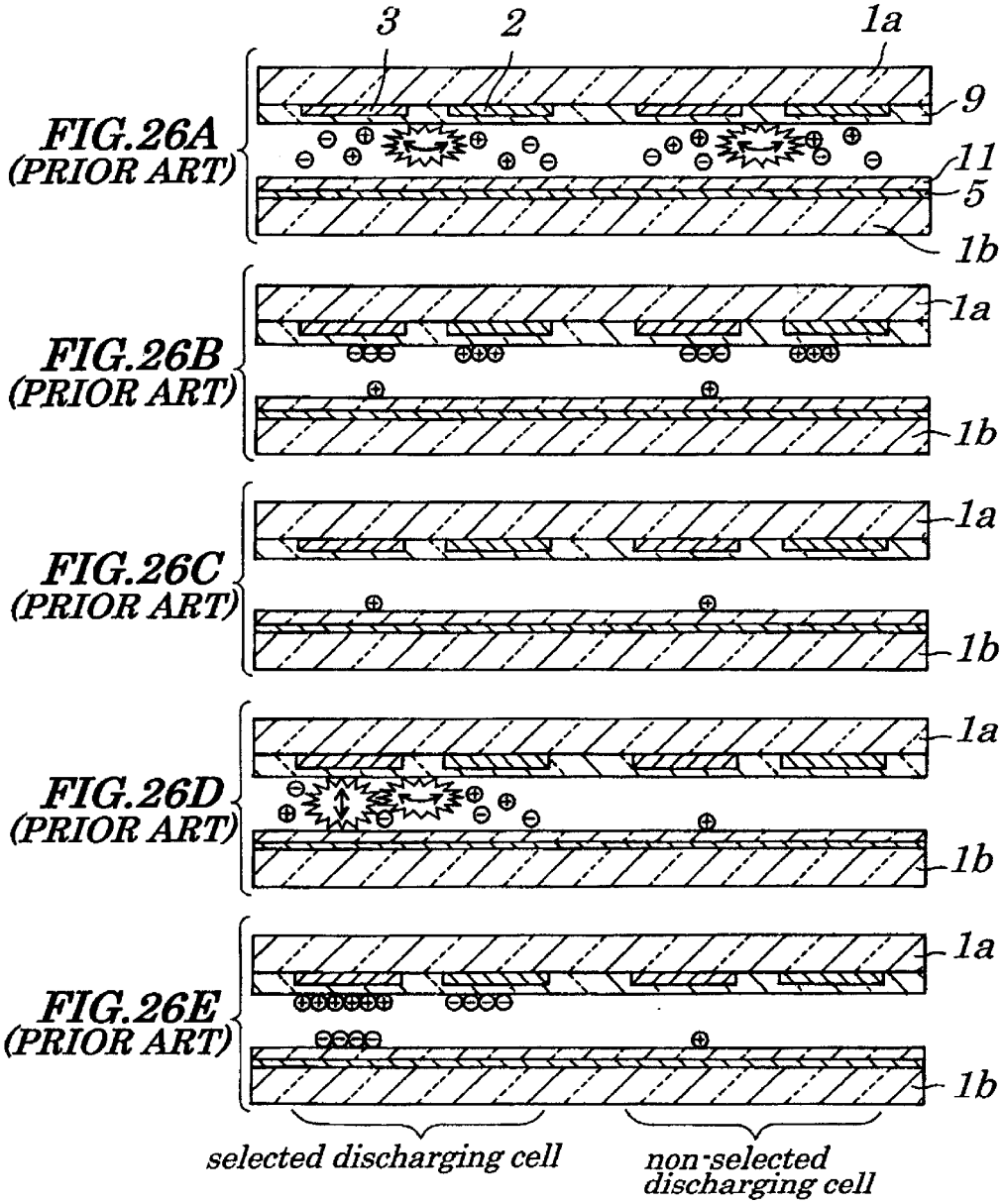
FIG.26A (PRIOR ART)
FIG.26B (PRIOR ART)
FIG.26C (PRIOR ART)
FIG.26D (PRIOR ART)
FIG.26E (PRIOR ART)
FIGS. 26A, 26B, 26C, 26D, and 26E are schematic diagrams illustrating a wall charge and a state of a discharge in a discharging cell in the conventional driving method of the conventional PDP.

FIG. 21 is a timing chart showing a method for driving a PDP according to an eleventh embodiment of the present invention. Though only a pre-discharging period A is shown in FIG. 21, as in the case of the first embodiment, a selective operation period B, a discharge sustaining period C, and a discharge sustaining terminating period are sequentially provided, following the pre-discharging period A. FIG. 22 is a schematic timing chart illustrating electric potential differences between a scanning electrode 2 and a sustaining electrode 3, and between the scanning electrode 2 and a data electrode 5, and states of discharges in the eleventh embodiment. In the eleventh embodiment, as in the case of the first embodiment, a reference potential between surface electrodes is used as a sustaining voltage Vs to sustain a discharge during the discharge sustaining period C. Therefore, a electric potential of the scanning electrode 2 and of the sustaining electrode 3 being higher than the sustaining potential Vs is defined as a electric potential of positive polarity and a electric potential of the scanning electrode 2 and the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the eleventh embodiment are the same as those of the PDP to be driven by the fourth embodiment, in which, to perform a color display, a plurality of phosphors, that is, three types of phosphors including red, green and blue color phosphors, are provided. Therefore, discharge initiating threshold voltage between the surface electrodes is 250 V in all discharging cells 12, however, the discharge initiating threshold voltage between the facing electrodes in a state where lots of activated particles exist in a discharging space is 330 V in the discharging cell 12 for the red and blue colors and 390 V in the discharging cell 12 for the green color.

In the eleventh embodiment, during the pre-discharging period A, a sawtooth-shaped pre-discharging pulse Pps having its ultimate potential being Vps of positive polarity is applied to the scanning electrode 2. On the other hand, a rectangular first pre-discharging pulse Ppcf having a electric potential being Vpcf, sawtooth-shaped second pre-discharging pulse Ppcs, rectangular third pre-discharging pulse Ppct having its electric potential being Vpct are successively applied to the sustaining electrode 3. At this point, slopes of the pre-discharging pulse Pps and the second pre-discharging pulse Ppcs are almost the same. A rectangular pre-discharging pulse Ppd having its electric potential being Vpd is fed to the data electrode 5. A difference in ultimate potentials between surface electrodes, that is, between the scanning electrode 2 receiving the pre-discharging pulse Pps and sustaining electrodes 3 receiving the pre-discharging pulse, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, for example, the Vps is set to be 350 V, the Vpcf to be 0 V, the Vpct to be 40 V and the Vpd to be −70 V. Moreover, a pulse width of the first pre-discharging pulse Ppcf is adjusted so that the second pre-discharging pulse Ppcs is applied when the electric potential of the scanning electrode 2 by the application of the pre-discharging pulse Pps becomes 270 V. A pulse width of the second pre-discharging pulse Ppcs is adjusted so that the third pre-discharging pulse Ppct is applied when the electric potential of the scanning electrode 2 by the application of the pre-discharging pulse Pps becomes 310 V.

By setting as above, when the electric potential of the pre-discharging pulse Pps becomes 250 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps reaches 260 V, the electric potential difference between the facing electrodes, that is, between the scanning electrode 2 and the data electrode 5, becomes 330 V. At this time, since lots of activated particles produced by the surface discharge exist in discharging space, a feeble facing discharge between the scanning electrode 2 and data electrode 5 in the discharging cells for the red and blue color occurs continuously and in a stable manner (at a time of $t_2$). Moreover, when the electric potential of the pre-discharging pulse Pps reaches 270 V, the second pre-discharging pulse Ppcs is fed to the sustaining electrode 3. At this point, since the slope of the second pre-discharging pulse Ppcs is almost equal to that of the pre-discharging pulse Pps, the electric potential difference between the surface electrodes between the scanning electrode 2 and the sustaining electrode 3 does not change and becomes constant thereafter and therefore the surface discharge stops (at a time of $t_3$). On the other hand, the facing discharge that has once occurred in the discharging cell for the red and blue colors continues in a stable manner, even after the surface discharge has stopped, by activated particles produced by the surface discharge itself. Then, when the electric potential of the pre-discharging pulse Pps reaches 310 V, the third pre-discharging pulse Ppct is fed to the sustaining electrode 3 and, as a result, the electric potential difference between the surface electrodes, that is, between the scanning electrode 2 and sustaining electrode 3 increases, which causes a feeble discharge to occur continuously (at a time of $t_4$). Then, when the electric potential of the pre-discharging pulse Pps becomes 320 V, a electric potential difference between the facing electrodes becomes 390 V. At this time, since lots of activated particles formed by the surface discharge exist in discharging space, a feeble facing discharge between the scanning electrode 2 and data electrode 5 also in the discharging cell for the green color occurs continuously and in a stable manner (at a time of $t_5$). Finally, when the electric potential of the pre-discharging pulse Pps reaches 350 V, all the discharges stop (at a time of $t_6$).

To the scanning electrode 2 is applied a sawtooth-shaped pre-discharge erasing pulse Ppe of negative polarity, following application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased (at a time of $t_7$). Moreover, the operation of erasing the wall charges during the pre-discharging period A includes an operation of adjusting wall charges to have a smooth operation be performed in the subsequent processes such as selective operations, discharge sustaining operations or a like.

Thereafter, as in the first embodiment, by selecting a discharging cell 12 during the selective operation period B, by obtaining light emitted for displaying induced by the discharge during the discharge sustaining period C and by stopping the discharge during the discharge sustaining terminating period D, same display operations as in the first embodiment can be performed.

In the eleventh embodiment, by causing a facing discharge to occur during the pre-discharging period A, formation of positive wall charges on the data electrode 5 is made possible. This enables lowering of the data voltage Vd and shortening of the selective operation period B.

According to the eleventh embodiment, since the surface discharge stops while the second pre-discharging pulse Ppcs is being applied, entire amounts of the discharge decrease when compared with a case where neither the second pre-discharging pulse Ppcs nor the third pre-discharging pulse Ppct is applied, which enables the luminance in a black display to be lowered. Moreover, since activated particles produced by the surface discharge are supplied in advance in each of the discharging cells 12 each having a different facing discharge initiating voltage, it is possible to cause a feeble facing discharge to occur in a stable manner in all charging cells. In the eleventh embodiment, same pre-discharging pulses Ppd are fed to all the data electrodes 5, the driving method of the eleventh embodiment can be applied not only to the panel having configurations in the fourth embodiment but also to a panel in which a plurality of types of phosphors is applied on one data electrode 5.

Twelfth Embodiment

Figure 27:
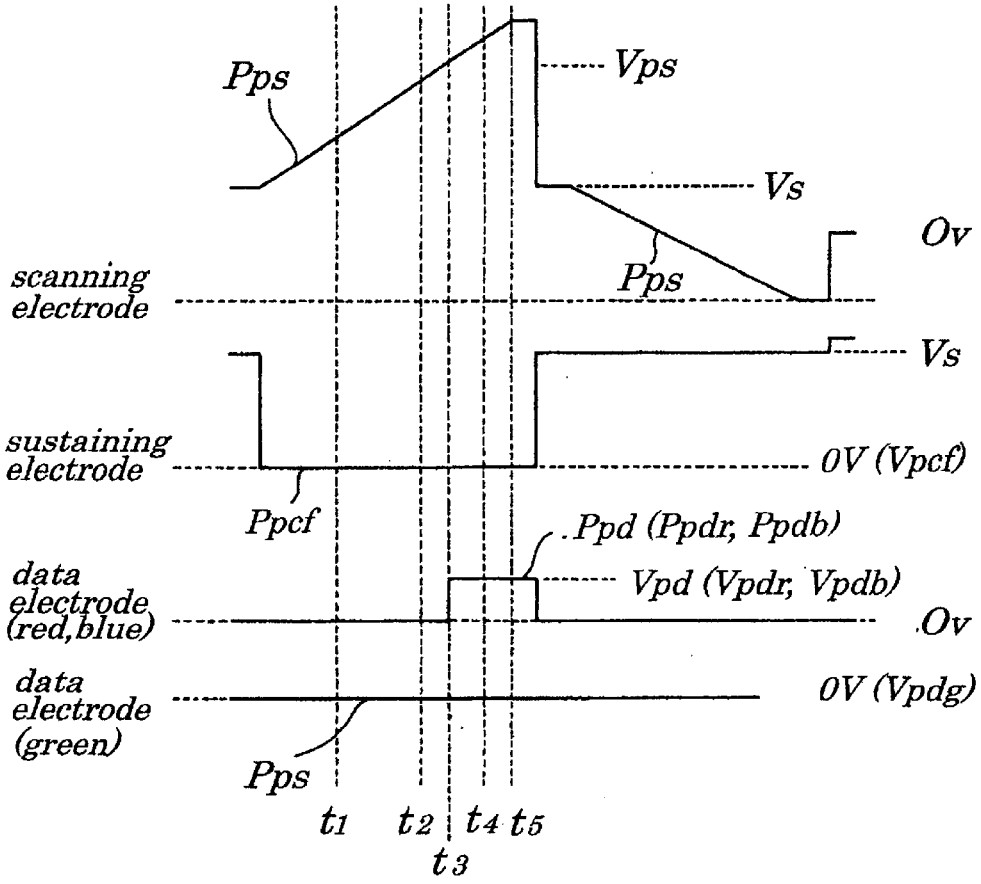
FIG. 27 is a timing chart showing a method for driving a PDP according to a twelfth embodiment of the present invention.
Figure 28:
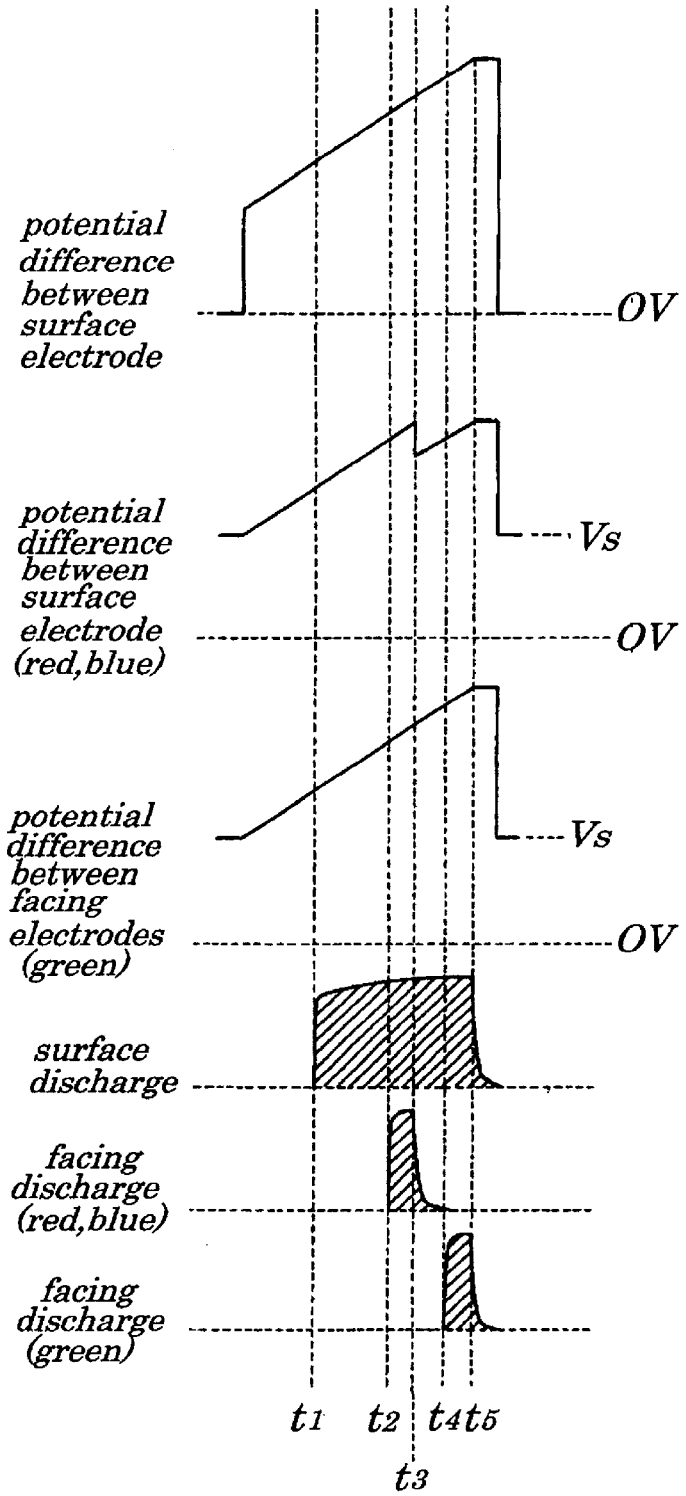
FIG. 28 is a timing chart schematically illustrating electric electric potential differences between electrodes and states of discharge in the twelfth embodiment of the present invention.

FIG. 27 is a timing chart showing a method for driving a PDP according to a twelfth embodiment of the present invention. Though only a pre-discharging period A is shown in FIG. 27, as in the case of the first embodiment, a selective operation period B, a discharge sustaining period C, and a discharge sustaining terminating period D are sequentially provided, following the pre-discharging period A. FIG. 28 is a schematic timing chart illustrating electric potential differences between a scanning electrode 2 and a sustaining electrode 3, and between the scanning electrode 2 and a data electrode 5, and states of the discharge in the twelfth embodiment. In the twelfth embodiment, a reference potential between surface electrodes is used as a sustaining voltage Vs to sustain a discharge during the discharge sustaining period C. Therefore, a electric potential of the scanning electrode 2 and the sustaining electrode 3 being higher than the sustaining potential Vs is defined as a electric potential of positive polarity and a electric potential of the scanning electrode 2 and the sustaining electrode 3 being lower than the sustaining potential Vs is defined as a electric potential of negative polarity. The sustaining voltage Vs is set to be, for example, about 170 V. A reference potential of the data electrode 5 is 0 (zero) V.

Configurations of the PDP to be driven by the method of the twelfth embodiment are the same as those of the PDP to be driven by the fourth embodiment, in which, to perform a color display, a plurality of phosphors, that is, three types of phosphors including the red, green and blue color phosphors, are provided. Therefore, the discharge initiating threshold voltage between the surface electrodes is 250 V in all discharging cells, however, the discharge initiating threshold voltage between the facing electrodes in a state where lots of activated particles exist in the discharging space is 330 V in the discharging cell for the red and blue colors and 390 V in the discharging cell for the green color.

In the twelfth embodiment, during the pre-discharging period, a sawtooth-shaped pre-discharging pulse Pps having its ultimate potential being Vps of positive polarity is applied to the scanning electrode 2. On the other hand, a rectangular pre-discharging pulse Ppcf having its electric potential being Vpcf is applied to the sustaining electrode 3. Moreover, a rectangular pre-discharging pulse Ppd having its electric potential being Vpd is applied to the data electrode 5. A difference in ultimate potentials between surface electrodes, that is, between the scanning electrode 2 receiving the pre-discharging pulse Pps and sustaining electrodes 3 receiving the pre-discharging pulse Ppcf, is set so as to exceed a discharge initiating threshold voltage between the surface electrodes, while a difference in ultimate potentials between the facing electrodes is set so as to exceed a discharge initiating threshold voltage between the facing electrodes, that is, between the scanning electrode 2 and data electrode 5 in a state where lots of activated particles such as ions or electrons exist in discharging space. Moreover, the difference in the ultimate potentials both between the surface electrodes and between the facing electrodes is so set that the discharge between the surface electrodes occurs prior to the occurrence of the discharge between the facing electrodes. Therefore, the Vps is set to be 420 V and the Vpc to be 0 V. Each of electric potentials Vpdr and Vpdb of the pre-discharging pulse Ppdr and Ppdb to be applied to the data electrode 5 corresponding to the discharging cell 12 in which the phosphor layer 8 for the red and blue colors are formed is 60 V. A electric potential Vpdg of a pre-discharging pulse Ppdg to be applied to the data electrode 5 corresponding to the discharging cell 12 in which the phosphor layer 8 for the green color is formed is set to be 0 V, that is, to be in a state where no pulse is applied. Furthermore, an adjustment is made so that the pre-discharging pulses Ppdr and Ppdb are applied when the electric potential of the scanning electrode 2 becomes 360 V by the application of the pre-discharging pulse Pps.

By setting as above, when the electric potential of the pre-discharging pulse Pps becomes 250 V, a electric potential difference between the scanning electrode 2 and sustaining electrode 3 becomes 250 V and, as a result, a feeble discharge occurs continuously between the surface electrodes (at a time of $t_1$). Then, when the electric potential of the pre-discharging pulse Pps reaches 330 V, the electric potential difference between the facing electrodes becomes 330 V. At this time, since lots of activated particles produced by the surface discharge exist in discharging space, a feeble facing discharge between the scanning electrode 2 and data electrode 5 occurs in the discharging cell 12 for the red and blue colors continuously and in a stable manner (at a time of $t_2$). Moreover, when the electric potential of the pre-discharging pulse Pps reaches 360 V, the pre-discharging pulses Ppdr and Ppdb are fed to the data electrode 5. By application of the pre-discharging pulses Ppdr and Ppdb, a electric potential difference between the facing electrodes in the discharging cell 12 for the red and blue colors decreases and thereafter the facing discharge in the discharging cell 12 stops (at a time of $t_3$). Then, when the electric potential of the pre-discharging pulse Pps reaches 390 V, the electric potential difference between the facing electrodes in the discharging cell 12 for the green color, becomes 390 V. At this time, since lots of activated particles formed by the surface discharge exist in discharging space, a feeble facing discharge between the scanning electrode 2 and data electrode 5 in the discharging cell for the green color occurs continuously and in a stable manner (at a time of $t_4$). Finally, when the electric potential of the pre-discharging pulse Pps reaches 420 V, all the surface discharges and the facing discharge in the discharging cell 12 for the green color stop (at a time of $t_5$).

To the scanning electrode 2 is applied a sawtooth-shaped pre-discharge erasing pulse Ppe of negative polarity, following the application of the pre-discharging pulse Pps. The ultimate potential Vpe of the pre-discharge erasing pulse Ppe is set to be, for example, 0 V. At this time, a electric potential of the sustaining electrode 3 is fixed at the sustaining voltage Vs. Also, a electric potential of the data electrode 5 is fixed at 0 V. By the application of the pre-discharge erasing pulse Ppe, a discharge of a polarity being opposite to that of the above pre-discharge occurs between the surface electrodes and wall charges formed on the scanning electrode 2 and on the sustaining electrode 3 are erased. Moreover, the operation of erasing the wall charges during the pre-discharging period A includes an operation of adjusting wall charges to have a smooth operation be performed in the subsequent processes such as selective operations, discharge sustaining operations or a like.

Thereafter, as in the first embodiment, by selecting a discharging cell 12 during the selective operation period B, by obtaining light emitted for displaying induced by the discharge during the discharge sustaining period C and by stopping the discharge during the discharge sustaining terminating period D, same display operations as in the first embodiment can be performed.

In the twelfth embodiment, by causing a facing discharge to occur during the pre-discharging period A, formation of positive wall charges on the data electrode 5 is made possible. This enables lowering of the data voltage Vd and shortening of the selective operation period.

According to the twelfth embodiment, since the facing discharge in the discharging cells 12 for the red and blue colors stops by the application of the pre-discharging pulses Ppdr and Ppdb, the entire amounts of the discharge decreases when compared with a case where no pre-discharging pulse Ppd is applied, which enables the luminance in a black display to be lowered. Moreover, during a period in which the electric potential of the pre-discharging pulse Pps is within a range of 330 V to 360 V in the discharging cell 12 for the red and blue colors and during a period in which the electric potential of the pre-discharging pulse Pps is within a range of 390 V to 420 V in the discharging cell 12 for the green color, the facing discharge occurs and therefore it is possible to control the amounts of the discharge in all the discharging cells 12 so as to be at a same level. This enables almost the same amounts of wall charges to be produced in the discharging cells 12 each having a different facing discharge initiating voltage and stability of the selective discharge in the selective operation period to be increased. Moreover, the method of the embodiment has another advantage in that, since all amounts of the discharges in the discharging cell 12 for each color are same, no coloring attributable to a difference in the amount of the discharge occurs in the black screen.

It is apparent that the present invention is not limited to the above embodiments but may be changed and modified without departing from the scope and spirit of the invention. For example, in the above embodiments, a writing selection-type driving method in which a wall charge is formed by the discharge during the selective operation period in the discharging cell 12 for displaying is employed. However, the present invention may be applied to a method in which the wall charge is formed during the pre-discharging period A and the wall charge is erased during the selective operation period B by causing a discharge in a discharging cell 12 not used for displaying to occur, that is, to a so-called erasing selection-type driving method. In the erasing selection-type driving method, in order to cause a stable and reliable discharge to occur during the selective operation period B, stable formation of wall charges during the pre-discharging period is important and by applying the present invention, it is possible to improve a driving characteristic and contrast of the PDP and to decrease data voltages for displaying.

What is claimed is:

1. A method for driving a plasma display panel for causing said plasma display panel, in which a plurality of first electrodes extending in a first direction and a plurality of second electrodes extending in said first direction are placed in such a manner that each of said first electrodes is adjacent to each of said second electrodes and a plurality of third electrodes extending in a second direction orthogonal to said first direction is placed and in which a discharging cell is placed at each point of intersection of each of said first and second electrodes and each of said third electrodes, to perform a display in response to video signals, said method comprising:

a process of causing a discharge to occur between said first electrodes and second electrodes being adjacent to each other in an initializing period; and a process of causing a discharge of one polarity to occur between said first electrodes and said third electrodes intersecting each other in said initializing period after said discharge between said first electrode and said second electrode starts in said initializing period.

2. The method for driving the plasma display panel according to claim 1, further comprising a process of decreasing intensity of said discharge between said first electrode and second electrode before said discharge of one polarity stops.

3. The method for driving the plasma display panel according to claim 2, wherein said process of decreasing intensity of said discharge between said first electrode and second electrode is performed after said discharge of one polarity occurred.

4. The method for driving the plasma display panel according to claim 2, wherein said process of decreasing intensity of said discharge between said first electrode and second electrode is performed at a same time when said discharge of one polarity occurs.

5. The method for driving the plasma display panel according to claim 2, wherein said process of decreasing intensity of said discharge between said first electrode and second electrode is performed before said discharge of one polarity occurs.

6. The method for driving the plasma display panel according to claim 5, wherein said process of causing said discharge of one polarity to occur is started while a space charge is left in a discharging cell.

7. The method for driving the plasma display panel according to claim 1, further comprising a process of applying sequentially scanning pulses to said first electrode and of causing a selective discharge of opposite polarity between said first and third electrodes by applying a data pulse to said third electrode in response to said video signals.

8. A method for driving a plasma display panel for causing said plasma display panel, in which a plurality of first electrodes extending in a first direction and a plurality of second electrodes extending in said first direction are placed in such a manner that each of said first electrodes is adjacent to each of said second electrodes and a plurality of third electrodes extending in a second direction orthogonal to said first direction is placed and in which a discharging cell is placed at each point of intersection of each of said first and second electrodes and each of said third electrodes, to perform a display in response to video signals, said method comprising:

a process of causing a discharge to occur between said first electrodes and second electrodes being adjacent to each other in an initializing period;

a process of causing a discharge of one polarity to occur between said first electrodes and said third electrodes intersecting each other after said discharge between said first electrode and said second electrode starts in said initializing period; and a process of applying sequentially scanning pulses to said first electrode and of causing a selective discharge of opposite polarity between said first and third electrodes by applying a data pulse to said third electrode in response to said video signals;

wherein, at a time of causing said selective discharge to occur, wall charges of one polarity are formed on said first electrode and wall charges of opposite polarity are formed on said third electrode and wherein a direction of an electric field being produced by said wall charges in discharging space matches a direction of an electric field occurring in said discharging space by application of said scanning pulse and said data pulse.

9. The method for driving the plasma display panel according to any one of claim 1 to claim 8, wherein said process of causing said discharge between said first and second electrodes to occur includes a process of adjusting timing with which said discharge between said first and second electrodes occurs by calibrating a electric potential of said second electrode.

10. A method for driving a plasma display panel for causing said plasma display panel, in which a plurality of first electrodes extending in a first direction and a plurality of second electrodes extending in said first direction are placed in such a manner that each of said first electrodes is adjacent to each of said second electrodes and a plurality of third electrodes extending in a second direction orthogonal to said first direction is placed and in which a discharging cell is placed at each point of intersection of each of said first and second electrodes and each of said third electrodes, to perform a display in response to video signals, said method comprising:

a process of causing a discharge to occur between said first electrodes and second electrodes being adjacent to each other in an initializing period; and a process of causing a discharge of one polarity to occur between said first electrodes and said third electrodes intersecting each other after said discharge between said first electrode and said second electrode starts in said initializing period;

wherein said process of causing said discharge of one polarity to occur includes a process of adjusting timing with which said discharge of one polarity occurs by calibrating a electric potential of said third electrode.

11. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode; and a process of causing a discharge of one polarity to occur between said first electrode and said third electrode in said initializing period after said discharge between said first electrode and said second electrode starts in said initializing period.

12. The method for driving the plasma display panel according to claim 11, further comprising a process of sequentially applying a scanning pulse to said first electrode during said selective operation period and of causing said selective discharge of opposite polarity to occur between said first and third electrodes by applying a data pulse to said third electrode in response to said video signals.

13. The method for driving the plasma display panel according to claim 11, wherein said discharge of one polarity occurring during said initializing period is a discharge using said first electrode as an anode and said third electrode as a cathode.

14. The method for driving the plasma display panel according to claim 11, further comprising a process of decreasing intensity of said discharge between said first electrode and second electrode before said discharge of one polarity stops, during said initializing period.

15. The method for driving the plasma display panel according to claim 14, wherein said process of decreasing intensity of said discharge between said first electrode and second electrode is performed after said discharge of one polarity occurred, during said initializing period.

16. The method for driving the plasma display panel according to claim 14, wherein said process of decreasing intensity of said discharge between said first electrode and second electrode during said initializing period is performed at a same time when said discharge of one polarity occurs.

17. The method for driving the plasma display panel according to claim 14, wherein said process of decreasing intensity of said discharge between said first electrode and second electrode is performed before said discharge of one polarity occurs.

18. The method for driving the plasma display panel according to claim 17, wherein said process of causing said discharge of one polarity to occur is started while a space charge is left in said discharging cell, during said initializing period.

19. The method for driving the plasma display panel according to claim 14, wherein said process of decreasing intensity of said discharge between said first electrode and second electrode includes a process of decreasing a electric potential difference between said first and second electrodes.

20. The method for driving the plasma display panel according to claim 19, wherein said process of decreasing said electric potential difference between said first and second electrodes includes a process of causing a electric potential of said second electrode to come near to a electric potential of said first electrode.

21. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode;

a process of causing a discharge of one polarity to occur between said first electrode and said third electrode after said discharge between said first electrode and said second electrode starts in said initializing period; and a process of sequentially applying a scanning pulse to said first electrode during said selective operation period and of causing said selective discharge of opposite polarity to occur between said first and third electrodes by applying a data pulse to said third electrode in response to said video signals wherein, at a time of causing said selective discharge to occur, wall charges of one polarity are formed on said first electrode and wall charges of opposite polarity are formed on said third electrode and wherein a direction of an electric field being produced by said wall charges in discharging space matches a direction of an electric field occurring in said discharging space by application of said scanning pulse and said data pulse.

22. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode;

a process of causing a discharge of one polarity to occur between said first electrode and said third electrode after said discharge between said first electrode and said second electrode starts in said initializing period; and a process of decreasing intensity of said discharge between said first electrode and second electrode before said discharge of one polarity stops, during said initializing period;

wherein said process of decreasing a electric potential difference between said first and second electrodes includes a process of fixing a difference in electric potentials between said first and second electrodes.

23. The method for driving the plasma display panel according to claim 22, wherein said process of fixing a difference in electric potentials between said first and second electrodes includes a process of matching a change in a electric potential of said second electrode to a change in a electric potential of said first electrode.

24. The method for driving the plasma display panel according to claim 23, wherein a process of matching a change in a electric potential of said second electrode to a change of a electric potential of said first electrode includes a process of causing said second electrode to be a floating electric potential and causing a electric potential of said second electrode to match a electric potential of said first electrode by capacitive coupling.

25. The method for driving the plasma display panel according to claim 22, wherein said process of fixing a difference in electric potentials between said first and second electrodes includes a process of changing a electric potential of said third electrode while electric potentials of said first and second electrodes are being fixed.

26. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode;

a process of causing a discharge of one polarity to occur between said first electrode and said third electrode after said discharge between said first electrode and said second electrode starts in said initializing period; and a process of decreasing intensity of said discharge between said first electrode and second electrode before said discharge of one polarity stops, during said initializing period;

wherein said process of decreasing intensity of said discharge between said first electrode and second electrode includes a process of decreasing an increasing rate of a electric potential difference between said first and second electrodes.

27. The method for driving the plasma display panel according to claim 26, wherein said process of decreasing an increasing rate of a electric potential difference between said first and second electrodes includes a process of causing a changing rate of a electric potential of said second electrode to come near to a changing rate of a electric potential of said first electrode.

28. The method for driving the plasma display panel according to claim 27, wherein said process of causing a changing rate of a electric potential of said second electrode to come near to a changing rate of a electric potential of said first electrode includes a process of causing said second electrode to be a floating electric potential and causing a electric potential of said second electrode to match a electric potential of said first electrode by capacitive coupling.

29. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode; and a process of causing a discharge of one polarity to occur between said first electrode and said third electrode after said discharge between said first electrode and said second electrode starts in said initializing period wherein said process of causing a discharge between said first and second electrodes to occur during said initializing period includes a process of adjusting timing with which a discharge occurs between said first and second electrodes by calibrating a electric potential of said second electrode.

30. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur, during said initializing period, between said first and second electrodes by applying a pulse whose electric potential changes with time to said first electrode; and a process of causing a discharge of one polarity to occur between said first electrode and said third electrode after said discharge between said first electrode and said second electrode starts in said initializing period wherein said process of causing a discharge of one polarity to occur during said initializing period includes a process of adjusting timing with which a discharge of one polarity occurs by calibrating a electric potential of said third electrode.

31. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, and a plurality of third electrodes each being placed on a surface facing said first substrate and extending in a column direction orthogonal to a direction in which said first and second electrodes extend on said second substrate and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and one discharge sustaining period during which a discharge for displaying is achieved, and of dividing said plurality of third electrodes into a plurality of electrode groups and holding each of said electrode groups at an individual electric potential, during said initializing period; and a process of causing a discharge between said first and third electrodes to occur.

32. The method for driving the plasma display panel according to claim 31, wherein a plurality of phosphor layers is formed on said third electrode in a manner that said phosphor layer of a same type is assigned to said third electrode of a same type and said third electrode on which said phosphor layer of said same type is formed belongs to said electrode group of a same type.

33. The method for driving the plasma display panel according to claim 32, wherein each electric potential at which said electrode group is held is set in a manner that a difference in a discharge initiating voltage between said first and third electrodes by a type of each phosphor decreases.

34. The method for driving the plasma display panel according to claim 31, further comprising a process of causing a discharge between said first and second electrodes to occur before causing a discharge between said first and third electrodes to occur, during said initializing period.

35. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, a plurality of third electrodes each being placed on a surface facing said first substrate and extending in a column direction orthogonal to a direction in which said first and second electrodes extend on said second substrate, and dielectric layer to cover said first and second electrodes, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur between said first and second electrodes by application of a pulse whose electric potential changes with time to said first electrode during said initializing period; and a process of causing said second electrode to be a floating electric potential and causing a electric potential of said second electrode to match a electric potential of said first electrode by capacitive coupling.

36. A method for driving a plasma display panel having first and second substrates being placed so as to face each other, a plurality of first electrodes each being placed on a surface facing said second substrate and each extending in a row direction on said first substrate, a plurality of second electrodes each pairing up with said first electrode and extending parallel to said first electrode and making up a display line by a space provided by said adjacent first electrode, a plurality of third electrodes each being placed on a surface facing said first substrate and extending in a column direction orthogonal to a direction in which said first and second electrodes extend on said second substrate, and a plurality of phosphors formed on said third electrode, and operating to have a matrix-type plasma display panel having one discharging cell at each of intersecting points of said first and second electrodes and said third electrode to perform a display in response to video signals, said method comprising:

a process of setting, in a field period making up one screen, at least one initializing period during which a state of said discharging cell is reset, at least one selective operation period during which a selective discharge occurs to select an ON or OFF state for displaying and at least one discharge sustaining period during which a discharge for displaying is achieved, and of causing a discharge to occur between said first and second electrodes by application of a pulse whose electric potential changes with time to said first electrode during said initializing period;

a process of causing a discharge of one polarity between said first and third electrodes to occur; and a process of causing intensity of said discharge between said first and second electrodes to decrease before said discharge of one polarity stops.

37. The method for driving the plasma display panel according to claim 36, wherein a process of decreasing intensity of said discharge between said first and second electrodes is performed during a period from a start of a discharge in a discharging cell having a low discharge initiating voltage between said first and third electrodes to a start of a discharge in a discharging cell having a high discharge initiating voltage between said first and third electrodes.

38. A method for driving a plasma display panel comprising:

a process of causing a discharge to occur between a plurality of first electrodes and a plurality of second electrodes being adjacent to each other in an initializing period; and a process of causing a discharge of one polarity to occur between said first electrodes and a plurality of third electrodes intersecting each other in said initializing period after said discharge between said first electrode and said second electrode starts in said initializing period.

* * * * *